US011633766B2

(12) United States Patent
Belue et al.

(10) Patent No.: US 11,633,766 B2
(45) Date of Patent: Apr. 25, 2023

(54) CLEANING APPARATUS, SYSTEM AND METHOD

(71) Applicant: GRONINGER CLEANING SYSTEMS, INC., Houston, TX (US)

(72) Inventors: Garth Belue, Houston, TX (US); Gijsbert Hendrik Klein, Rotterdam (NL); Berthold Schaap, Rotterdam (NL); Joost Kasbergen, Rotterdam (NL); Robbert Vijlbrief, Katy, TX (US)

(73) Assignee: GRONINGER CLEANING SYSTEMS, INC., Houston, TX (US)

( * ) Notice: Subject to any disclaimer, the term of this patent is extended or adjusted under 35 U.S.C. 154(b) by 403 days.

(21) Appl. No.: 16/932,390

(22) Filed: Jul. 17, 2020

(65) Prior Publication Data

US 2021/0016333 A1 Jan. 21, 2021

Related U.S. Application Data

(60) Provisional application No. 62/875,810, filed on Jul. 18, 2019.

(51) Int. Cl.
*B08B 9/08* (2006.01)

(52) U.S. Cl.
CPC ..... *B08B 9/0813* (2013.01); *B08B 2209/08* (2013.01)

(58) Field of Classification Search
CPC ..... B08B 9/08; B08B 9/0813; B08B 9/093; B08B 9/0933; B08B 9/0936; B08B 2209/027; B08B 2209/08
See application file for complete search history.

(56) References Cited

U.S. PATENT DOCUMENTS

| | | | | |
|---|---|---|---|---|
| 2,217,360 | A * | 10/1940 | William | C10B 33/006 239/245 |
| 2,218,625 | A | 10/1940 | Rudigier | |
| 3,544,012 | A | 12/1970 | McNally | |
| 3,880,359 | A | 4/1975 | Novy | |
| 4,163,455 | A | 8/1979 | Hebert et al. | |
| 4,805,650 | A * | 2/1989 | Yasui | B08B 9/093 212/281 |
| 5,095,929 | A * | 3/1992 | Harvey | B08B 9/093 134/167 R |
| 5,107,879 | A | 4/1992 | Harvey | |
| 5,353,298 | A | 10/1994 | Moulder | |
| 5,392,798 | A | 2/1995 | Hirose et al. | |
| 5,638,845 | A | 6/1997 | Oliver et al. | |
| 5,718,382 | A * | 2/1998 | Jaeger | B08B 9/0936 239/227 |
| 6,192,905 | B1 | 2/2001 | Mincy et al. | |
| 6,213,134 | B1 | 4/2001 | Pike | |
| 7,159,598 | B2 | 1/2007 | Gregory | |
| 7,264,009 | B2 * | 9/2007 | Gregory | B08B 9/093 134/102.1 |
| 8,871,033 | B2 | 10/2014 | Zink | |
| 2012/0067372 | A1 | 3/2012 | O'Quinn et al. | |

* cited by examiner

*Primary Examiner* — David G Cormier
(74) *Attorney, Agent, or Firm* — The Compton Law Firm, P.C.; Scott D. Compton

(57) ABSTRACT

The disclosure is directed to an apparatus, system and method for cleaning interior surfaces of storage containers such as tank trailers and other surfaces using a low volume of high pressure fluid. The apparatus of this disclosure includes one or more high pressure fluid conduits that can be extended and retracted within a storage container.

12 Claims, 45 Drawing Sheets

CLEANING APPARATUS, SYSTEM AND METHOD

CROSS-REFERENCE TO RELATED APPLICATIONS

This application claims benefit of U.S. Provisional Patent Application Ser. No. 62/875,810, filed on Jul. 18, 2019, the content of which is hereby incorporated by reference in its entirety.

STATEMENT REGARDING FEDERALLY SPONSORED RESEARCH OR DEVELOPMENT

Not applicable.

BACKGROUND OF THE DISCLOSURE

1. Field of the Invention

This disclosure relates generally in the field of fluid stream cleaning operations such as cleaning the interior surfaces of spaces including the interior surfaces of storage containers.

2. Background Art

Storage containers such as tank trailer storage containers, rail car tanks and other vessels used for storing and/or transporting flowable materials such as liquids, solids and combinations thereof can accumulate a build-up of material on their interior surfaces following use. To prevent contamination, the interior of such storage containers are typically cleaned or washed prior to reuse.

In North America, including the United States of America (hereafter the "U.S.A."), tank trailer storage containers (hereafter "tank trailers") and rail car tanks designed for the transport of flowable materials typically include a manway or manhole centrally disposed along the top of the tank trailer or rail car tank. An exemplary tank trailer 5 is provided in the prior art illustration of FIG. 1. Such tank trailers 5 typically range from about 12.2-12.8 meters (40.0-42.0 feet) in length, which provides about 6.1-6.4 meters (20.0-21.0 feet) in length on either side of the manhole 7. To date, cleaning of these types of tank trailers 5 typically involves certain cleaning standards according to the type of load that was previously carried in a particular tank trailer 5 and often requires manual inspection within a tank trailer 5 to insure a desired level of cleanliness following a cleaning operation. In North America, tank trailer 5 cleaning typically employs recirculation systems using low pressure, high volume water based fluids with a high chemical content at high fluid temperatures. Such systems require large volumes of water and chemicals for operation and often produce undesirable amounts of waste. Since such systems employ some form of recycling mode, the effectiveness of the chemicals may vary because various non-predictable chemical reactions may occur. This can make the cleaning process more difficult to predict and may cause uncontrolled safety issues for workers.

Alternative modes of cleaning in North America have been attempted using high pressure fluid nozzles as shown in FIG. 1, for emitting fluid jet streams 9 from a position below a manhole 7. However, the high pressure fluid jet streams 9 produced typically atomize prior to contacting the interior surface of the tank trailer 5, thereby reducing the fluid impact of the fluid jet streams 9, which often leads to a grating type pattern on the interior surface of a tank trailer 5 not achieving a desired cleaning of the interior of the tank trailer 5. Other spreader type systems have been attempted for reaching the distal interior surfaces of tank trailers 5, however such systems employ too low fluid pressure for effective cleaning of the interior of tank trailers 5.

Overcoming the above shortcomings is desired.

SUMMARY OF THE DISCLOSURE

The present disclosure is directed to an apparatus for directing high pressure fluid streams against one or more interior surfaces of a storage container having a manhole disposed along the top of the storage container, including (1) a cover assembly in fluid communication with one or more sources of high pressure fluid, the cover member comprising a mating member operationally configured to engage a manhole of a storage container and a cover member operationally configured to cover the manhole; (2) a support assembly attached to the cover member and in fluid communication with the cover member; (3) a drive rod assembly disposed through the cover member and the support assembly; and (4) one or more extendable assemblies attached to the support assembly and attached to the drive rod assembly, the one or more extendable assemblies having fluid outlets in fluid communication with the support assembly; wherein the drive rod assembly is operationally configured to extend and retract the one or more extendable assemblies.

The present disclosure is also directed to an apparatus for cleaning storage containers, including (1) a cover assembly in fluid communication with one or more sources of high pressure fluid and operationally configured to engage a manhole of a storage container and cover at least part of the manhole of the storage container; (2) a support assembly in fluid communication with the cover assembly; (3) a drive rod assembly; (4) a first extendable assembly having a first fluid outlet in fluid communication with the support assembly and an opposing second extendable assembly having a second fluid outlet in fluid communication with the support assembly; and (5) a locking assembly attached to the support assembly, the locking assembly including opposing pivotal catch arms operationally configured to direct the first extendable assembly and the second extendable assembly to a retracted position; wherein the drive rod assembly is operationally configured to simultaneously extend and retract the first and second extendable assemblies.

The present disclosure is also directed to a cleaning system for a tank trailer cleaning installation including (1) an apparatus operationally configured to direct high pressure fluid onto one or more interior surfaces of a tank trailer, the apparatus being insertable through a manhole of the tank trailer in a first retracted position and operationally configured to extend out in opposite directions to one or more second extended positions for simultaneously directing high pressure fluid onto one or more interior surfaces of the tank trailer; (2) a lift assembly operationally configured to move the apparatus vertically and horizontally; and (3) one or more high pressure fluid sources in fluid communication with the apparatus via one or more upstream fluid conduits; wherein the apparatus includes (a) a cover assembly operationally configured to engage and cover the manhole of the tank trailer, (b) a first extendable assembly with a first high pressure spray nozzle at its distal end and (c) an opposing second extendable assembly with a second high pressure spray nozzle at its distal end; and wherein the fluid in the one or more pressurized fluid sources is conveyed to the apparatus via the one or more upstream fluid conduits at an internal fluid pressures from 500.0 PSI to 5000.0 PSI to produce a fluid jet stream out through each of the first high pressure spray nozzle and the second high pressure spray nozzle having a flow rate of 52.0 gallons per minute at 500.0 PSI to 5000.0 PSI up to a distance of 3.05 meters (10.0 feet) without atomization of the fluid jet streams.

DEFINITIONS USED IN THE DISCLOSURE

Figure 1:
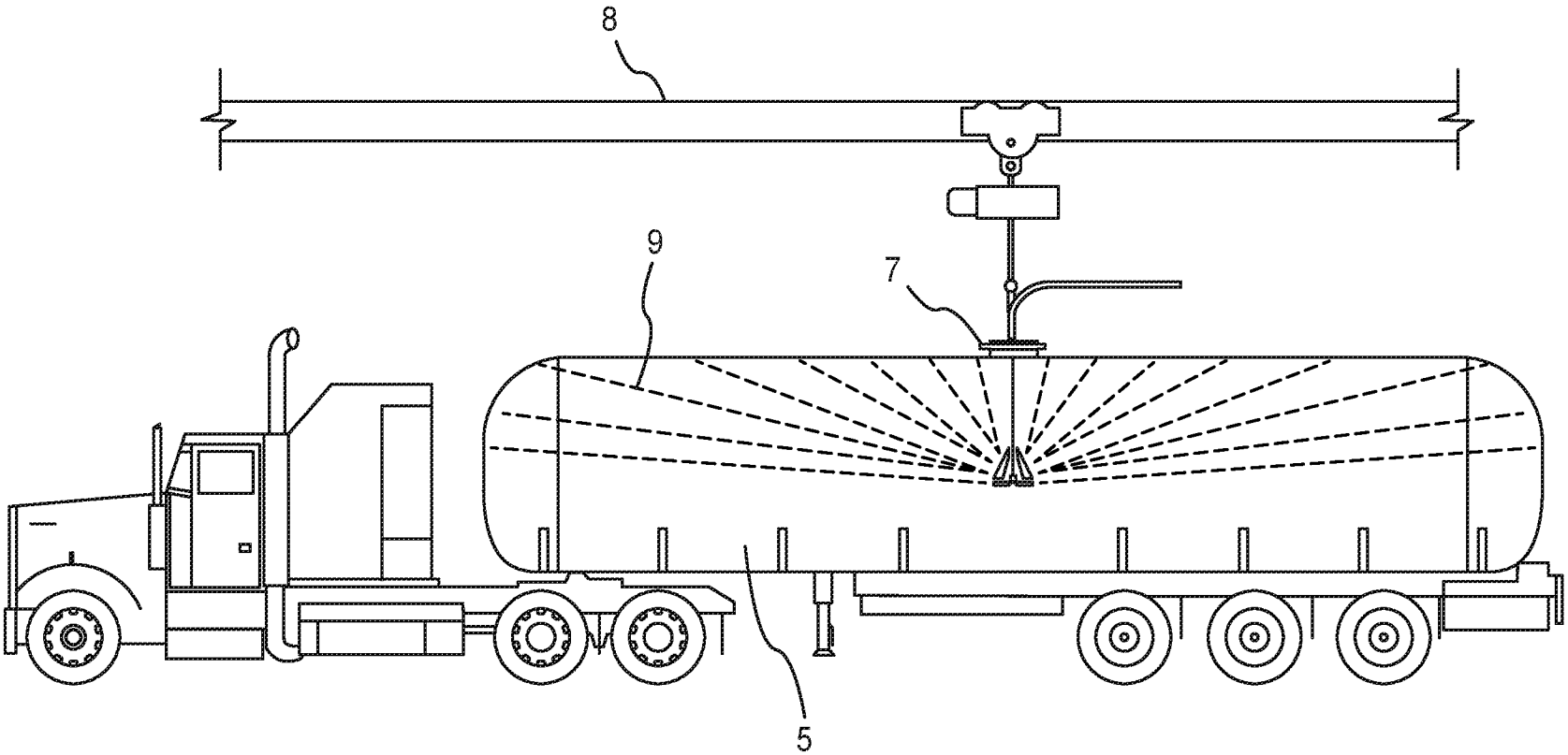
FIG. 1 (PRIOR ART)
FIG. 1 is a side view of a prior art fluid cleaning technique as performed on a tank trailer.

The term "at least one", "one or more", and "one or a plurality" mean one thing or more than one thing with no limit on the exact number; these three terms may be used interchangeably within this application. For example, at least one device means one or more devices or one device and a plurality of devices.

The term "about" means that a value of a given quantity is within ±20% of the stated value. In other embodiments, the value is within ±15% of the stated value. In other embodiments, the value is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value.

The term "substantially" or "essentially" means that a value of a given quantity is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value. In other embodiments, the value is within ±0.5% of the stated value. In other embodiments, the value is within ±0.1% of the stated value.

DETAILED DESCRIPTION OF THE DISCLOSURE

For the purposes of promoting an understanding of the principles of the present disclosure, reference is now made to the embodiments illustrated in the drawings and particular language will be used to describe the same. It is understood that no limitation of the scope of the claimed subject matter is intended by way of the disclosure.

The terms "first," "second," and the like, herein do not denote any order, quantity, or importance, but rather are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable. For example, in some circumstances, an event or capacity can be expected, while in other circumstances, the event or capacity cannot occur. This distinction is captured by the terms "may" and "may be."

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should he read as meaning "at least one," "one or more," or the like. The use of the term "assembly" does not imply that the components or functionality described or claimed as part of an assembly are all necessarily configured in a common package.

As used in this specification and the appended claims, the phrase "storage container" may refer to portable and/or stationary vessels, tanks, silos, mixers, blenders, other hollow articles, and combinations thereof operationally configured to hold and/or store flowable or moveable fluids, solids, and combinations thereof therein (hereafter "flowable fluids"). Exemplary tanks include, but are not necessarily limited to tank trailers, ISO tanks, rail car tanks, underground storage tanks, and combinations thereof. Herein, "tank truck," "tanker truck," and "tanker" commonly refer to a motor vehicle pulling a tank trailer 5 or other sealable storage container for the storage and/or transport of flowable fluids. As of the time of this disclosure, in North America, e.g., the U.S.A., a common tank trailer 5 is provided with a single access port such as a top manhole 7 centrally disposed, i.e., located halfway, along the length of the tank trailer 5 as shown in FIG. 1.

Herein, "kPa" refers to kilopascal, "PSI" refers to pounds-force per square inch and "BSP" refers to British Standard Pipe. Herein, "CMR" stands for "Convention Relative au Contrat de Transport International de Marchandises par la Route" as understood by the skilled artisan in the field of road and highway transport. Herein, "PLC" refers to a programmable logic controller or programmable controller. Herein, "GPM" refers to gallons per minute and "LPM" refers to liters per minute. Herein, "ISO" refers to the International Organization for Standardisation. As understood by the skilled artisan, an "ISO tank" is a tank container built to an ISO standard. Herei, "AISI" refers to American Iron and Steel Institute as understood by persons of ordinary skill in the iron and steel industry.

For purposes of this disclosure, flowable fluids may include, but are not necessarily limited to flowable or moveable liquids, gases, supercritical fluids, gels, and combinations thereof for storage within a storage container. Flowable solids may include, but are not necessarily limited to flowable or moveable dry bulk materials also referred to as commodity cargo or "bulk cargo" as defined in 46 U.S.C. § 40102 at the time of this disclosure. Exemplary dry bulk materials include, but are not necessarily limited to (1) granules, e.g., salt, sugar, sand, roofing granules, fertilizer, rice, coal, coffee, (2) pebbles, e.g., plastic pellets, grit, (3) powders, e.g., cement, flour, lime, (4) irregulars, e.g., animal feeds, quarried materials, and combinations thereof for storage within a storage container. Other non-limiting examples of flowable solids include fuller's earth, flour, fly ash, charcoal, grain, and caustic soda. In regard to storage containers, "to clean," "cleaning," "wash" and like terms refer to the removal of storage substance(s), e.g., flowable materials, and/or other foreign substances from one or more target surfaces of a storage container, including but not necessarily limited to one or more target interior surfaces, to a degree satisfactory for reuse of the storage container without threat of contamination to a new load of fluids and/or solids to be carried by the storage container.

An apparatus of the system described herein may be constructed from one or more materials durable for cleaning operations as described and/or as may be required by law and/or regulation. In one aspect, the present disclosure provides a system including an apparatus for operation at low internal fluid pressures or for operation at high internal fluid pressures ranging from or about 3447.4 kPa (500.00 PSI) up to or about 34473.8 kPa (5000.0 PSI). As discussed herein, variations in the apparatus may be provided as desired or as may be otherwise required for a particular cleaning operation. In addition, the apparatus may include one or more component parts constructed from one or more materials suitable for providing operative structural support in connection with one or more particular target cleaning operations. Suitable materials of construction for the apparatus include, but are not necessarily limited to, those materials resistant to chipping, cracking, excessive bending and reshaping as a result of weathering, heat, moisture, other outside mechanical and chemical influences, as well as physical impacts to the apparatus. Particular materials of construction may include, but are not necessarily limited to one or more metals, one or more plastics, one or more filled composite materials, and combinations thereof depending on the type or types of cleaning activities to be performed with a particular apparatus. Suitable metals include ferrous metals and non-ferrous metals. As discussed below, one suitable ferrous metal for high fluid pressure cleaning operations may include stainless steel. Suitable plastics include thermoplastics such as polyvinyl chloride ("PVC") and chlorinated polyvinyl chloride ("CPVC").

In one embodiment, the present disclosure is directed to an apparatus for cleaning interior surfaces of storage containers. The apparatus includes high pressure fluid conduits extendable and retractable within one or more types of storage containers operationally configured to emit high pressure cleaning fluid onto the interior surfaces of storage containers.

In another embodiment, the present disclosure is directed to a system for cleaning interior surfaces of storage containers.

In another embodiment, the present disclosure is directed to a method for cleaning interior surfaces of storage containers.

In another embodiment, the present disclosure provides a system under control of an operator for cleaning interior surfaces of storage containers. The system may include high fluid pressure, hot water, steam, detergents, and combinations thereof.

In another embodiment, the present disclosure provides a system for cleaning the interior surface(s) of one or more storage containers using a low volume of high pressure fluid. Regarding the cleaning of a tank trailer 5 as shown in FIG. 1, the present system is operationally configured to perform a cleaning operation in about one third the time compared to prior art cleaning operations used to clean the same tank trailer 5 with a low pressure, high temperature, heavy chemical, high volume water cleaning operation as is employed in North American at the time of this disclosure. By speeding up the cleaning process, the system of this disclosure makes for better utilization of a fleet of tank trailers 5 in commerce.

In another embodiment, the disclosure provides a system and apparatus for cleaning the interior of a storage container, the apparatus having opposing high pressure fluid delivery conduits extendable within the storage container out to a desired distance, each conduit having a high pressure nozzle effective for directing high pressure fluid streams against the interior surface of the storage container.

In another embodiment, the disclosure provides a system and apparatus for directing streams of cleaning fluid onto multiple interior surfaces of a storage container simultaneously.

In another embodiment, the disclosure provides an apparatus for receiving pressurized fluid from one or more upstream fluid sources and routing the fluid through a manhole of a tank trailer 5 against opposing inner surfaces of the tank trailer 5 at a desired fluid pressure and/or temperature.

In another embodiment, the disclosure provides an apparatus for cleaning surfaces of elongated enclosed spaces using low volume high pressure fluid for a period of time required for cleaning surfaces of such spaces.

In another embodiment, the disclosure provides a system including one or more fluid sources and a retractable apparatus in fluid communication with one or more fluid sources, the retractable apparatus being operationally configured to be directed into a storage container via a manhole of the storage container in a manner effective to fluidly seal the manhole while simultaneously directing pressurized fluid into the storage container for impacting one or more interior surfaces of the storage container.

In another embodiment, the disclosure provides an apparatus for directing pressurized fluid onto interior surfaces of a single manhole tank trailer 5, the apparatus being operationally configured to be directed or inserted into a tank trailer 5 via its manhole in a first retracted position or orientation and extend out radially according to the axial center of the manhole in opposite directions to one or more second extended or operable positions for simultaneously directing one or more fluids onto interior surfaces of the tank trailer 5 including the inner surface of the tank trailer 5 at or near opposite ends within the tank trailer 5.

In another embodiment, the disclosure provides a system, apparatus and method for cleaning the interior of a hollow member defined by a top manhole. Suitably, the apparatus is defined by a longitudinal axis for concentric alignment with the manhole when directing, i.e., during insertion, of the apparatus into the hollow member via the manhole. The apparatus includes opposing retractable fluid conduits that may extend out within a hollow member in opposing directions in a manner effective to direct pressurized fluid onto differing interior surfaces within the hollow member.

In another embodiment, the disclosure provides a removable storage container cleaning apparatus adjustable between a first non-operable retracted orientation and a second operable fully extended orientation. The apparatus may also be extended to one or more other operable less than fully extended orientations. The apparatus may be directed in and out of a top manhole of a storage container in its first non-operable retracted orientation and directed to one or more operable extended positions when located within the storage container for directing pressurized fluid against interior surfaces of the storage container. In one embodiment, the apparatus includes opposing retractable fluid conduits operationally configured to extend out radially within the storage container relative the location of the manhole.

In another embodiment, the disclosure provides an apparatus including two opposing articulated members operable as fluid conduits for directing pressurized fluid onto interior surfaces of a target storage container.

In another embodiment, the disclosure provides an apparatus including two opposing articulated members operable as fluid conduits for directing pressurized fluid onto inner surfaces of a target storage container.

In another embodiment, the disclosure provides an apparatus including two opposing articulated members operable for remote cleaning of interior surfaces of one or more target storage containers.

In another embodiment, the disclosure provides an apparatus for directing one or more pressurized fluids onto interior surfaces of tanks, pipes, enclosed chambers, rooms, and other spaces defined by walls, baffles, windows, and/or other types of interior surfaces.

In another embodiment, the disclosure provides an apparatus for directing one or more pressurized fluids onto target surfaces, the apparatus having opposing support members and fluid conduits assembled together in a scissor-type configuration. In one embodiment, the opposing support members may include a plurality of support arm members and a plurality of fluid conduit members assembled together in a scissor-type configuration.

In another embodiment, the disclosure provides a tank cleaning apparatus including a fluid spreader assembly that may be manually or remotely manipulated causing extension and retraction movements of the fluid spreader assembly as desired.

In another embodiment, the disclosure provides a system for cleaning the interior of storage containers including the following cleaning operations: (1) food-grade cleaning, (2) Kosherization, (3) shipper specific cleaning, (4) cleaning of caustic storage containers, (5) flushing, (6) steam cleaning, (7) hot and cold rinsing, (8) presolve washing, and combinations thereof.

In another embodiment, the disclosure provides a cleaning system, apparatus and method for use by commercial tank cleaning service providers designed to drastically reduce cleaning cycle time, reduce water consumption, and as a result, produce less waste and thus reduce the environmental impact compared to known high fluid volume low fluid pressure tank cleaning operations. By way of the present system, apparatus and method, tank truck operators may increase utilization of a tank truck fleet, improve product delivery windows and experience a huge improvement of cleanliness of storage containers including, but not limited to tank trailers 5.

In another embodiment, the disclosure provides a system, apparatus and method for automated cleaning of the interior of storage containers using cleaning fluid comprising clean potable water and one or more chemicals added to or otherwise injected into the water according to a specific cleaning operation. In one embodiment, one or more of the chemicals may be biodegradable. The system may include a set of cleaning programs according to one or more cleaning operations to be performed. Each cleaning program may be specific to one or more particular cleaning operations. In one mode of operation, once a cleaning program is selected an operator(s) is not required to be in the vicinity of the tank trailer 5 being cleaned. In one particular embodiment, the system includes a recycling system whereby only the sludge removed from within the tank trailer 5 need be disposed of. The cleaning water of the system may be reused without end by way of the recycling system.

In another embodiment, the disclosure provides a system, apparatus and method for automated cleaning of storage containers using a low volume of high pressure fluid wherein all system equipment including, but not necessarily limited to all fluid conduits, e.g., hoses, piping, valves, couplings, seals and spray nozzles are operationally dedicated for internal high fluid pressure use up to 34473.8 kPa (5000.0 PSI).

Figure 2:
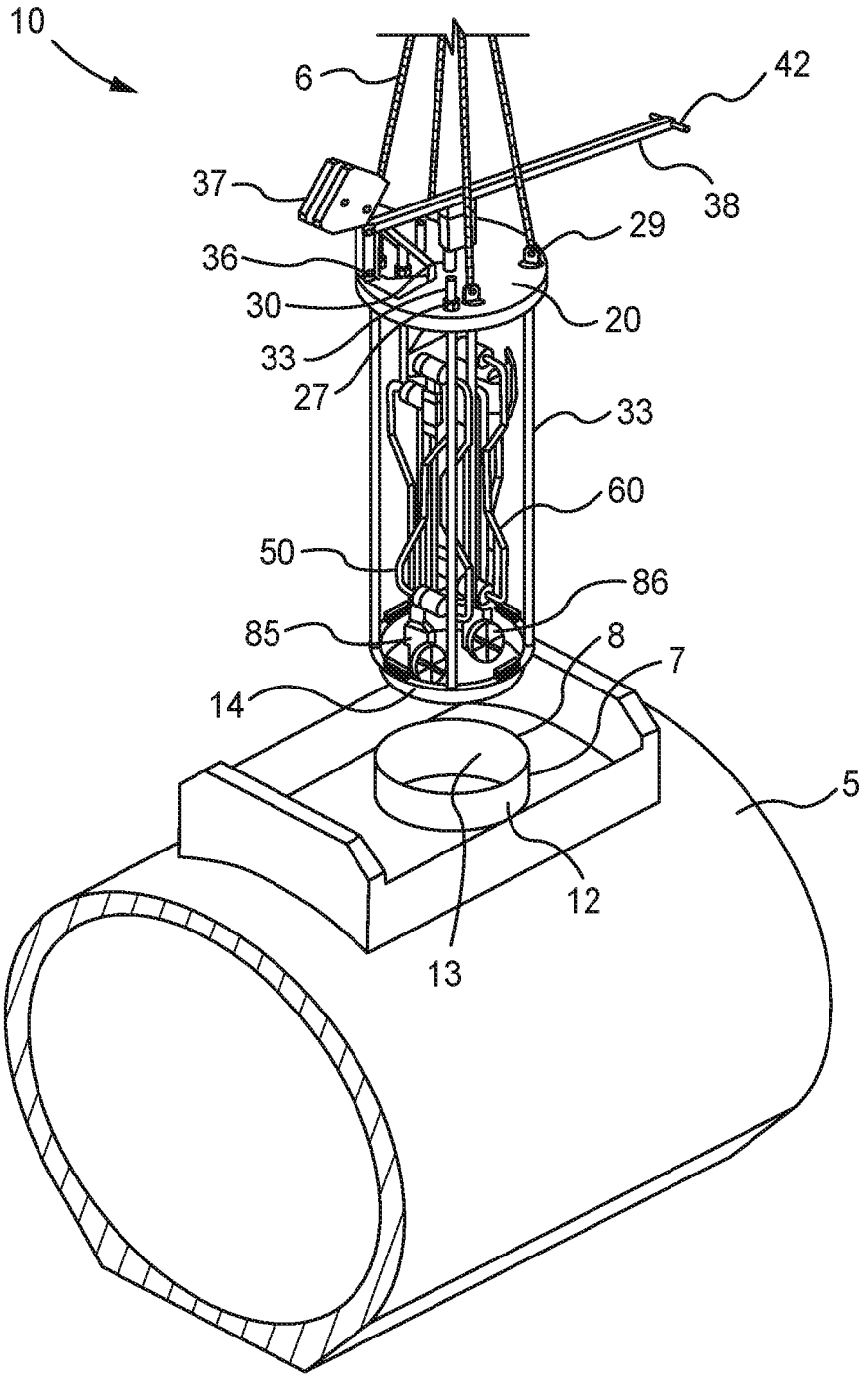
FIG. 2 is a perspective view of an embodiment of the apparatus of this disclosure and a partial view of a tank trailer.

With reference to FIG. 2, a first embodiment of a cleaning apparatus 10 operationally configured to convey pressurized fluid up to 34473.8 kPa (5000.0 PSI) from one or more upstream locations to one or more interior surfaces of a tank trailer 5 or other storage container is provided. As described below, this particular embodiment of the apparatus 10 is operationally configured for manual operation.

Suitably, the cleaning apparatus 10 (hereafter "apparatus 10") is moveable or transportable along the x, y and z axes in a manner effective to align the apparatus 10 with an access port such as a manhole 7 for insertion of at least part of the apparatus 10 within the interior of the tank trailer 5 (hereafter "tank 5"). In this embodiment, the apparatus 10 includes a cover assembly provided as a two-part cover assembly operationally configured to be mated to a manhole 7 of a tank 5 in a manner effective to cover a manhole 7 or at least substantially cover a manhole 7 along its perimeter during operation of the apparatus 10. A two-part cover assembly of this embodiment suitably includes a first member or ring member 14 operationally configured to engage or mate with a manhole 7 in a manner effective to align the apparatus 10 vertically for insertion of the apparatus 10 through a manhole 7 into a tank 5. As shown in FIG. 2, a typical manhole 7 includes a cylindrical sidewall with a circular rim 8, an outer surface 12 defining an outer diameter of the manhole 7 and an inner surface 13 defining an inner diameter of the manhole 7. As such, the ring member 14 may also be referred to as a "mating member" of the apparatus 10. The two-part cover assembly also includes a second member or circular top cover member 20 axially aligned with the ring member 14 and operationally configured to engage at and/or cover the ring member 14 or at least part of the ring member 14 in a manner effective to (1) prevent solid and/or liquid foreign substances from entering a tank 5 via the manhole 7 and (2) prevent high pressure fluid, e.g., fluid spray, from exiting the tank 5 via the manhole 7 during cleaning operations of the apparatus 10 within a tank 5. Accordingly, any solids and/or liquids that are not part of a tank 5 cleaning operation enter into a tank 5 through a manhole 7 when the cover assembly is mated to a manhole 7.

As understood by the skilled artisan, the apparatus 10 is operationally configured for use with tanks 5 having standard type cylindrical manholes 7 as are commercially available at the time of this disclosure. In another implementation, the ring member 14 and cover member 20 may be operationally configured to mate to a different shape manhole 7, for example, non-circular manholes including, but not necessarily limited to oval shape manholes and multi-sided manholes 7. As such, the apparatus 10 may be designed to accommodate particular shaped manholes 7. Moreover, the present system may include one or more tanks 5 having a particular shaped manhole 7 and an apparatus 10 operationally configured for use with such manhole 7.

Figure 3:
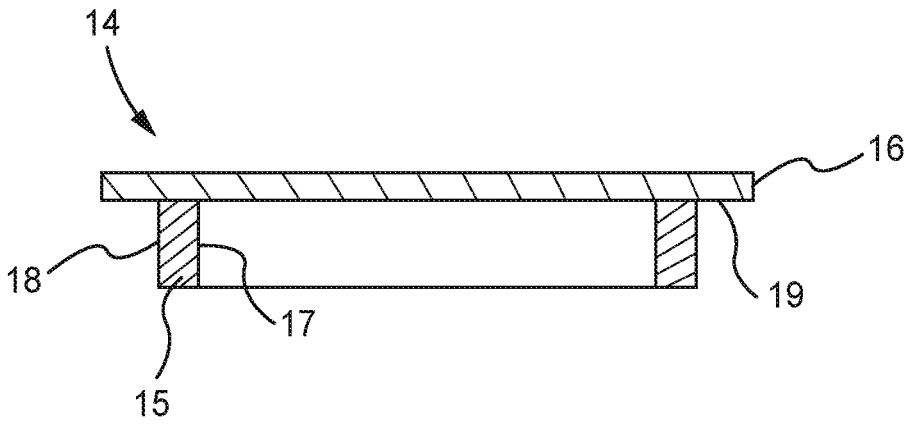
FIG. 3 is a side sectional view of a simplified ring member of an embodiment of the present apparatus.

Turning to FIG. 3, one suitable ring member 14 may include a cylindrical sidewall 15 operationally configured to mate with a manhole 7, the sidewall 15 having an inner surface 17 defining an inner diameter of the ring member 14 and an outer surface 18 defining a first outer diameter of the ring member 14. As discussed below, in another embodiment the sidewall 15 may be conical in form. In this embodiment, the ring member 14 also includes a perimeter lip member 16 extending out beyond the outer surface 18 of the sidewall 15 defining a second outer diameter of the ring member 14. In this embodiment, the outer diameter of the outer surface 18 of the sidewall 15 may be the same or substantially similar as the inner diameter of a corresponding manhole 7. At a mated position including the sidewall 15 of the ring member 14 set within the manhole 7, the outer surface 18 of the sidewall 15 may lies in abutment or substantial abutment with the inner surface 13 of the manhole 7. During installation of the apparatus 10, the sidewall 15 is suitably inserted within the manhole 7 until the lip member 16 engages at least part of the rim 8 of the manhole 7 without interfering with a hinge connection of the manhole 7. In other words, the rim 8 of the manhole 7 acts as a seat for an abutment surface 19 of the lip member 16.

As further shown in FIG. 3, the lip member 16 may include a planar abutment surface 19 for engaging a level upper surface of a rim 8 of a manhole 7. In another embodiment, the abutment surface 19 may include a circular groove at a depth within the lip member 16 effective to receive part of a rim 8 therein. The abutment surface 19 may also include a different surface configuration other than a planar surface as may be necessary for abutment with an un-level rim 8 of a manhole 7. As also understood by the skilled artisan, the lip member 16 may include an outer diameter greater than, less than or equal to the outer diameter of a corresponding manhole 7.

Although the apparatus 10 may be built to scale, in one particular implementation the apparatus 10 is contemplated for use with a manhole 7 having an inner diameter of or about 50.8 cm (20.0 inches). Accordingly, the ring member 14 of the apparatus 10 suitably includes a sidewall 15 having an outer diameter of or about 50.8 cm (20.0 inches) and a lip member 16 with an outer diameter of or about equal to the outer diameter of the manhole 7.

Figure 4:
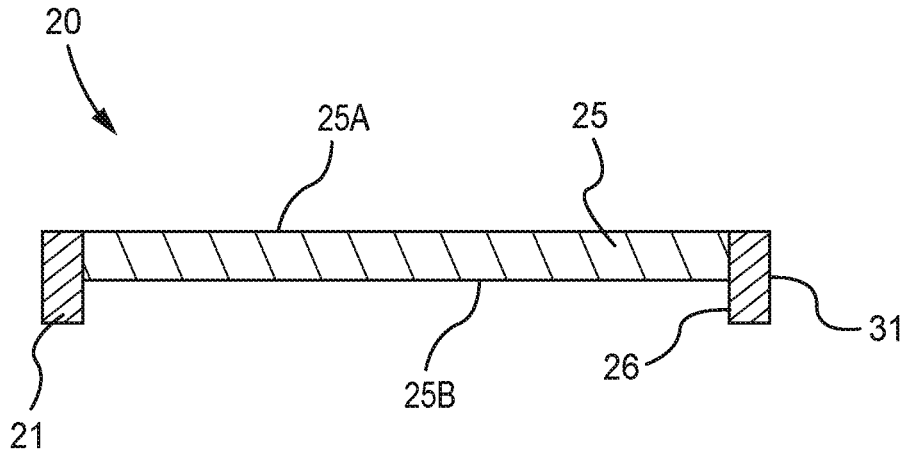
FIG. 4 is a side sectional view of a simplified cover member of an embodiment of the present apparatus.

Turning now to FIG. 4, one suitable cover member 20 may include a planar main body or planar section 25 defined by an outer surface 25A and an inner surface 25B, an annular side wall 21 defined by an inner surface 26 for fitting over a corresponding ring member 14 and manhole 7 in a cap or lid type configuration. As such, the inner surface 26 of the side wall 21 suitably has an inner diameter of or about equal to the outer diameter of the corresponding lip member 16 and manhole 7. Suitably, the weight of the apparatus 10 is effective to maintain the cover member 20 in an abutment position with the ring member 14 and manhole 7 during operation of the apparatus 10.

Referring again to FIG. 2, the ring member 14 and cover member 20 are interconnected via one or more guide members 33 attached to the lip member 16 at a first end at different points and extend out in parallel alignment about the lip member 16 as shown forming a cage type configuration for other various components of the apparatus 10 during non-use and transport. In this embodiment, the cover member 20 includes a plurality of apertures 23 (see FIG. 5), each aperture 23 being operationally configured to receive a second end of a corresponding guide member 33 there through. Suitably, the one or more guide members 33 are operationally configured to axially align the ring member 14 and the cover member 20 including as the cover member 20 is directed toward and apart from the ring member 14. In one embodiment, the guide members 33 may be cylindrical rod type members as shown. In another embodiment, the guide members 33 may be elongated multi-sided members and/or elongated non-circular members, e.g., an oval shape surface. The guide members 33 of this disclosure may also be provided as solid members, as hollow members or as partially solid and partially hollow members. As understood by the skilled artisan, the size and/or shape of the apertures 23 are substantially similar as corresponding guide members 33 to provide a flush fit of the guide members 33 within the apertures 23 to assist in maintaining an axial alignment between the ring member 14 and the cover member 20.

Figure 6:
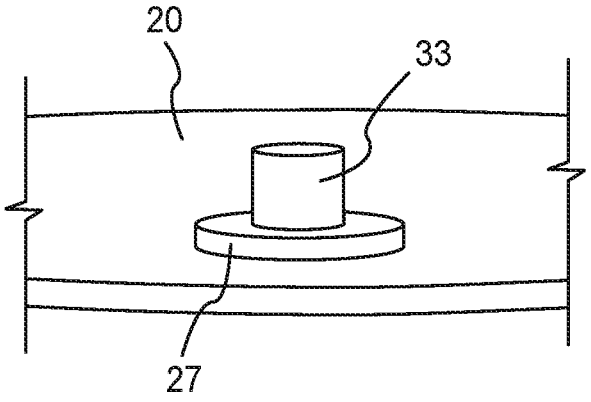
FIG. 6 is a partial perspective view illustrating the interconnection between a cover member and a guide member of an embodiment of an apparatus of the present disclosure.

With attention to both FIGS. 2 and 6, each of the guide members 33 are secured to the cover member 20 via collar members 27 or other clamp type members or assemblies, e.g., a collar assembly 27, of component parts located external the cover member 20 in a manner effective to contact the guide members 33 and the cover member 20 and suspend the guide members 33 and ring member 14 as depicted in FIG. 2. In one embodiment, each collar member 27 and corresponding guide member 33 may be provided as a one-piece construction. In another embodiment, one or more collar members 27 may be permanently secured to each of the guide members 33, e.g., via welds, via one or more adhesives, and combinations thereof. In another embodiment, one or more of the collar members 27 may be provided as removable members attached to the guide members 33, for example, collar members 27 may be secured to the guide members 33 via release pins, clamps, or threadedly secured to guide member 33, and combinations thereof.

Figure 5:
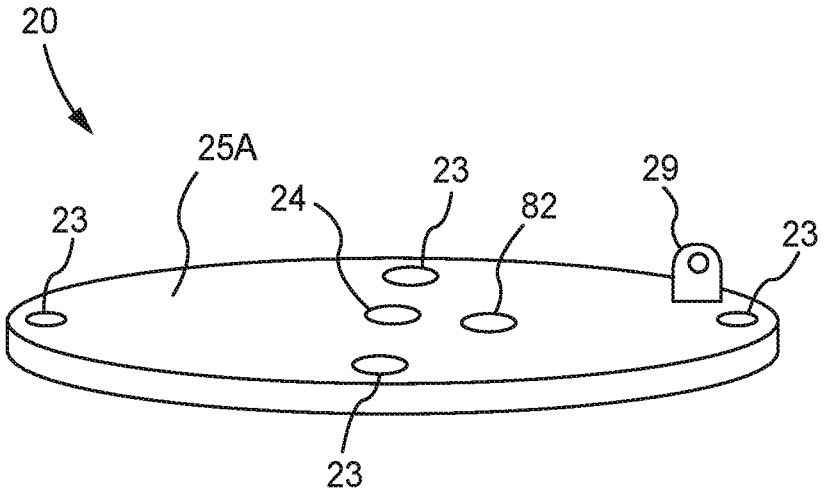
FIG. 5 is a simplified perspective view of a simplified cover member of an embodiment of the present apparatus.

With reference to FIGS. 2 and 5, the cover member 20 also includes one or more lifting attachment surfaces 29 provided as hooks, lift eyes, handles or the like for attachment of lifting or hoisting equipment (see lift assembly 6 in FIG. 2) such as shackles, hoist rings, hooks, turnbuckles, eye bolts, masterlinks, rope, cable, chain, belts, and combinations thereof and/or or other similar lifting or transport construction configured to move the apparatus 10 along the x, y and z axes, e.g., moving the apparatus 10 from a storage location to a mated position within a tank 5 and vice versa. In an embodiment including a plurality of lift eyes 29 as shown in FIG. 2, each of the lift eyes 29 is suitably spaced apart in a manner effective to maintain the cover member 20 in a substantially horizontal orientation during transport of the apparatus 10 as is common in industrial lift type transport operations.

With reference to FIGS. 2 and 5, the cover member 20 includes a centrally located aperture 24 for receiving a drive rod 30 there through. In this embodiment, the central aperture 24 is circular in shape for receiving a cylindrical drive rod 30 there through. In another embodiment, the shape of the central aperture 24 and drive rod 30 may be multi-sided and/or curved non-circular members, e.g., oval shaped, and/or irregular shaped having straight and/or curved sides. In another embodiment, the aperture 24 may be located at a non-central location along the cover member 20. As understood by the skilled artisan, the size and/or perimeter shape of the aperture 24 is the same or substantially similar as the size and perimeter shape of the drive rod 30 for a flush fit maintaining desired alignment of the drive rod 30 as the drive rod 30 is directed linearly in either direction.

Figure 7:
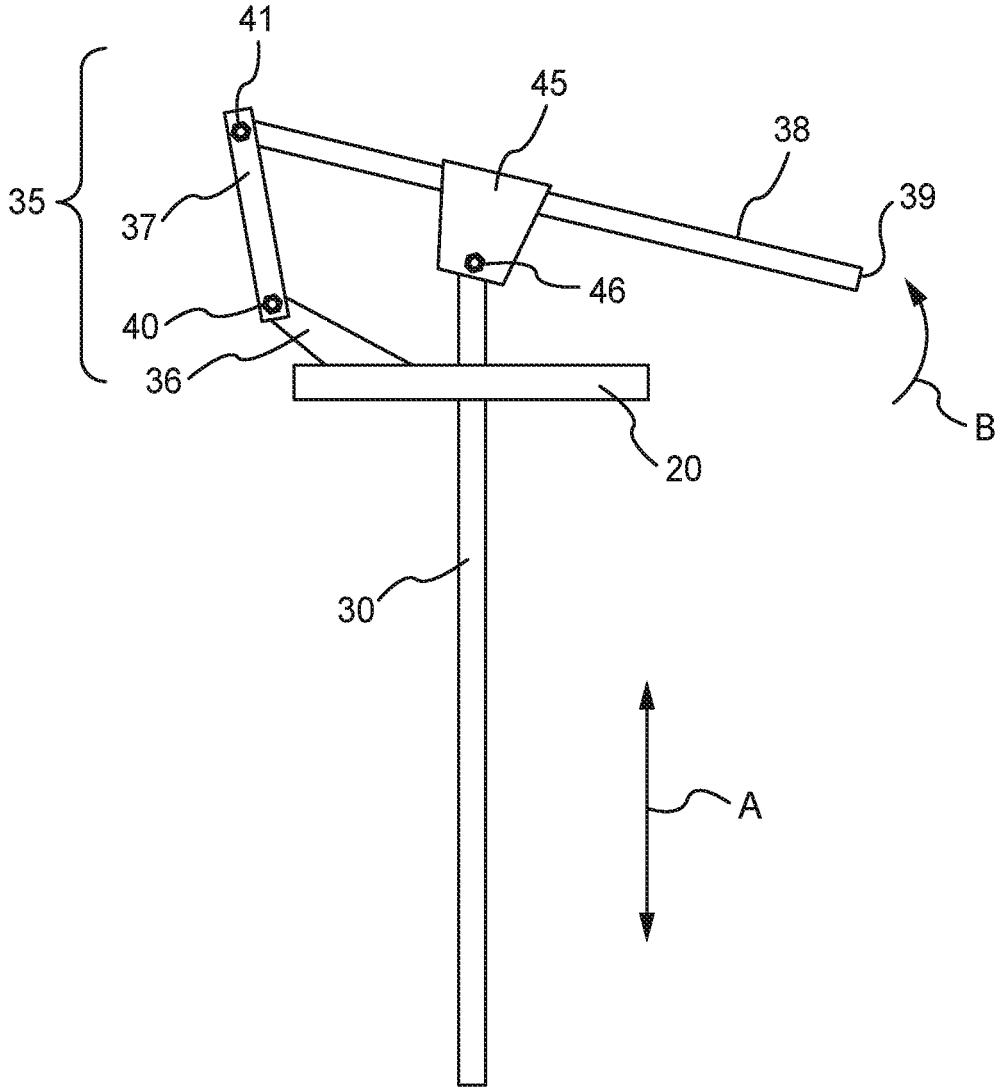
FIG. 7 is a side view of a simplified illustration of a control assembly and drive rod of an embodiment of an apparatus of the present disclosure.

Turning to FIG. 7, the apparatus 10 also includes a manually operable control assembly 35 for directing the drive rod 30 linearly in opposing directions according to directional arrow A. As shown in this embodiment, the control assembly 35 includes a fixed base 36 and a first link member 37 pivotally interconnecting the fixed base 36 and an elongated lever 38 via a fixed hinge 40 and pivot point 41 in a manner effective to allow a free end 39 of the lever 38 to be directed a predetermined travel distance in opposing directions for applying an axial drive force to the drive rod 30 through a desired linear travel distance. Suitably, the lever 38 is pivotally attached to the first end of the drive rod 30 at a pivot or fulcrum point 46 via an interconnect member such as a plate or housing 45. The fixed hinge 40, pivot point 41 and fulcrum point 46 are formed via corresponding apertures and pivot pins or the like as understood by persons of ordinary skill in the art of pivotal connections. In operation, the free end 39 of the lever 38 may be directed from a first position as shown in FIG. 7 to one or more second positions by directing the free end 39 away from the cover member 20 (according to directional arrow B). A maximum second position of the free end 39 suitably determines the maximum linear travel distance of the drive rod 30 out beyond the outer surface 25A of the cover member 20. In one embodiment, the free end 39 may include a handle 42 as shown in FIG. 2. In another embodiment, the free end 39 may be provided as a flat distal end of the lever 38 as shown in FIG. 7. In another embodiment, the distal end 38 of the lever 38 may be rounded off. The lever 38 may also include a rubber hand grip as is common in the field of hand tools and other manually operated hand gripped items.

In another embodiment, the control assembly 35 may be fitted with a drive motor for remotely directing the lever 38 through its travel distance. In another embodiment, a lever 38 may be replaced by an automated control system for remote control of the drive rod 30 via a motor for applying an axial drive force to the drive rod 30, e.g., an electric linear actuator, a pneumatic linear actuator, a hydraulic linear actuator, as such are understood by the skilled artisan. Herein, the drive rod 30 and control assembly 35 may be referred to collectively as a "manual drive assembly" of the apparatus 10 of this embodiment.

Figure 8:
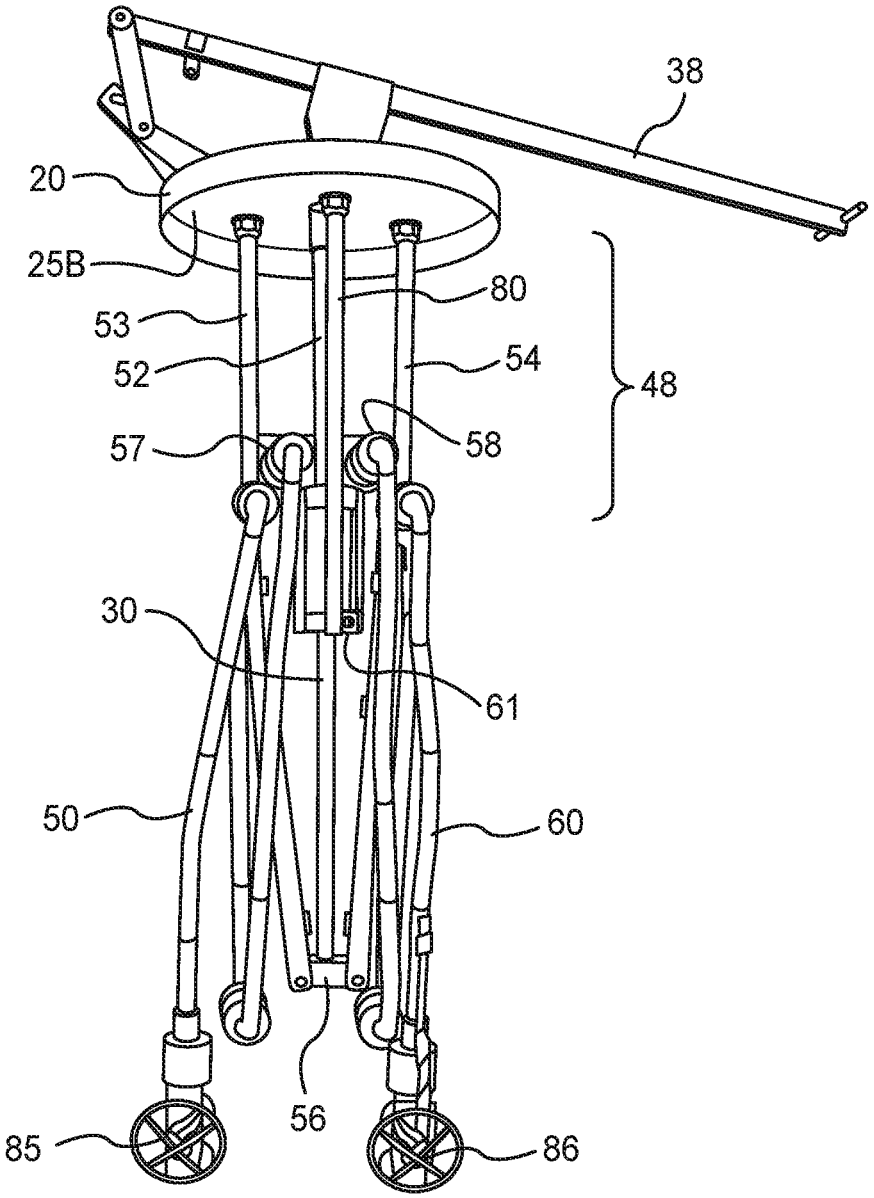
FIG. 8 is a perspective view of an embodiment of an apparatus of the present disclosure in a fully retracted position.
Figure 9:
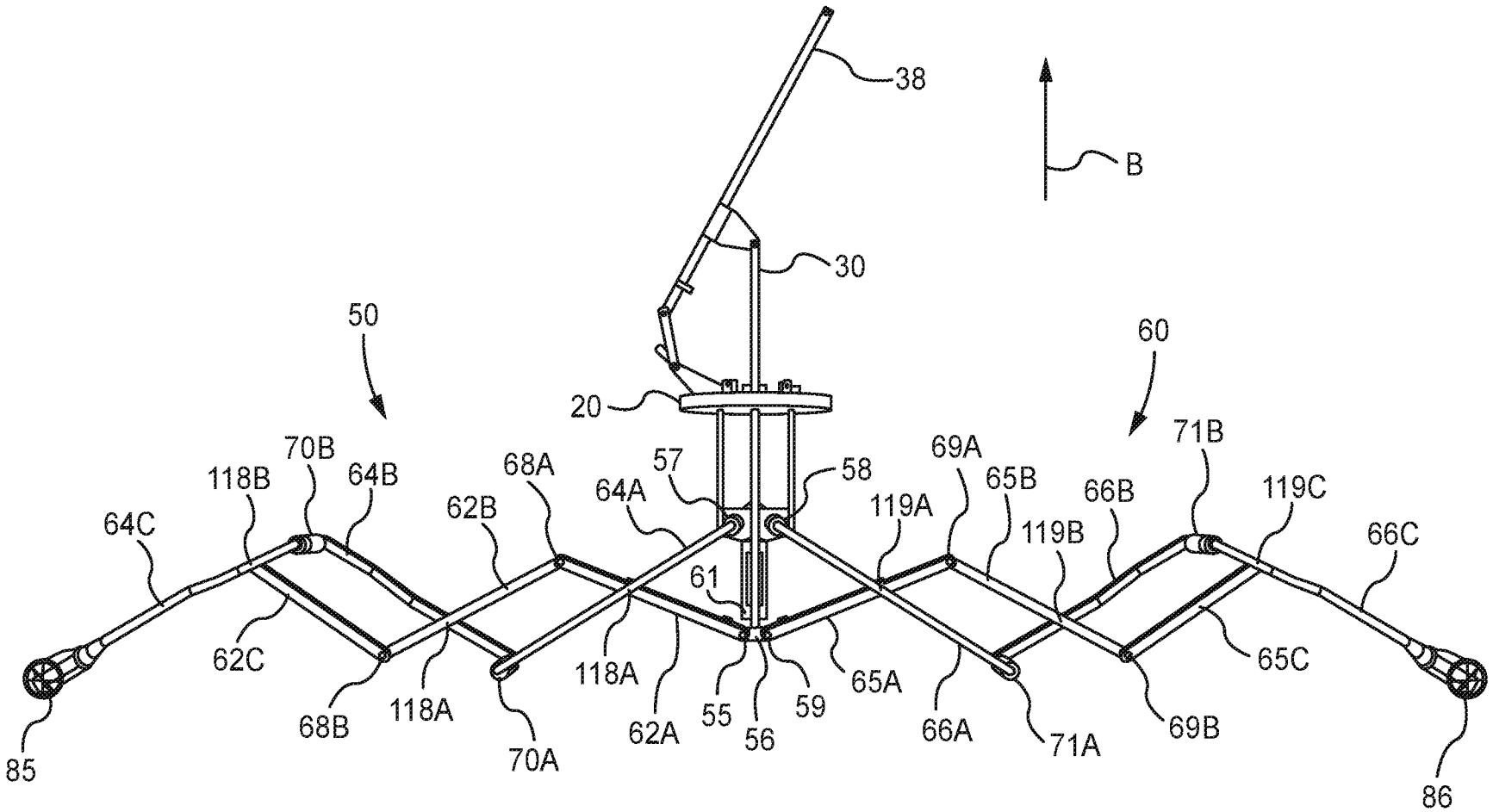
FIG. 9 is a side view of the apparatus of FIG. 8 in a fully extended position.

Referring to FIGS. 8 and 9, the apparatus 10 of FIG. 2 includes a support assembly 48 releasably attached to the inner surface 25B of the cover member 20, e.g., releasably attached via threaded nuts, and one or more extendable assemblies attached or secured to the support assembly 48, the one or more extendable assemblies including one or more fluid outlets located at or near the distal ends of the one or more extendable assemblies. In this embodiment, the apparatus 10 includes a first extendable assembly 50 and an opposing second extendable assembly 60, each of which is attached to the support assembly 48 and the drive rod 30 in a manner effective for simultaneous extension and retraction of the extendable assemblies 50, 60, i.e., the extendable assemblies 50, 60 are extended and retracted in unison, as the drive rod 30 is directed linearly according to directional arrow A. In particular, the fixed support assembly 48 includes (1) a fixed tubular member 52 that is attached to the cover member 20 and axially aligned with the central aperture 24 for receiving the drive rod 30 there through, (2) opposing fixed supports 53, 54 providing attachment surfaces for the opposing first extendable assembly 50 and the second extendable assembly 60 and (3) fluid junctions 57, 58 disposed between the fixed supports 53, 54 on either side of the tubular member 52 as shown. In one embodiment, the inner surface of the fixed tubular member 52 may include an inner diameter or inner length and width or other shape the same or substantially similar as the corresponding drive rod 30 located therein. In addition, the tubular member 52 may also include a stop member 61 operationally configured to contact a drive rod connection member 56 in a manner effective to dictate the travel distance of the drive rod 30 establishing maximum extension of the first and second extendable assemblies 50, 60 as shown in FIG. 9.

In this embodiment, the first extendable assembly 50 includes three support arm members 62A-62C and three fluid conduit members 64A-64C assembled in a scissor extendable configuration as shown. Likewise, the second extendable assembly 60 also includes three support arm members 65A-65C and three fluid conduit members 66A-66C assembled in a scissor extendable configuration.

Suitably, the support arm members (or "arm members") and fluid conduit members of each extendable assembly 50, 60 are pivotally attached and defined by cross angles providing a scissor extendable or lazy tong configuration for extension and retraction of each extendable assembly 50 and 60. Although the first extendable assembly 50 and the second extendable assembly 60 of this embodiment are provided having three arm members, a different number of individual arm members of each assembly 50, 60 may be employed in another embodiment.

In one embodiment, each of the individual arm members 62A-62C and 65A-65C may include a similar configuration, shape, size and/or length. In another embodiment, or one or more individual arm members may differ in configuration, shape, size and/or length from one or more of the other arm members. In addition, one of the extendable assemblies 50 or 60 may include a different number of arm members than the other assembly. Also, one extendable assembly, first extendable assembly 50 or the second extendable assembly 60, may include an extended length different from the other assembly.

Figure 10:
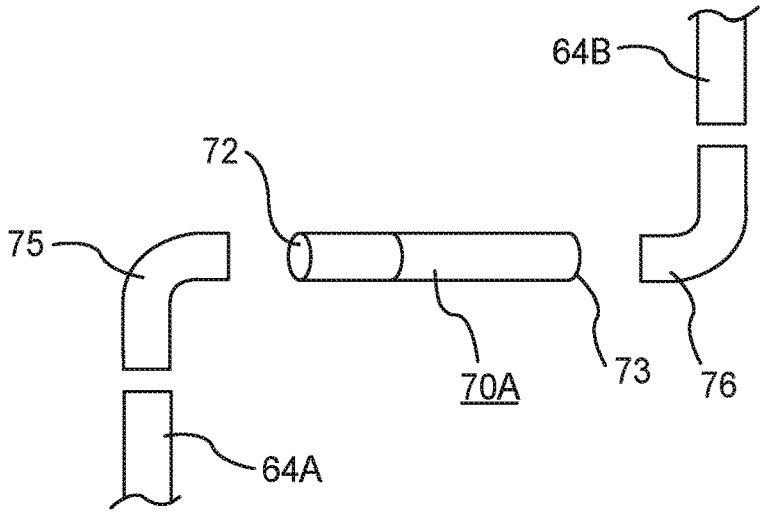
FIG. 10 is a simplified exploded view of a twist coupling and fluid conduit component parts attachable thereto.

As shown in FIG. 9, the support arm members 62A-62C and 65A-65C are pivotally linked via pivot pins, bolts, or the like (see pivot points 68A, 68B, 69A, 69B) and fluid conduit members 64A-64C and 66A-66C are fluidly communicated via twist couplings 70A, 70B, 71A, 71B. Suitable twist couplings 70A, 70B, 71A, 71B include tubular members or other fluid conduits with open ends for fluidly communicating with corresponding fluid conduit sections. As shown in the simplified embodiment of FIG. 10, one suitable twist coupling 70A includes a first open end 72 (or "upstream end") and a second open end 73 (or "downstream end") fluidly communicating fluid conduit members 64A and 64B. As depicted, fluid conduit members 62A and 62B may be provided as longitudinal tubular type members fluidly communicated with the twist coupling 70A via 90.0 degree elbow members 75, 76 rotatable within the twist coupling 70A. In another embodiment, the open ends of each of the fluid conduit members 64A and 64B may include a 90.0 degree bend angle for fluid communication with the twist coupling 70A. In one embodiment, direct contact between the twist coupling 70A, elbow members 75, 76 and/or fluid conduit members 64A and 64B may provide a suitable fluid seal when connected. In another embodiment, O-rings and/or other seals may be employed for fluidly sealing the twist coupling 70A, elbow members 75, 76 and/or fluid conduit members 64A and 64B.

With further reference to FIGS. 8 and 9, the proximal ends of support arm members 62A, 65A are pivotally attached to a drive rod connection member 56 at the distal end of the drive rod 30 via pivot pins 55, 59 in a manner effective for the first and second extendable assemblies 50, 60 to fold in a fully retracted position as shown in FIG. 8. In another embodiment, the proximal ends of support arm members 62A, 65A may be pivotally attached to a drive rod connection member 56 via hinges or ball/socket type connections. The proximal ends of fluid conduit members 64A, 66A are pivotally and fluidly secured to fluid junctions 57, 58 as described above, e.g., via ninety-degree elbow members or ninety-degree bend angles, O-rings and/or other seals. In this embodiment, suitable fluid junctions 57, 58 include twist couplings or the equivalent.

In one embodiment, each of the support arm members 62A-62C and 65A-65C may include a single elongated straight rigid member, e.g., provided as an elongated bar, rod or shaft member. In another embodiment, opposing support arm members 62A and 65A may include two elongated support side members assembled in parallel as discussed below (see also support arm member 65A in FIG. 16). In another embodiment, one or more of the support arm members 62A-62C, 65A-65C may include one or more bends. Each of the fluid conduit members 64A-64C and 66A-66C may include a static tubular member. One or more of the fluid conduit members 64A-64C and 66A-66C may also be provided as flexible tubular members or, in the alternative, one or more fluid conduit sections may be provided with elongated bracing type members to prevent restricted fluid flow through one or more fluid conduit sections that may otherwise be caused by kinking of one or more of the fluid conduit sections. For high pressure cleaning operations, the fluid conduit members 64A-64C and 66A-66C may be constructed of one or more metals including, but not necessarily limited to steel, stainless steel, aluminum, brass, copper, and combinations thereof. The fluid conduit members 64A-64C and 66A-66C may also be constructed of one or more high pressure plastic conduits.

In one particular embodiment, the apparatus 10 may include fluid conduit members 64A-64C and 66A-66C constructed of stainless steel pipe having a pressure rating up to 34473.8 kPa (5000.0 PSI). The fluid conduit members 64A-64C and 66A-66C may also be pivotally attached to the support arm members 62A-62C and 65A-65C at pivot points 118A-118C, 119A-119C via pins, bolts, or the like (see FIG. 9).

Figure 11:
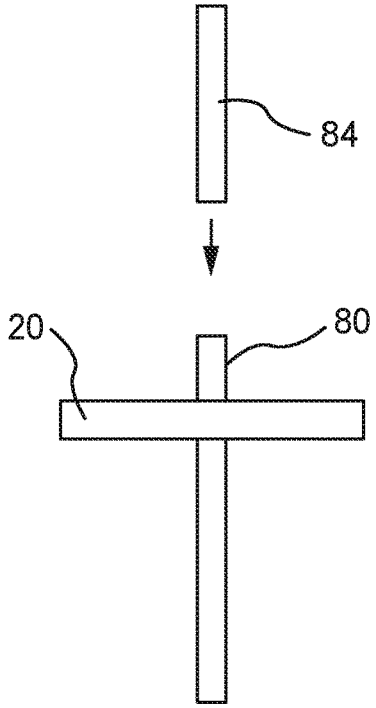
FIG. 11 is a side view illustrating parts of an apparatus of the present disclosure including a fluid conduit extending through a cover member that is operationally configured to be fluidly connected to an upstream fluid conduit.
Figure 13:
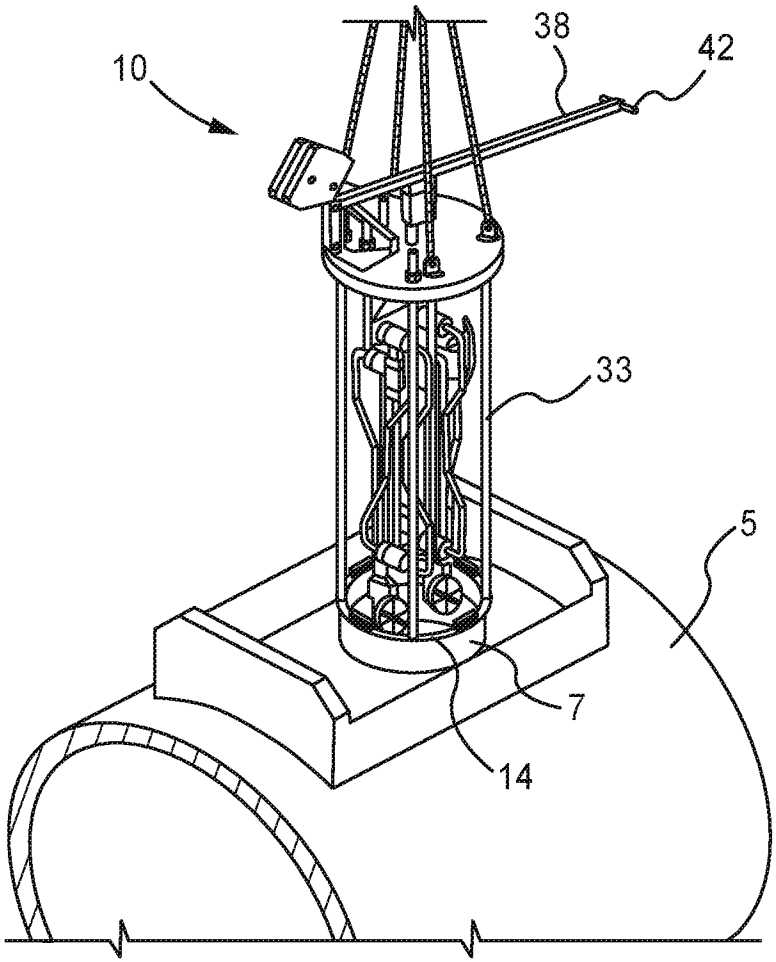
FIG. 13 is a perspective view of the apparatus of FIG. 12 including a ring member of the apparatus mated to the manhole of the tank trailer.
Figure 12:
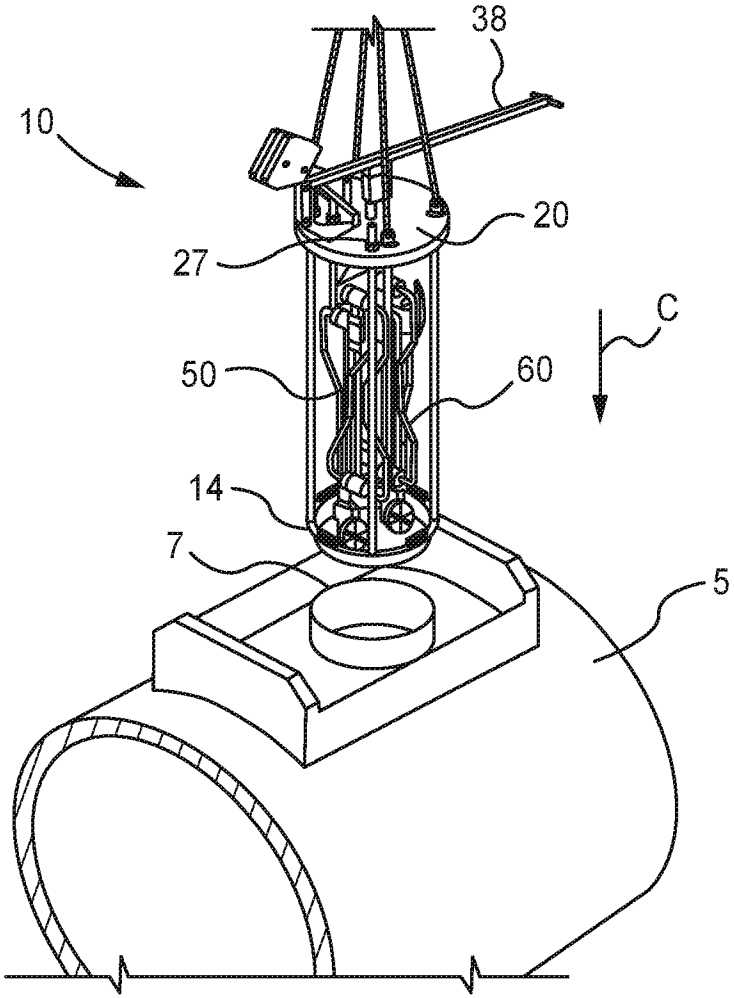
FIG. 12 is a perspective view of the apparatus of FIG. 2 and a simplified illustration of a tank trailer including the apparatus located above a manhole of the tank trailer.

Referring to FIG. 8, each of the fluid junctions 57, 58 lies in fluid communication with a fluid conduit 80 that is in fluid communication with one or more upstream fluid sources. A suitable fluid conduit 80 may include a static or flexible tubular member in fluid communication with an aperture 82 located along the cover member 20 (see FIG. 5). In another embodiment, the fluid conduit 80 may extend through the aperture 82 for direct fluid communication with an upstream fluid conduit 84 or a conduit fitting disposed there between as depicted in the simplified illustration of FIG. 11.

With further reference to FIGS. 8 and 9, the distal end of the first extendable assembly 50 includes a fluid outlet such as a spray nozzle 85 or the like in fluid communication with fluid conduit section 64C and the distal end of the second extendable assembly 60 includes a fluid outlet such as a spray nozzle 86 in fluid communication with fluid conduit section 66C for dispensing fluid from the apparatus 10. A suitable spray nozzle includes, but is not limited to commercially available spray nozzles as currently used in tank and equipment cleaning as understood by the skilled artisan. One suitable spray nozzle may include a high pressure static spray ball as the term is understood by those skilled in art. Another suitable spray nozzle may include a high pressure self-rotating or self-propelled nozzle, e.g., a free spinning spray nozzle, a controlled rotation spray nozzle or a gear-controlled spray nozzle. One particular spray nozzle may include a high pressure swivel type spray nozzle (hereafter "swivel") as such is understood by persons of ordinary skill in the art. As also understood by persons of ordinary skill in the art, spray nozzles for purposes of this disclosure may include circular orifices for emitting jet streams of fluid out from the first extendable assembly 50 and second extendable assembly 60. In other words, in addition to fluid flow rate, fluid velocity and internal fluid pressure, spray nozzle geometry may be a factor affecting the jet streams 11 produced by the present apparatus 10. Suitable spray nozzle orifices may include circular orifices having a diameter ranging from 0.22 cm (0.0866 inches) to 0.3 cm (0.118 inches).

Exemplary installation and operation of the apparatus 10 of FIG. 2 with a tank 5 is illustrated in FIGS. 12-17. Beginning with FIGS. 12-13, the apparatus 10 is directed to a position of axial alignment with the manhole 7 of a target tank 5. Once aligned, the ring member 14 may be directed to a mated position with the manhole 7 (see directional arrow C). At this point during installation, the collar members 27 act as a catch whereby the guide members 33 and the ring member 14 attached thereto are suspended from the cover member 20 via collar members 27 with the extendable assemblies 50, 60 being located within the guide members 33 as shown.

Figure 15:
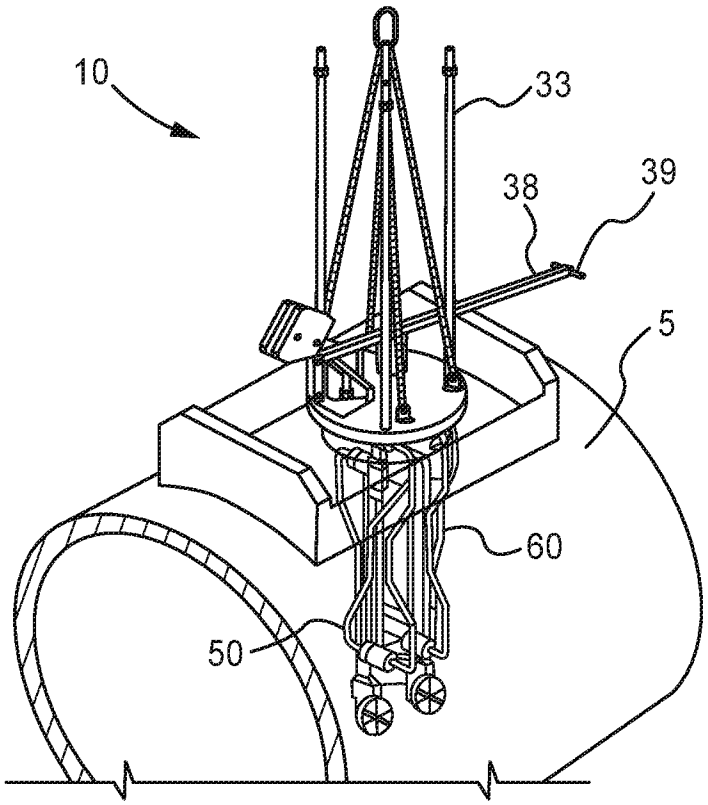
FIG. 15 is a perspective view of the apparatus of FIG. 12 shown set within the tank trailer including a cover member of the apparatus covering the ring member of the apparatus and the manhole of the tank trailer.
Figure 14:
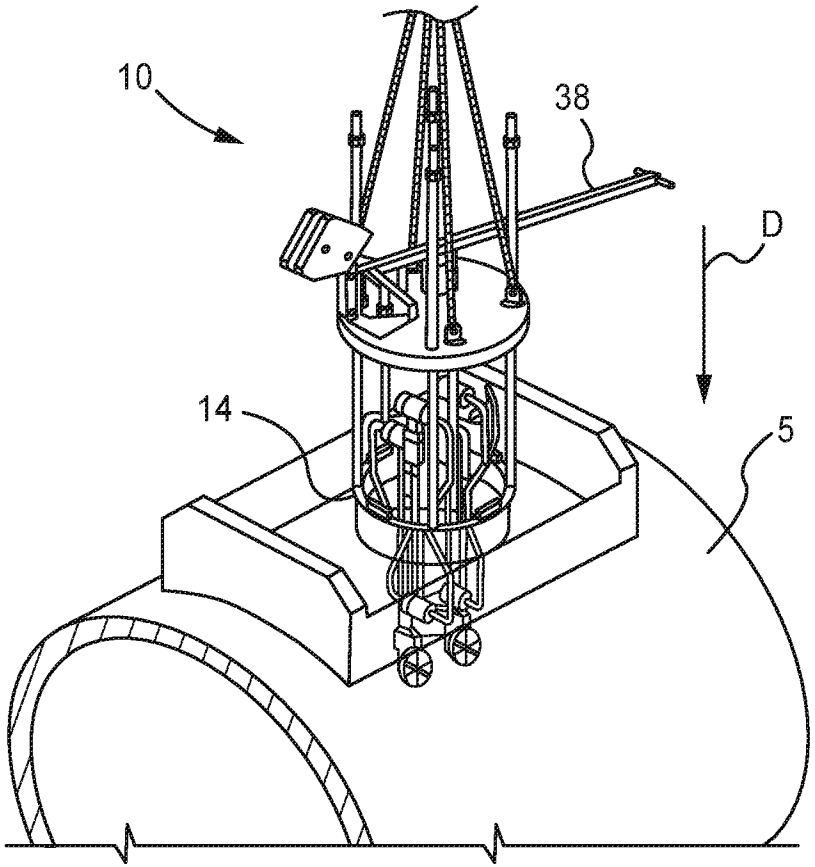
FIG. 14 is a perspective view of the apparatus of FIG. 12 shown partially within the tank trailer.
Figure 17:
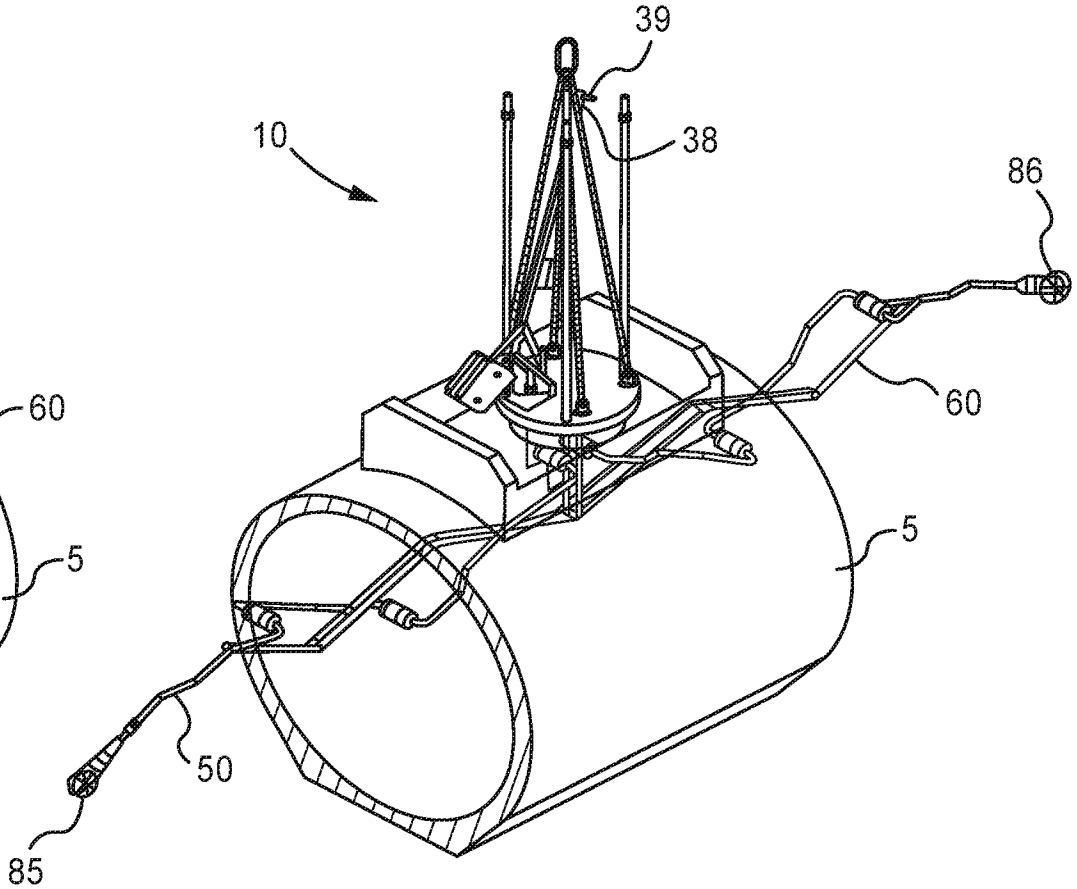
FIG. 17 is a perspective view of the apparatus of FIG. 12 shown in a fully extended position within the tank trailer.
Figure 16:
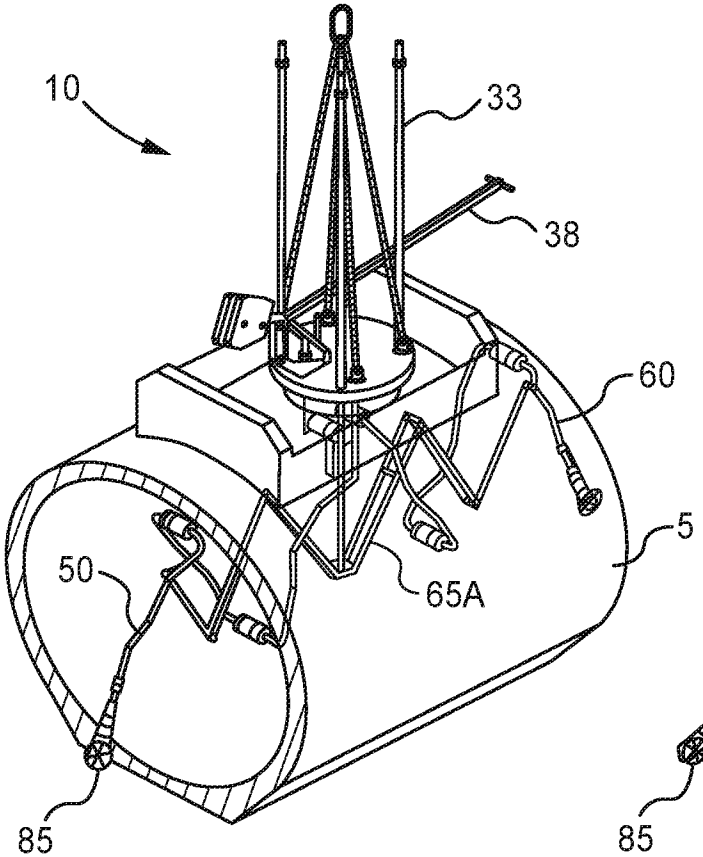
FIG. 16 is a perspective view of the apparatus of FIG. 12 shown in a partially extended position within the tank trailer.

Turning to FIGS. 14 and 15, once the ring member 14 is set to a mated position with the manhole 7, the cover member 20 may be directed along the guide members 33 to a mated position with the ring member 14 (see directional arrow D). At the mated position, the first and second extendable assemblies 50, 60 are positioned within the tank 5 at a fully retracted position as shown in FIG. 15. In order to direct the first and second extendable assemblies 50, 60 from a fully retracted position to a fully extended position as depicted in FIG. 17, the free end 39 of the lever 38 is directed away from the tank 5 (see directional arrow B in FIG. 7) thereby directing the drive rod 30 attached thereto out through the cover member 20 until the drive rod connection member 56 abuts the stop member 61 as described above. As the drive rod connection member 56 draws near the stop member 61, the scissor extendable or lazy tong configuration of the support arm members 62A-62C and 65A-65C allows the first and second extendable assemblies 50, 60 to extend out in a synchronized manner as shown in FIG. 17 with the spray nozzles 85, 86 located a desired distance from the longitudinal axis of the apparatus 10 or center of the corresponding manhole 7. As such, it is further contemplated that the lever 38 may be manipulated to orient the first and second extendable assemblies 50, 60 at partially extended positions in order to position the spray nozzles 85, 86 a desired extended distance for use in a smaller size tank 5 as shown in FIG. 16.

In one embodiment, a locking device, clamp, chain, rope, bungee cord, or type of other elastic cord, or other form of tie down, and combinations thereof may be employed to hold the lever 38 in a fixed position during operation of the apparatus 20. At a fully extended position, the arrangement of the fixed base 36 and the one or more link members, e.g., first link member 37, may be operationally configured to hold the lever 38 in a maximum second position as depicted in FIG. 17. In still another embodiment, the lever 38 may be manually held in one or more fixed positions.

Figure 18:
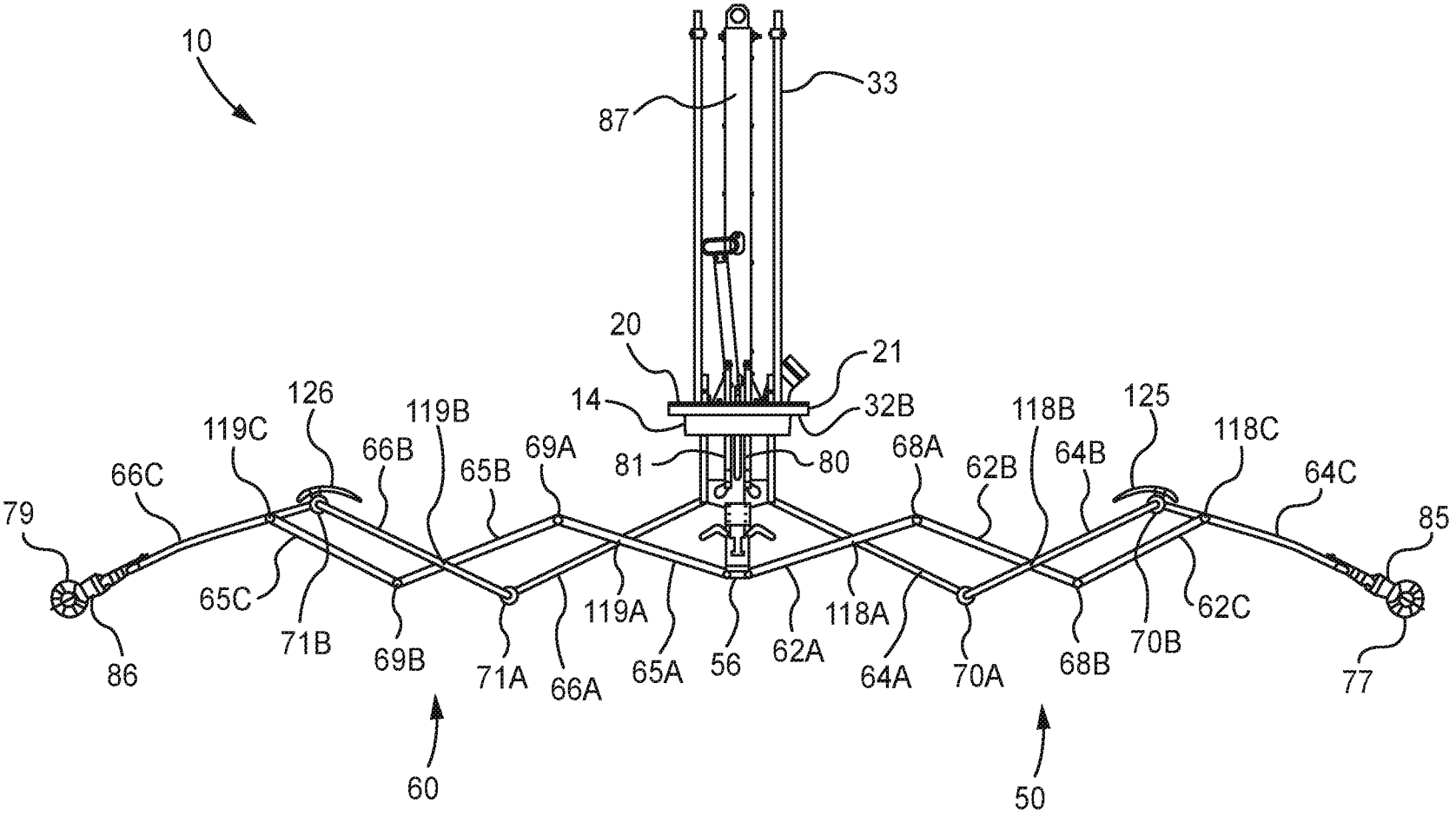
FIG. 18 is a side view of another embodiment of the apparatus in a fully extended position.

With reference to FIG. 18, another embodiment of the apparatus 10 operationally configured to convey pressurized fluid up to 34473.8 kPa (5000.0 PSI) from one or more upstream locations to the interior of a tank trailer 5 or other storage container is provided. In this embodiment, the apparatus 10 is operationally configured for automated operation.

Figure 19:
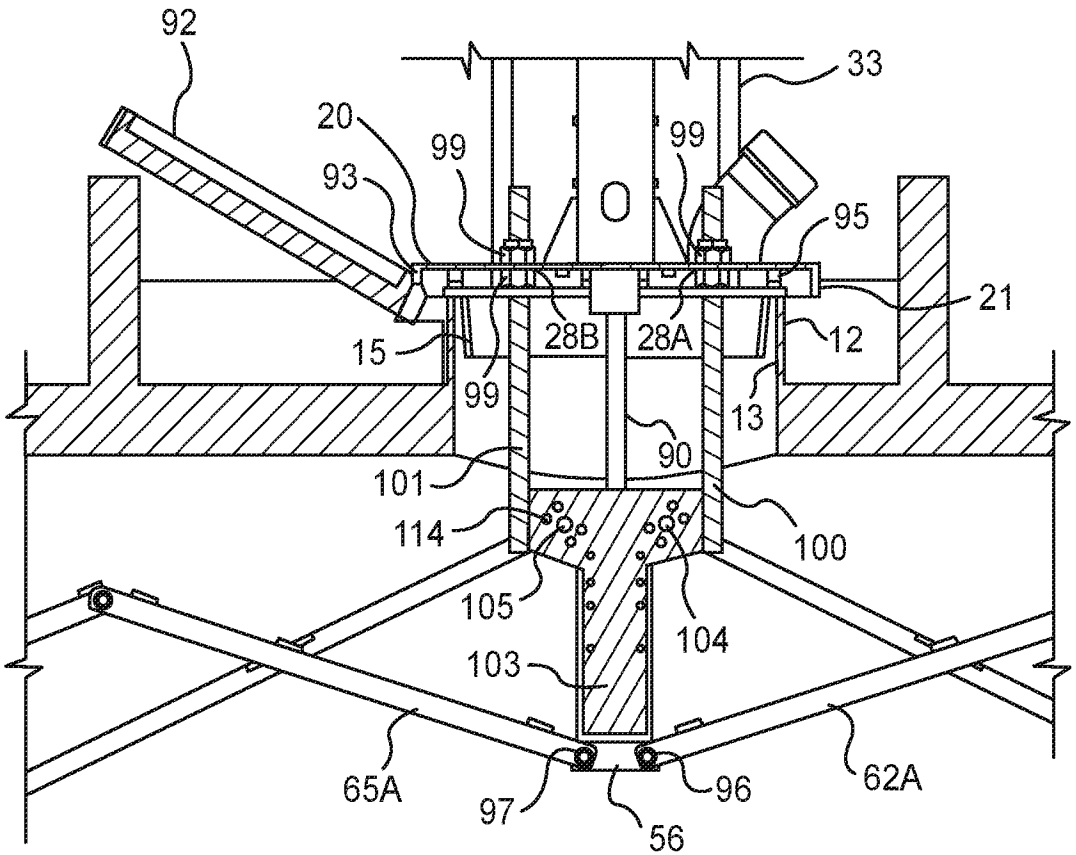
FIG. 19 is a side sectional detailed view of the apparatus of FIG. 18.
Figure 20:
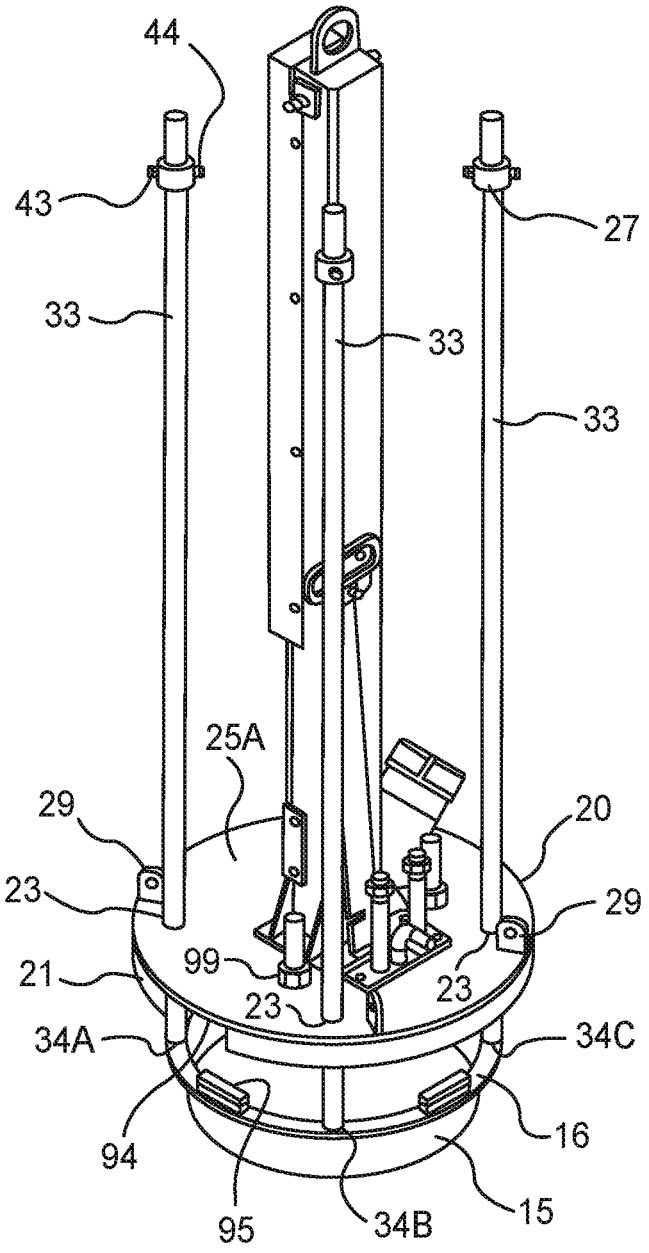
FIG. 20 is a perspective view of part of the apparatus of FIG. 18.

In this embodiment of the apparatus 10, the ring member 14 includes a lip member 16 with an abutment surface 19 for contacting the rim 8 of a manhole 7 and one or more spacers 95 disposed along the opposing side of the lip member 16 operationally configured as seats or contact surfaces for the inner surface 25B of the cover member 20 (see FIGS. 19 and 20). With particular reference to FIG. 20, one suitable ring member 14 may include four spacers 95 each set equidistant between four guide members 33. The spacers 95 may be included as part of a one-piece construction element of the ring member 14, or, the one or more spacers 95 may be welded or fastened to the ring member 14. One or more spacers 95 may also be included in the manual embodiment of the apparatus 10 of FIG. 2 described above. Suitably, the one or more spacers 95 are effective to allow gas to escape from a tank 5 through the space or gap provided between the ring member 14 and the cover member 20.

As shown in FIG. 19, the ring member 14 also includes a conical shaped sidewall 15 to assist with insertion of the ring member 14 within a manhole 7. Similar as described above, the cover member 20 of this embodiment is axially aligned with the ring member 14 and includes a side wall 21 operationally configured to cover the ring member 14 and manhole 7 of a tank 5 during operation of the apparatus 10.

In an embodiment of the apparatus 10 configured for use with a manhole 7 having an inner diameter of or about 52.07 cm (20.5 inches), a conical shape sidewall 15 as shown in FIG. 19 may have (1) a maximum outer diameter of or about 49.5 cm (19.5 inches) at its junction with the lip member 16, (2) a minimum outer diameter at its distal end of or about 47.8 cm (18.8 inches), (3) a maximum inner diameter of or about 49.05 cm (19.31 inches) at its junction with the lip member 16 and (4) a minimum inner diameter at its distal end of or about 47.4 cm (18.65 inches). Without limiting the invention, the sidewall 15 suitably includes a length effective to extend into a manhole 7 at a depth for desired operation of the apparatus 10.

For example, as shown in FIG. 19, the sidewall 15 may include a length less than the height of the inner surface 13 of the manhole 7. In another embodiment, the sidewall 15 may include a length greater than or less than the length as depicted in FIG. 19 including a length extending into the tank 5. The sidewall 15 may also include a uniform wall thickness or a tapering wall thickness.

As shown in FIG. 19, the inner diameter of the side wall 21 of the cover member 20 is the same or substantially similar as the outer diameter of the manhole 7 so that the cover member 20 may fit over the manhole 7 in a lid or cap type configuration with the inner surface 25B of the cover member 20 set in abutment with the outer surface 12 of the manhole 7. Such configuration of the cover member 20 acts as a safety feature of the apparatus 10 to assist in preventing fluid from exiting the manhole 7 during operation of the apparatus 10. As such, the inner surface of the cover member 20 may include one or more rubber seals to further prevent leakage. Although the apparatus 10 may be built to scale, in one particular embodiment the apparatus 10 as shown in FIGS. 18-20 is contemplated for use with a manhole 7 of a tank 5 having an inner diameter of or about 50.8 cm (20.0 inches) and an outer diameter of or about 65.0 cm (25.6 inches). Accordingly, the side wall 21 of the cover member 20 has an inner diameter of about 64.0 cm (25.2 inches).

Similar as described above, the ring member 14 and cover member 20 of this embodiment are interconnected via a plurality of guide members 33 with first ends secured to the lip member 16 at a plurality of attachment points (see attachment points 34A, 34B, 34C in FIG. 20). As shown, the guide members 33 may be equally spaced apart along the lip member 16 and extend out in parallel alignment forming a cage type configuration for other various components of the apparatus 10 during both use and non-use of the apparatus 10. In one embodiment, the guide members 33 may be secured to the lip member 16 via fasteners. In another embodiment, the guide members 33 may be secured to the lip member 16 via welds. In still another embodiment, the ring member 14 and guide members 33 may be provided as a one-piece construction.

The cover member 20 includes a plurality of equally spaced apertures 23 for receiving a corresponding guide member 33 there through as shown. Suitably, the guide members 33 are operationally configured to provide structural support and maintain an axial alignment between the ring member 14 and the cover member 20 as the cover member 20 is directed toward and apart from the ring member 14. In this embodiment, the guide members 33 are provided as four cylindrical rod type members each defined by a longitudinal axis perpendicular to the planar outer surface 25A of the cover member 20. In another embodiment, the guide members 33 may include a different elongated shape, e.g., multi-sided shape, oval shape, irregular shape. The guide members 33 may be provided as solid construction, hollow construction or partially solid and partially hollow construction as desired. Also, a different number of guide members 33 may be provided in another embodiment of the apparatus 10.

In the embodiment of FIG. 20, the guide members 33 are provided as hollow cylindrical tubular members with apertures (not shown) near the distal end of each guide member 33 for receiving part of a collar assembly 27 there through. Similar as described above, the collar assemblies 27 of this embodiment act as a catch against the outer surface 25A of the cover member 20 during transport of the apparatus 10. In this embodiment, each collar assembly 27 suitably includes a slotted hex nut 43, washer and hex bolt 44 combination wherein each hex bolt 44 is disposed through its corresponding aperture of the hex nut 43 and aperture of the guide member 33 for fastening the slotted hex nut 43 to the guide member 33.

Figure 22:
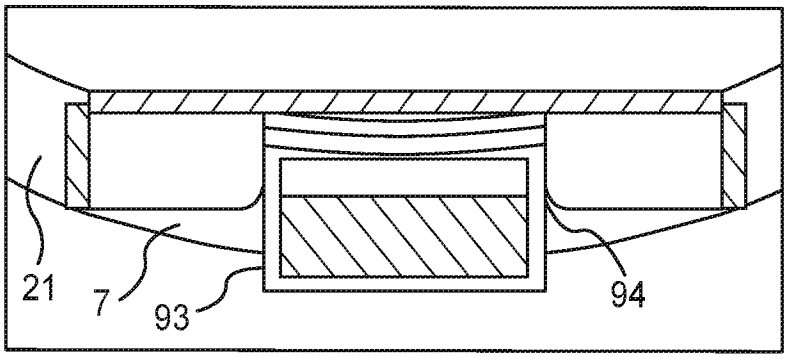
FIG. 22 is a detailed view of part of FIG. 21.
Figure 21:
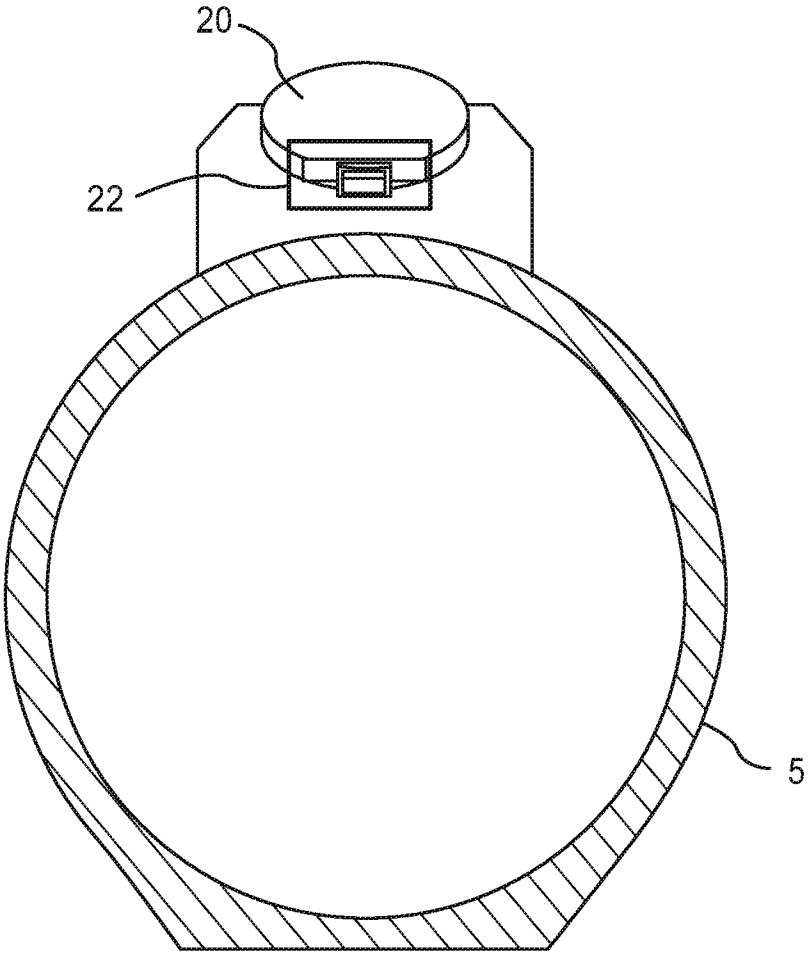
FIG. 21 is a simplified illustration of a cover member of the apparatus of FIG. 18 covering a manhole of a tank trailer.

As understood by the skilled artisan, a typical manhole 7 includes a cover 92 attached to the manhole 7 via a hinge connection 93 that is located at a fixed position on the manhole 7, typically at the longitudinal center line of a tank 5, i.e., a hinge connection 93 is typically located in line with the center diameter of a tank 5. The cover member 20 of this embodiment is advantageous in that it is operationally configured to mate with and cover a circular manhole 7 according to the location and configuration of the hinge connection 93. As shown in the simplified illustrations of FIGS. 21 and 22, the side wall 21 of the cover member 20 includes a cutout portion or notch 94 enabling the cover member 20 to securely fit over the manhole 7 according to the spacers 95 unencumbered by the hinge connection 93. In other words, the notch 94 portion of the cover member 20 is operationally configured to fit over the hinge connection 93, which ensures proper alignment and fitting of the cover member 20 with the manhole 7. As such, the notch 94 portion of the cover member 20 acts as a guide of the apparatus 10 during installation to ensure proper orientation of the cover member 20 with a manhole 7 of a tank 5. The cover member 20 of the apparatus 10 as described in FIGS. 12-17 also suitably includes a notch 94 as described above.

Figure 23:
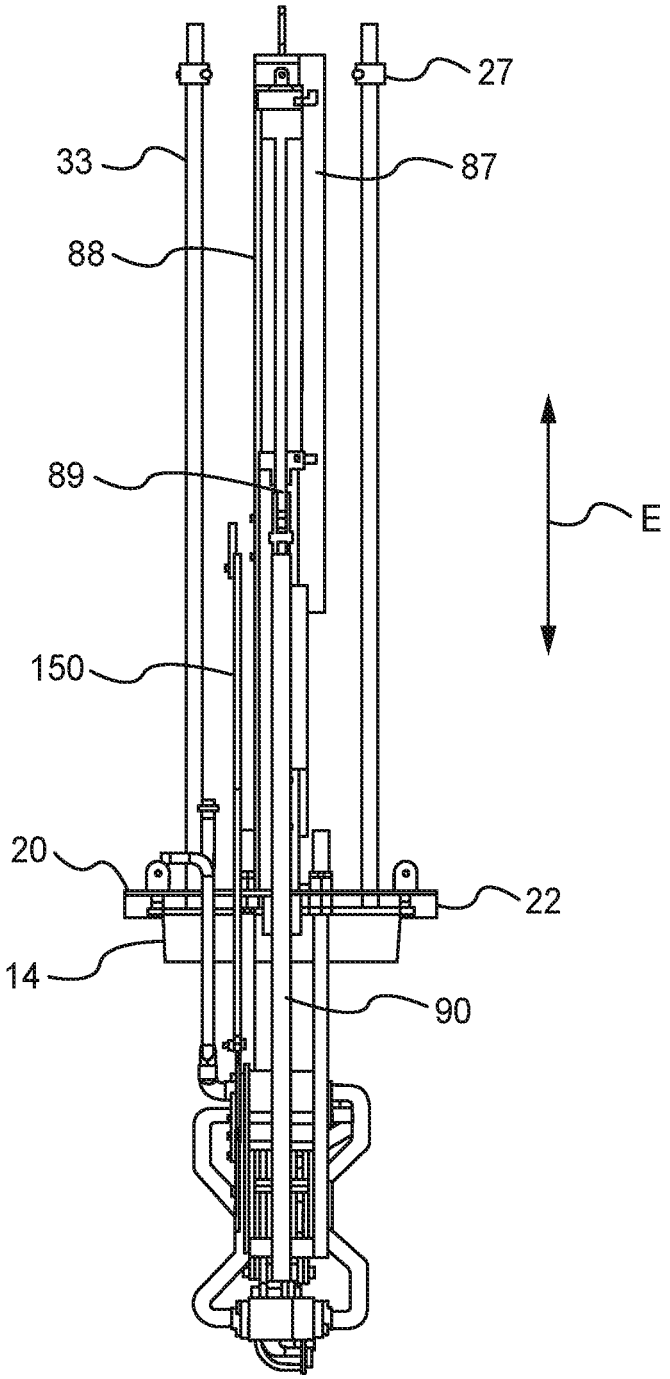
FIG. 23 is a partial phantom side view of the apparatus of FIG. 18.

Referring to FIG. 23, the apparatus 10 of this embodiment includes a remote control assembly operationally configured to automatically extend and retract the first extendable assembly 50 and opposing second extendable assembly 60 and to hold or maintain the first extendable assembly 50 and the second extendable assembly 60 in both a fully retracted position (see FIG. 24) and one or more extended positions (see FIG. 18). The apparatus 10 also includes a support assembly for securing the first extendable assembly 50 and second extendable assembly 60 in a manner effective for simultaneous extension and retraction of the extendable assemblies 50, 60 according to operation of the remote control assembly. In this embodiment, automatic extension and retraction of the extendable assemblies 50, 60 is suitably controlled by a linear actuator. One suitable linear actuator is operationally configured to hold or lock the extendable assemblies 50, 60 in a retracted position and one or more extended positions. One non-limiting linear actuator may include a pneumatic air cylinder 88 ("cylinder 88") enclosed within a housing 87 including a mounting plate 47 releasably attachable to the cover member 20 via one or more fasteners or fastener assemblies 49 (see FIGS. 27 and 29). One suitable fastener assembly 49 includes a hex head bolt and spring washer combination. The housing 87 is also operationally configured to protect the cylinder 88 against external contact and operationally configured to provide one or more mounting points for the nose and/or the tail of the cylinder 88 housed therein. Other types of linear actuators may be employed as desired, e.g., a mechanical actuator such as a screw-jack may be employed in a different embodiment of the apparatus 10.

Common to pneumatic air cylinders, the cylinder 88 of this embodiment includes a cylinder rod 89 defined by a longitudinal axis of a desired stroke for dictating extension and retraction of the extendable assemblies 50, 60. Attached at the distal end of the cylinder rod 89 is a second elongated rod or auxiliary rod 90 in axial alignment with the cylinder rod 89. In this embodiment, the cover member 20 includes a centrally located aperture 24 for receiving the auxiliary rod 90 there through providing for linear movement of the auxiliary rod 90 according to the stroke of the cylinder rod 89 (see directional arrow E). In one embodiment, the distal end of the cylinder rod 89 may be provided as a male thread operationally configured to be coupled with a female thread of the auxiliary rod 90 or vice versa. In another embodiment, a releasable pin may be used to couple the cylinder rod 89 and auxiliary rod 90. Herein, the linear actuator and auxiliary rod 90 may be referred to collectively as a "drive rod assembly" of the apparatus 10.

One suitable cylinder 88 includes a double acting cylinder with two air ports for receiving air lines in fluid communication with one or more sources of pressurized air, e.g., one or more air compressors, as such type cylinder is understood by the skilled artisan. Without limiting the invention, one suitable cylinder 88 has a 2.54 cm (1.0 inch) bore and a 65.0 cm (25.6 inch) stroke controlled by a pneumatic control valve in fluid communication with one or more sources of pressurized air as discussed below.

Figure 24:
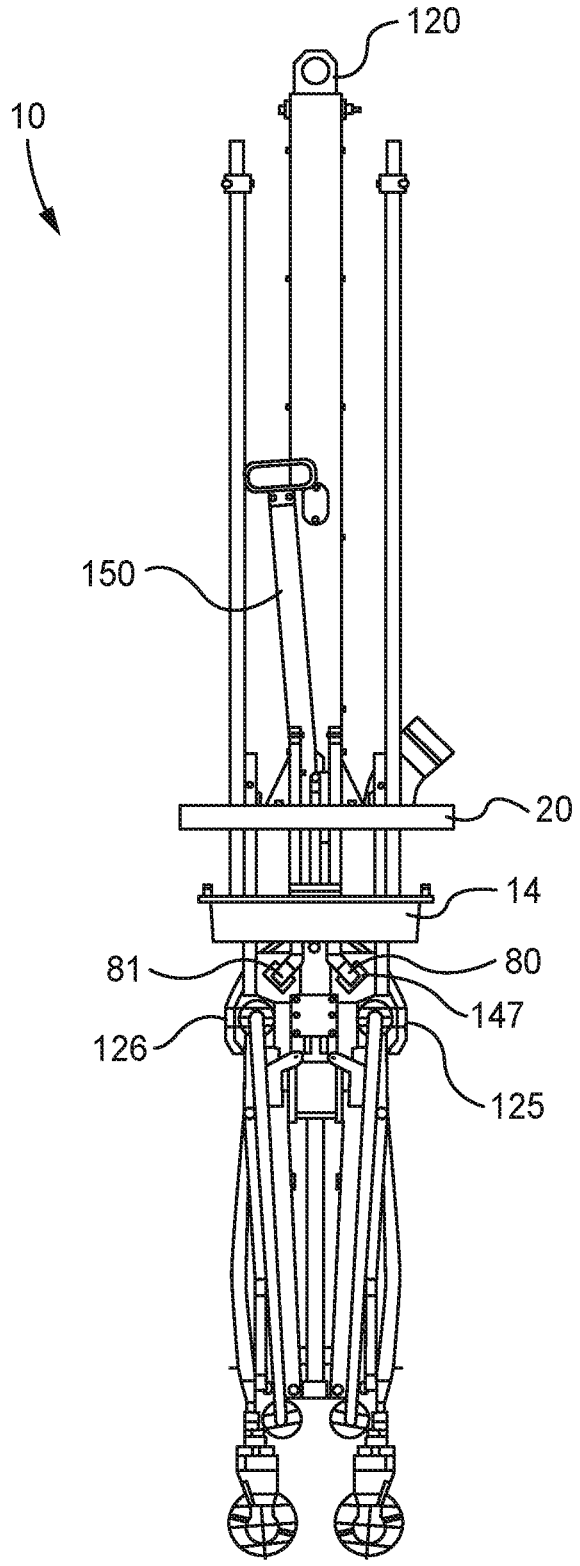
FIG. 24 is a side view of the apparatus of FIG. 18 including a cover member apart from a ring member of the apparatus.

With reference to FIGS. 18 and 19, a distal end of the auxiliary rod 90 is attached to a drive rod connection member 56, which provides pivotal attachment points 96, 97 for communicating each of the extendable assemblies 50, 60 with the cylinder 88. Similar as described above, each of the extendable assemblies 50, 60 of this embodiment has three support arm members and three fluid conduit members assembled in a scissor extendable configuration from a fully retracted position as shown in FIG. 24 to a fully extended position as shown in FIG. 18.

Referring to FIG. 19, the support assembly of this embodiment suitably includes elongated parallel first fixed supports 100, 101 secured to the cover member 20 of the cover assembly on opposite sides of the auxiliary rod 90 as shown. In this embodiment, the first fixed supports 100, 101 are provided as threaded cylindrical members and the cover member 20 includes apertures 28A, 28B for receiving each of the first fixed supports 100, 101 there through. As shown, each of the first fixed supports 100, 101 is suitably fastened to the cover member 20 via a set of threaded nuts 99, e.g., hex nuts, located on opposite sides of the cover member 20. In another embodiment, the cover member 20 and first fixed supports 100, 101 may be provided as one-piece construction.

Disposed between the first fixed supports 100, 101 is a second fixed support 103 providing fluid connection points for fluid junctions 57, 58 (see FIG. 31) for each of the extendable assemblies 50, 60. In this embodiment, the second fixed support 103 is provided as a T-shape plate type member with opposing arms or wings secured to the first fixed supports 100, 101 as shown and a leg portion extending a distance according to the stroke of the drive rod assembly. In other words, the distal end of the second fixed support 103 provides a contact surface for the drive rod connection member 56 during operation of the apparatus 10.

The second fixed support 103 includes fluid apertures 104 and 105 (see FIG. 19) providing fluid attachment points between fluid junctions 57, 58 and corresponding fluid conduits 80, 81 (see FIG. 24) operationally configured to convey pressurized fluid from one or more upstream fluid sources to the fluid junctions 57, 58 (see FIGS. 26 and 27) and out through the extendable assemblies 50, 60. Suitable fluid conduits 80, 81 may include static and/or flexible tubular members. For cleaning operations requiring high pressure fluids, the fluid conduits 80, 81 may suitably be constructed from stainless steel, although one or more metals such as titanium, copper and aluminum may be used in combination with stainless steel or in place of stainless steel in other embodiments. In one suitable embodiment, the fluid conduits 80, 81 are attached to the second fixed support 103 at fluid apertures 104, 105 via couplings 146 or the like and threaded fasteners 147 there through e.g., bolts, (see FIG. 27) and may include one or more rubber ring-seals providing a fluid seal between each of the fluid conduits 80, 81 and apertures 104 and 105. One suitable rubber ring-seal may be constructed from one or more synthetic rubbers and one or more fluoropolymer elastomers. One particular rubber ring-seal may be constructed from fluroelastomer or FKM. As of the time of this disclosure, suitable rubber ring-seals are commercially available from The Chemours Company, Wilmington, Del., U.S., under the brand name Viton® Fluoroelastomer.

Figure 25:
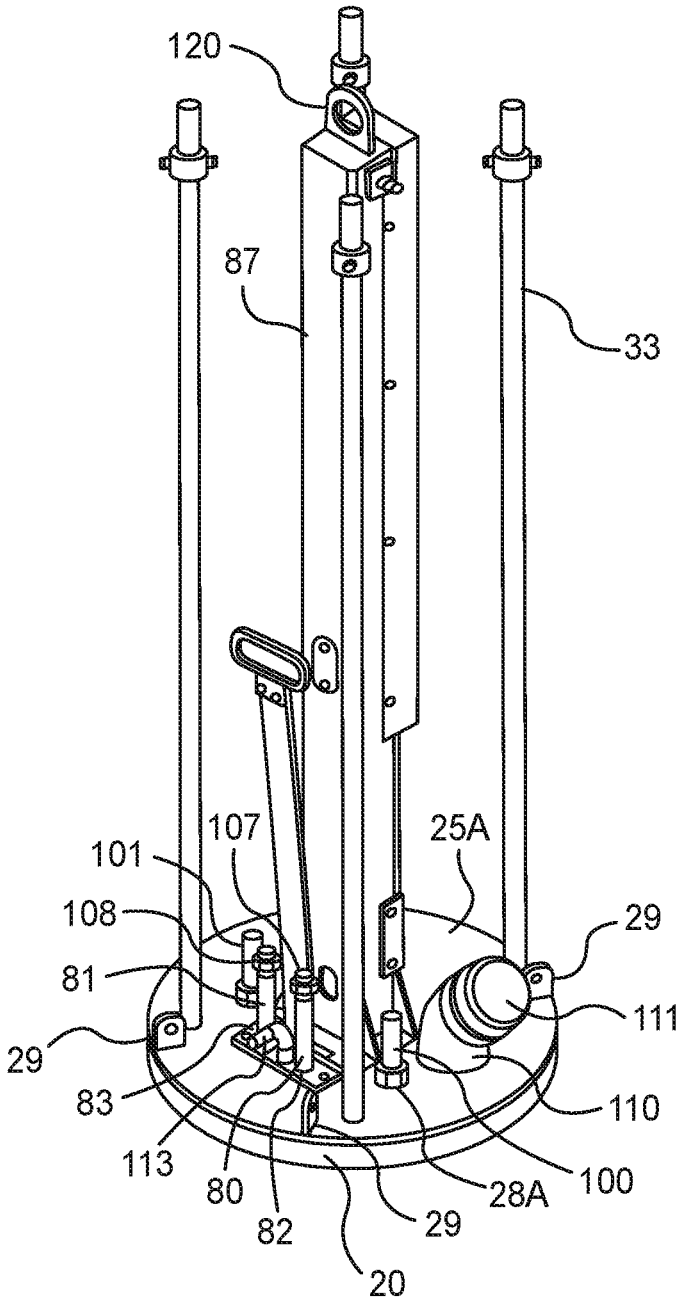
FIG. 25 is a perspective view of part of the apparatus of FIG. 18.

Turning to FIG. 25, the cover member 20 of this embodiment suitably includes apertures 82 and 83 for receiving the fluid conduits 80, 81 there through. In one suitable embodiment, the apertures 82, 83 are the same or substantially similar in size and shape as the corresponding fluid conduits 80, 81 to prevent the flow of fluid out of a tank 5 through the apertures 82, 83 during operation of the apparatus 10. As shown, each of the fluid conduits 80, 81 extends out from the outer surface 25A of the cover member 20 a desired distance and include distal ends 107, 108 operationally configured to be fluidly communicated with upstream fluid conduits, e.g., fluidly communicated with fluid couplings (not shown) interconnecting the distal ends 107, 108 and corresponding upstream fluid conduits 84 for fast and easy connection and disconnect with upstream fluid conduits. For high pressure fluid tank 5 cleaning operations, suitable fluid couplings are rated for use up to a maximum internal working pressure of 34473.8 kPa (5000.0 PSI).

In certain cleaning operations, tanks 5 may include hazardous gases and/or chemicals capable of causing odor nuisances, e.g., ammonia, acrylic. As such, the apparatus 10 may be operationally configured for use with one or more air purification systems including, but not necessarily limited to (1) gas scrubbers (alkaline and acid), (2) activated carbon filters, (3) enclosed vapor combustion units or flares, and combinations thereof. Accordingly, the cover member 20 may include a gas outlet 110 for receiving a fluid conduit, e.g., a suction hose (not shown), in fluid communication with the gas outlet 110 for the transfer of gases out from within a tank 5 through a fluid conduit and through an air purification system (see FIG. 25). Herein, the gas outlet 110 may also be referred to as an extraction point of the apparatus 10. As further shown, the gas outlet 110 includes a sealable cover such as a removable cap 111 or the like for closing off the gas outlet 110 during periods of nonuse. Although the size and type of the gas outlet 110 may vary, for tank 5 cleaning operations one suitable gas outlet 110 and removable cap 111 combination may include 4.0 inch BSP.

As further shown in FIG. 25, the cover member 20 may also include a fluid inlet 113 (or "steam injection inlet 113") for automated and integrated steaming of a tank 5 through the cover member 20 when the apparatus 10 is attached to a manhole 7. As shown, one suitable steam injection inlet 113 may include an elbow or bent pipe, e.g., ninety-degree pipe, providing for horizontal attachment of an upstream steam conduit or coupling. The cover member 20 of this embodiment may also include one or more attachment surfaces depicted as a plurality of lift eyes or lift rings 29 for removal of the apparatus 10 from a manhole 7 and for transport of the apparatus 10 via a lift assembly 6. In this embodiment, the cover member 20 includes four equidistant lift rings 29 effective for maintaining the cover member 20 in a horizontal or substantially horizontal orientation during transport of the apparatus 10, i.e., effective for maintaining an upright or substantially upright orientation of the apparatus 10. As further shown in FIG. 25, the housing 87 may also include one or more attachment surfaces such as a lift eye or lift ring 120 as shown for removal of the apparatus 10 from a manhole 7 and for transport of the apparatus 10 via a lift assembly 6. In this embodiment, a lift assembly 6 may attach at the longitudinal center of the apparatus 10 via the lift ring 120 and along the periphery of the apparatus 10 via the lift rings 29 located on the cover member 20.

In this embodiment, the arm members 62A-62C and 65A-65C of the extendable assemblies 50, 60 are pivotally linked together via fastener assemblies at pivot points 68A, 68B, 69A, 69B (see FIG. 18). Suitable fastener assemblies include, but are not necessarily limited to a threaded hex head bolt, slotted hex nut and washer combination and each of the arm members 62A-62C and 65A-65C are operationally configured for pivotal attachment using such type of fastener assembly.

Herein, the arm members 62A and 65A attached to the drive rod connection member 56 may be referred to as proximal arm members. The next arm members 62B and 65B pivotally attached to arm members 62A and 65A may be referred to as intermediate arm members and arm members 62C and 65C pivotally attached to the intermediate arm members and to the fluid conduit members 64C and 66C may be referred to herein as distal arm members. As understood by the skilled artisan, in an embodiment including extendable assemblies 50, 60 comprised of four or more arm members, the arm member attached to the drive rod connection member 56 is the proximal arm member, the arm member furthest from the proximal arm member in the assembly is the distal arm member and each of the arm members there between are intermediate arm members.

Figure 26:
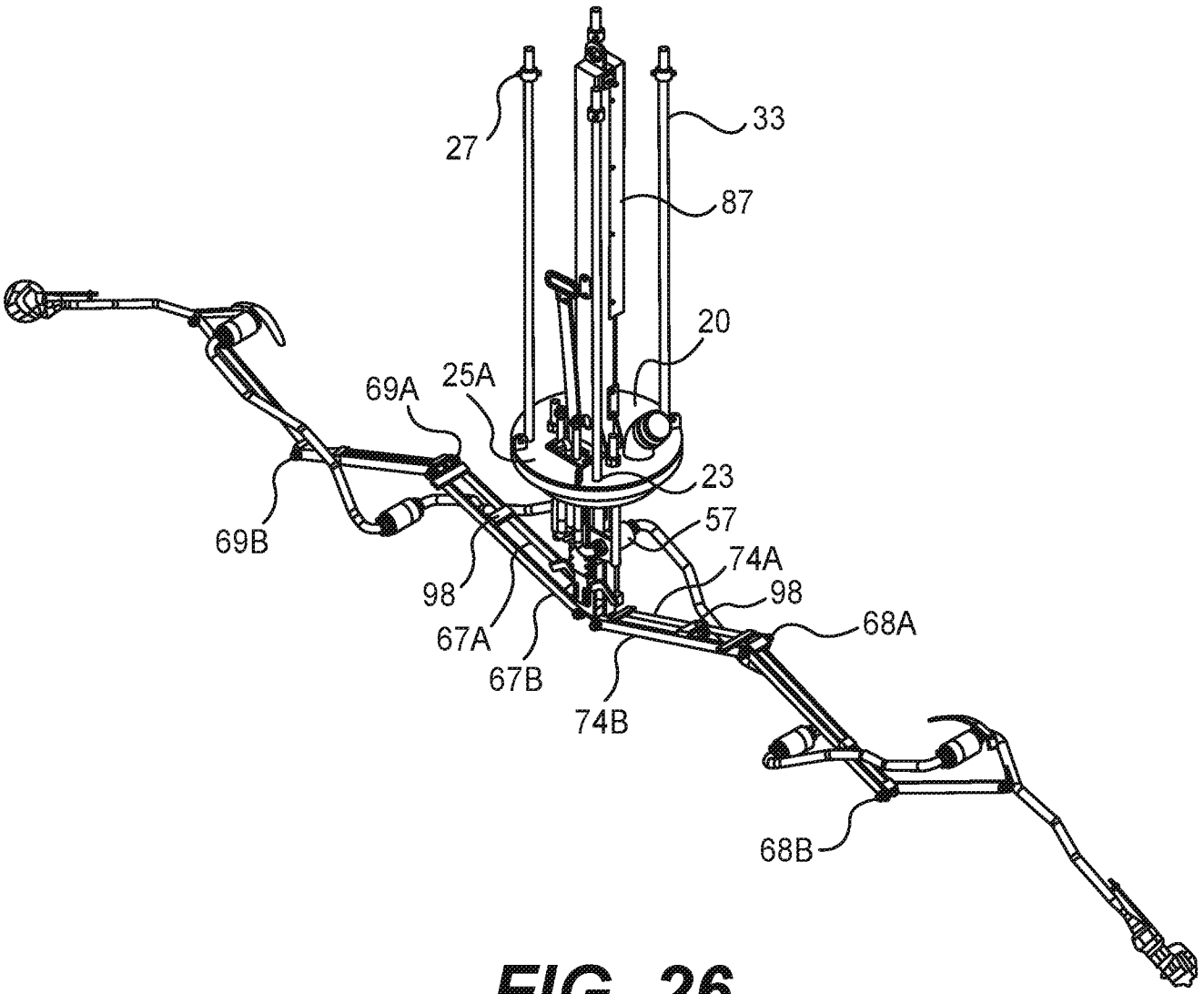
FIG. 26 is a perspective view of the apparatus of FIG. 18 in a fully extended position.
Figure 27:
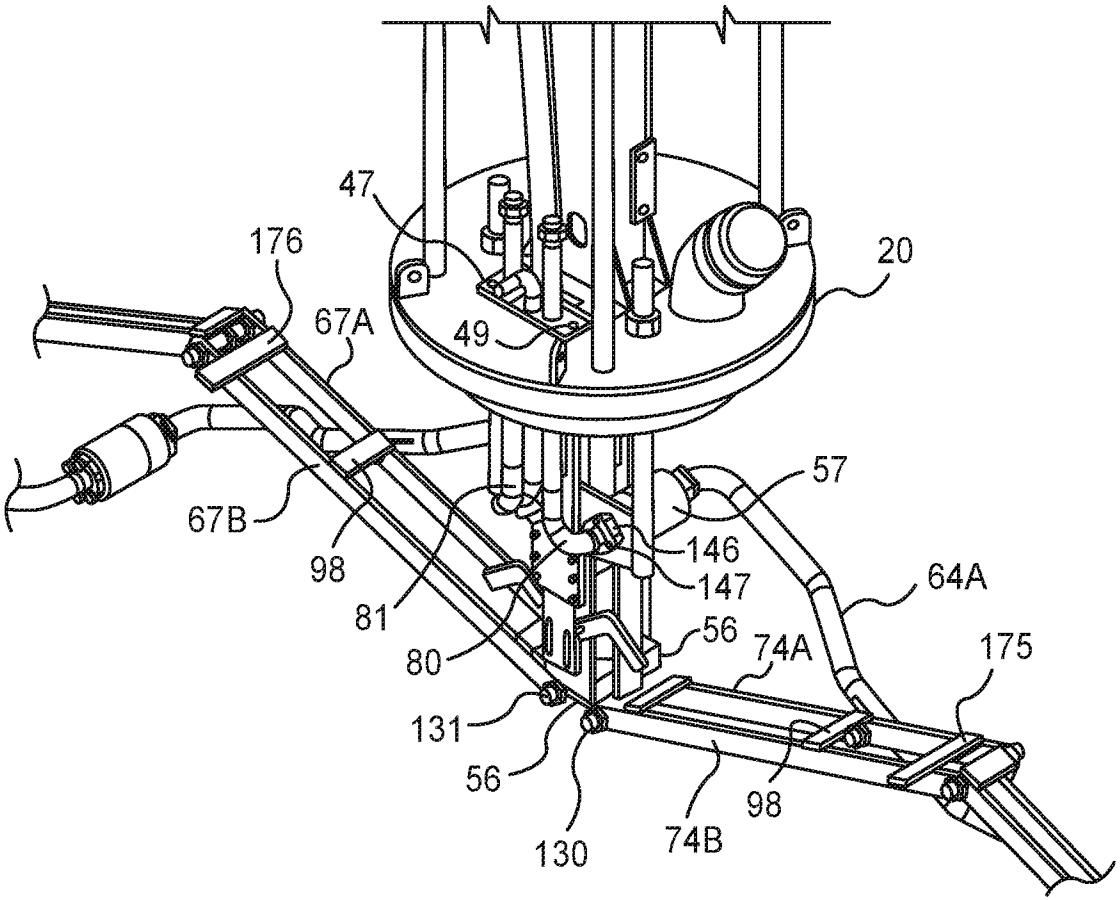
FIG. 27 is a perspective view of part of the apparatus of FIG. 18.

With reference to FIGS. 26 and 27, each of the proximal arm members 62A, 65A of this embodiment is provided as an assembly with two elongated side members in parallel defining the length of each of the arm members 62A, 65A, e.g., see side members 67A, 67B of arm member 65A and side members 74A, 74B of arm member 62A in FIG. 26. Each of the arm members 62A, 65A is pivotally attached on opposing sides of the drive rod connection member 56 via a fastener assembly 130, 131 including, but not necessarily limited to a threaded hex head bolt, slotted hex nut and washer combination wherein each hex head bolt is disposed through an aperture of the drive rod connection member 56, defining pivotal attachment points 96, 97 (see FIG. 19) for securing each of the side members 67A, 67B and 74A, 74B to the drive rod connection member 56.

One or more of the proximal arm members 62A, 65A may also include one or more bracing members 98 interconnecting the side members 67A, 67B and 74A, 74B operationally configured to provide structural support and maintain the parallel arrangement of the side members 67A, 67B and 74A, 74B. In another embodiment, proximal arm members 62A, 65A may comprise a single elongated member pivotally attached to a single side of the drive rod connection member 56, however, the configuration of the parallel side members 67A, 67B and 74A, 74B and bracing members 98 as shown are operationally configured to augment structural support of the extendable assemblies 50, 60.

Figure 28:
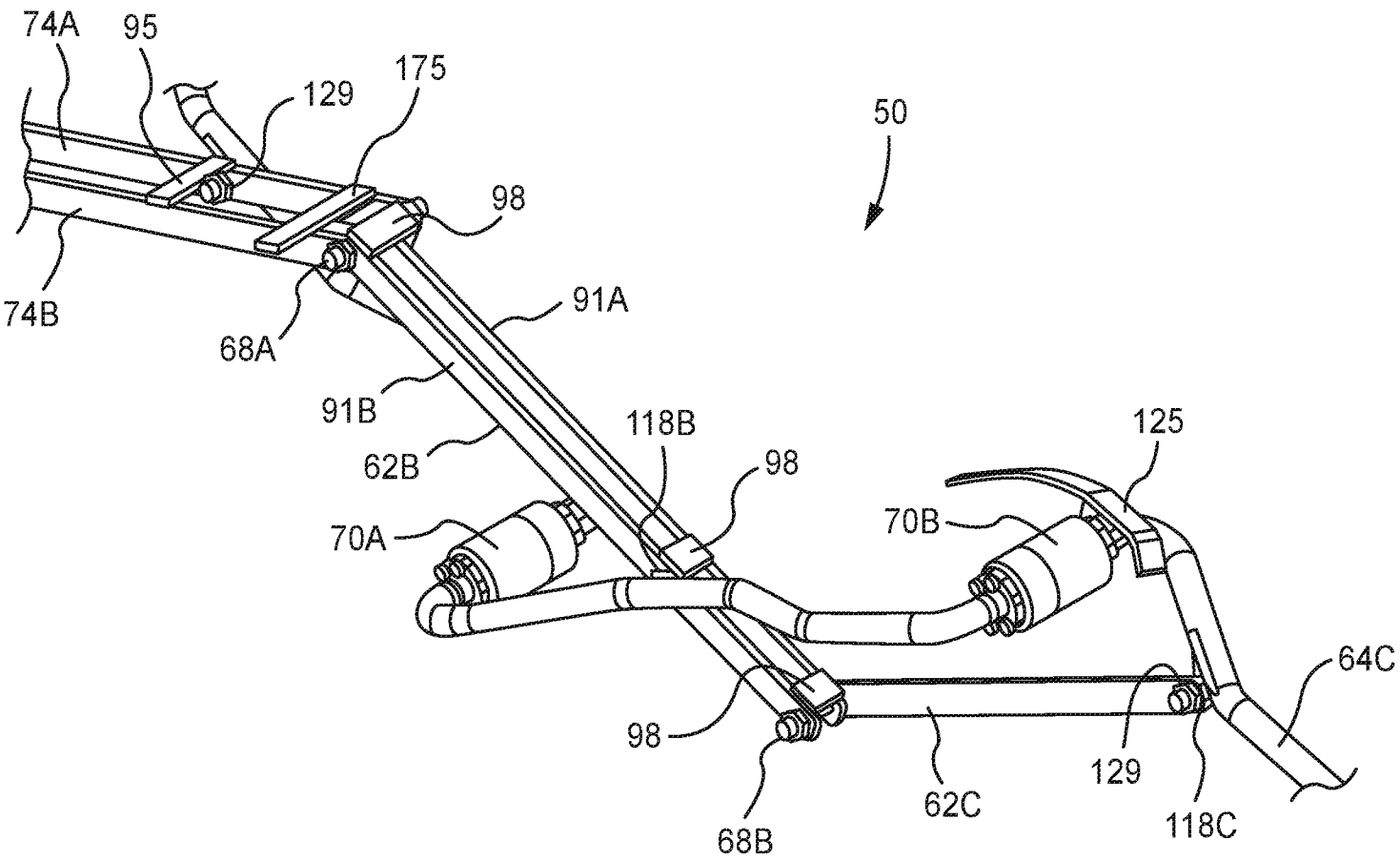
FIG. 28 is a perspective view of part of a first extendable assembly of the apparatus of FIG. 18.

Turning to FIG. 28, the intermediate arm members 62B, 65B may also include an assembly with two elongated side members in parallel defining the length of each of the arm members 62B, 65B, e.g., see side members 91A, 91B of intermediate arm member 62B. One or both of the intermediate arm members 62B, 65B may also include one or more bracing members 98 interconnecting the side members as shown. As depicted in FIG. 28, the width between side members 91A, 91B is less than the width between side members 74A, 74B effective for an interlocking pivotal attachment of the arm members 62A and 62B at pivot point 68A via a common fastener or fastener assembly. In another embodiment, the side members 91A, 91B may be configured to attach on the outside of the side members 74A and 74B at pivot point 68A, for example, (1) an embodiment where each of the side members 91A, 91B widens at its proximal end or (2) an embodiment where the width between the side members 91A, 91B is greater than the width between side members 74A and 74B.

With further reference to FIG. 28, the distal arm members 62C and 65C of this embodiment may be provided as elongated planar members pivotally attached to either side of intermediate arm members 62B and 65B. In this embodiment, the distal arm members 62C and 65C are attached to the front side of the arm members 62B and 65B—see the attachment between arm member 62C and side member 91A in FIG. 28. In still another embodiment, the distal arm members 62C and 65C may be provided with two elongated side members in parallel similar as the proximal arm members 62A, 65A and the intermediate arm members 62B, 65B for pivotal attachment with the intermediate arm members 62B, 65B via a fastener or fastener assembly as described herein.

With particular attention to FIGS. 18, 28-30, arm members 62A-62C and 65A-65C are suitably pivotally connected to the fluid conduit members 64A-64C and 66A-66C at pivot points 118A-118C, 119A-119C in a manner effective for desired extension and retraction of the extendable assemblies 50, 60. In one suitable embodiment, the outer surfaces of the fluid conduit members 64A-64C and 66A-66C may include threaded male members and the arm members 62A-62C and 65A-65C may include apertures for receiving the threaded male members there through (see threaded male member 123 and aperture 124 in FIG. 30). A threaded nut such as a slotted hex nut 129 (see FIG. 28) or the like may be secured to each of the threaded male members in a manner effective to maintain a pivotal connection between the arm members 62A-62C and 65A-65C and fluid conduit members 64A-64C and 66A-66C during operation of the apparatus 10.

Figure 32:
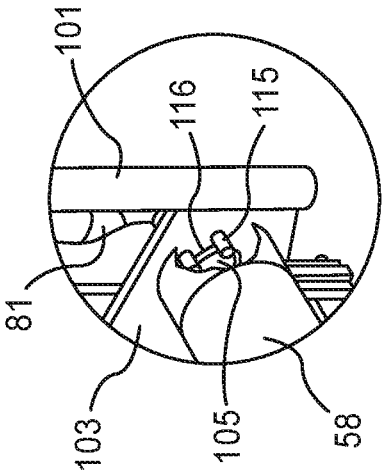
FIG. 32 is a detailed view of part of FIG. 31.
Figure 31:
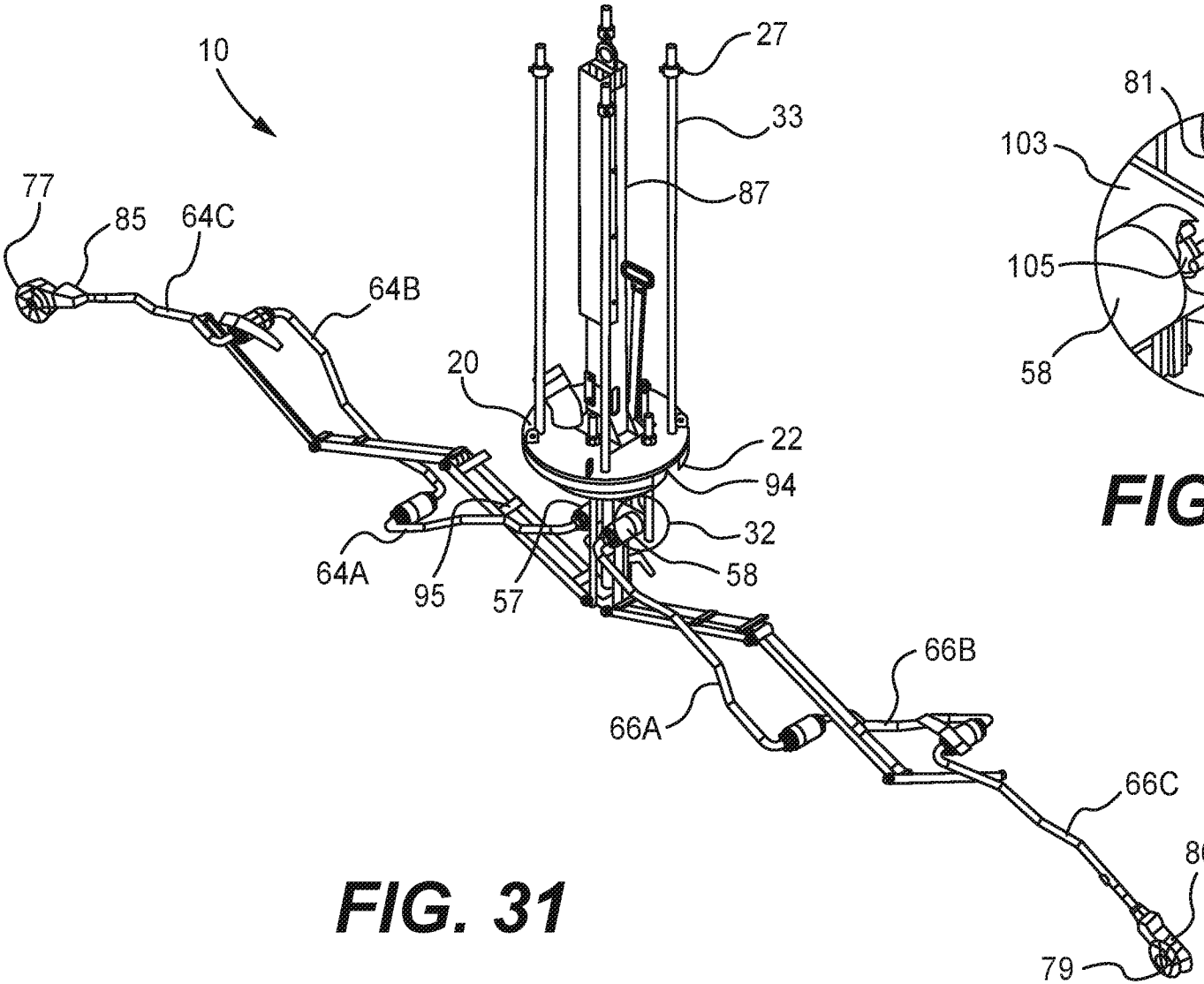
FIG. 31 is another perspective view of the apparatus of FIG. 18 in a fully extended position.
Figure 33:
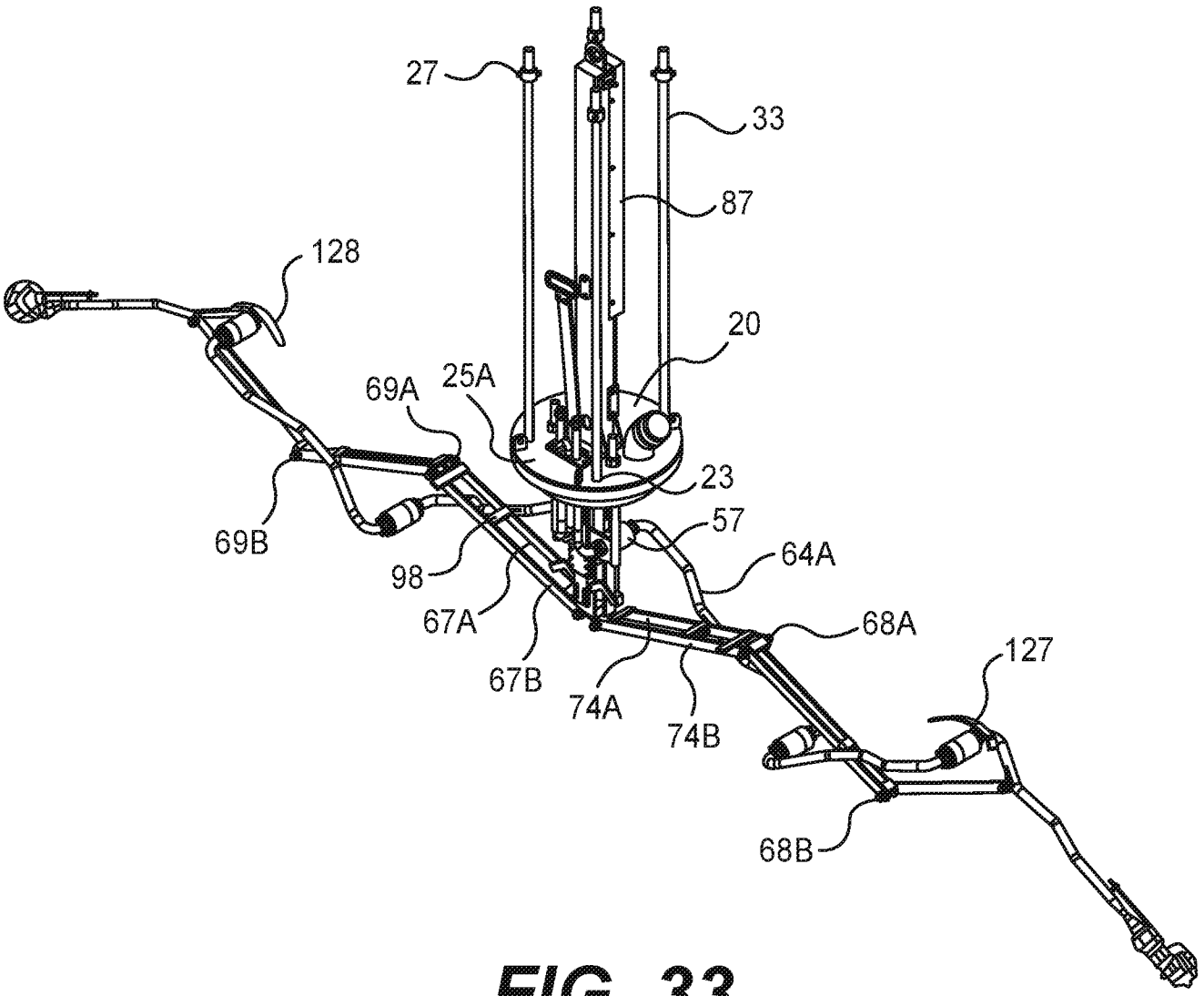
FIG. 33 is another perspective view of the apparatus of FIG. 18 in a fully extended position.

With reference to FIGS. 31-33 each of the fluid junctions 57, 58 may be provided as a high pressure twist coupling, for example, a swivel joint of 10-DN25-SAE 3000, commercially available from NMF Techniek B. V. (a.k.a., NMF Sealing Solutions), Groningen, Netherlands. In this embodiment, the twist couplings 57, 58 are secured to the second fixed support 103 via one or more threaded fasteners 115 disposed through one or more fastener apertures 114 (see FIG. 19) in the fixed support in a manner effective to fluidly communicate each of the twist couplings 57, 58 with their corresponding fluid aperture 104 or 105 and their corresponding fluid conduits 80, 81. Without limiting the invention, one suitable fastener 115 may include a threaded fastener, including but not necessarily limited to a threaded cylinder head cap screw alone or in combination with a spring washer or the like, for mating with corresponding threaded female surfaces of the twist couplings 57, 58. As shown in FIG. 32, the fluid apertures 104, 105 may be fitted with one or more O-rings 116 providing a fluid seal between the second fixed support 103 and the twist couplings 57, 58.

Herein, fluid conduit members 64A and 66A in fluid communication with the fluid junctions 57, 58 may be referred to as proximal fluid conduit members. Fluid conduit members 64B and 66B may be referred to as intermediate fluid conduit members and conduit members 64C and 66C in fluid communication with the high pressure spray nozzles 85, 86 discussed below may be referred to herein as distal fluid conduit members. In this embodiment, the intermediate fluid conduit members 64B and 66B are fluidly communicated with proximal and distal fluid conduit members 64A and 64C and 66A and 66C at their open ends via twist couplings 70A, 70B, 71A, 71B operationally configured to allow for simultaneous extension and retraction of the extendable assemblies 50, 60. Suitable twist couplings 70A, 70B, 71A, 71B may include swivel joints similar in kind as the fluid junctions 57, 58 as described above.

For high pressure fluid tank 5 cleaning operations, one suitable embodiment of the apparatus 10 is operationally configured for use at internal fluid pressures from 3447.4 kPa (500.00 PSI) to 34473.8 kPa (5000.0 PSI). For such embodiment, the fluid conduit members 64A-64C and 66A-66C are suitably constructed from one or more materials operable at a maximum internal pressure up to 34473.8 kPa (5000.0 PSI). Suitable materials of construction for the fluid conduit members 64A-64C and 66A-66C include one or more metals, including but not necessarily limited to stainless steel, titanium, aluminum, and combinations thereof. For high pressure fluid tank 5 cleaning operations, suitable fluid conduit members 64A-64C and 66A-66C are constructed of stainless steel and have an inner diameter of 26.6 mm (1.0 inches), an outer diameter of 33.4 mm (1.3 inches), each having a length of 107.5 cm (42.3 inches). As further shown in FIG. 29, each of the fluid conduit members 64A-64C and 66A-66C may include a shape effective to provide the retracted configuration of the extendable assemblies 50, 60 and shown in FIG. 24.

Figure 29:
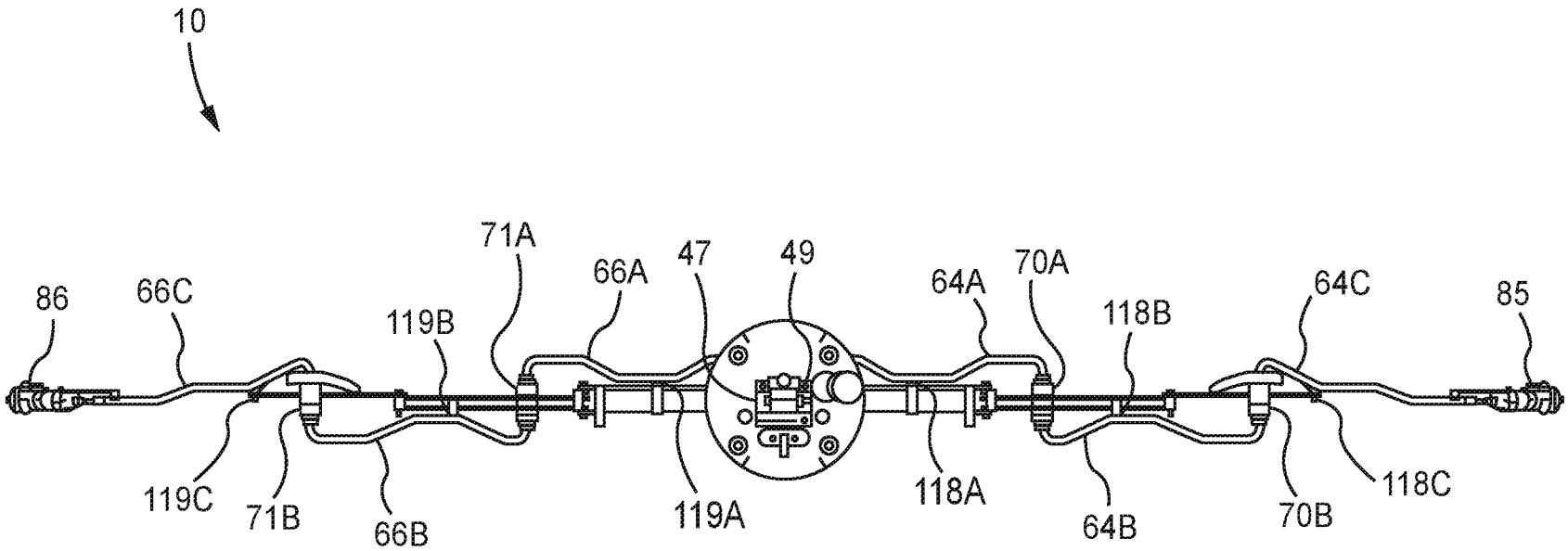
FIG. 29 is a top view of the apparatus of FIG. 18 in a fully extended position.
Figure 30:
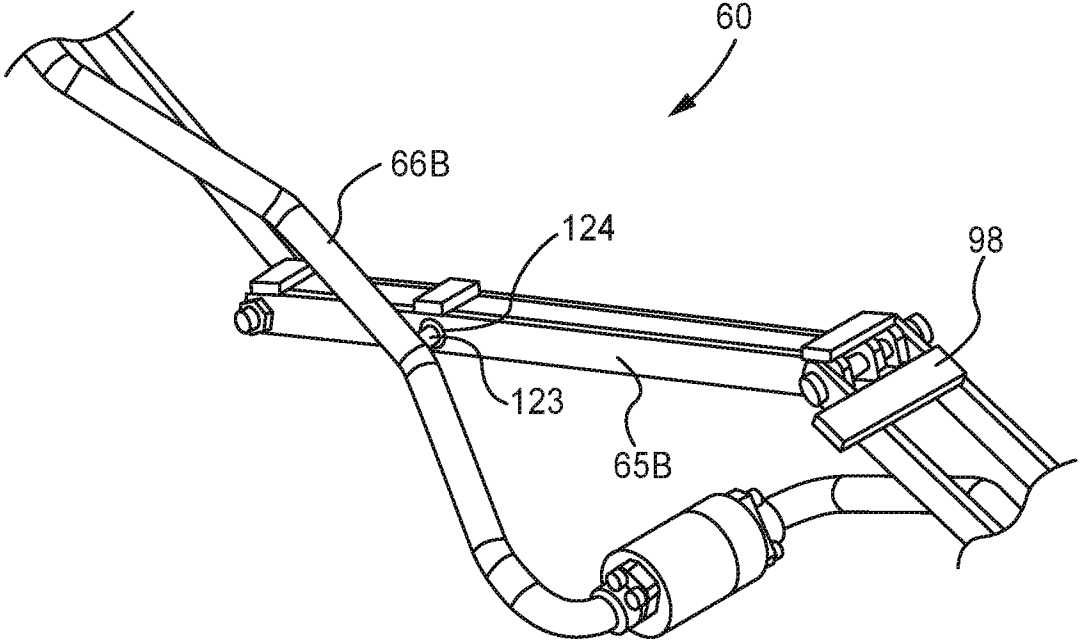
FIG. 30 is a perspective view of part of a second extendable assembly of the apparatus of FIG. 18.

Referring to FIG. 29, suitable spray nozzles 85, 86 include swivels wherein rotation of the cleaning head of the swivel increases as the fluid flow rate increases. For high pressure fluid tank 5 cleaning operations, suitable spray nozzles 85, 86 are operable at internal pressures up to 34473.8 kPa (5000.0 PSI) and flow rates up to 120.0 liters per minute (31.7 gallons per minute). Without limiting the invention, suitable high pressure spray nozzles 85, 86 for use herein may include the stainless steel A80R rotating self-propelled cleaning head model swivel commercially available from P.A. SpA, Rubiera, Italy. For one or more particular operations, the spray nozzles 85, 86 may also include guard brackets 77, 79 as standard equipment or as an add-on feature (see FIGS. 18 and 31). In one suitable embodiment, the spray nozzles 85, 86 include four nozzles having the following dimensions (L/D): 271.5 mm (10.7 inches)/161.0 mm (6.3 inches). In one particular embodiment, the spray nozzles 85, 86 may include stainless steel self-spinning cleaning head model RW200A commercially available from Bolondi Ivano, Montecchio Emilia, Italy, having the following dimensions (L/D): 257.0 mm (10.0 inches)/174.0 mm (6.9 inches).

Each extendable assembly 50, 60 may also include a guard member (or skate 125, 126) attached to the twist couplings 70B and 71B (see FIGS. 18, 24, 28, 34) by removable fasteners such as bolts or the like to promote extension and retraction of each extendable assembly 50, 60. In this embodiment, the skates 125, 126 are provided as curved members or curved blade type members oriented in a manner effective to provide surfaces effective to assist each of the extendable assemblies 50, 60 fold to a proper retracted position with the distal edges 127, 128 of each skate 125, 126 directed within the perimeter of the ring member 14 as shown in FIG. 24. The skates 125, 126 are suitably constructed of one or more metals including, but not necessarily limited to stainless steel, titanium, aluminum, and combinations thereof. As understood by the skilled artisan, the shape of the skates 125 and 126 and their mode of attachment to the twist couplings 70B and 71B provides resiliency to each of the skates 125, 126 when forces are applied to the skates 125, 126, e.g., when the skates 125, 126 are being contacted by an object or part of a tank 5.

Figure 35:
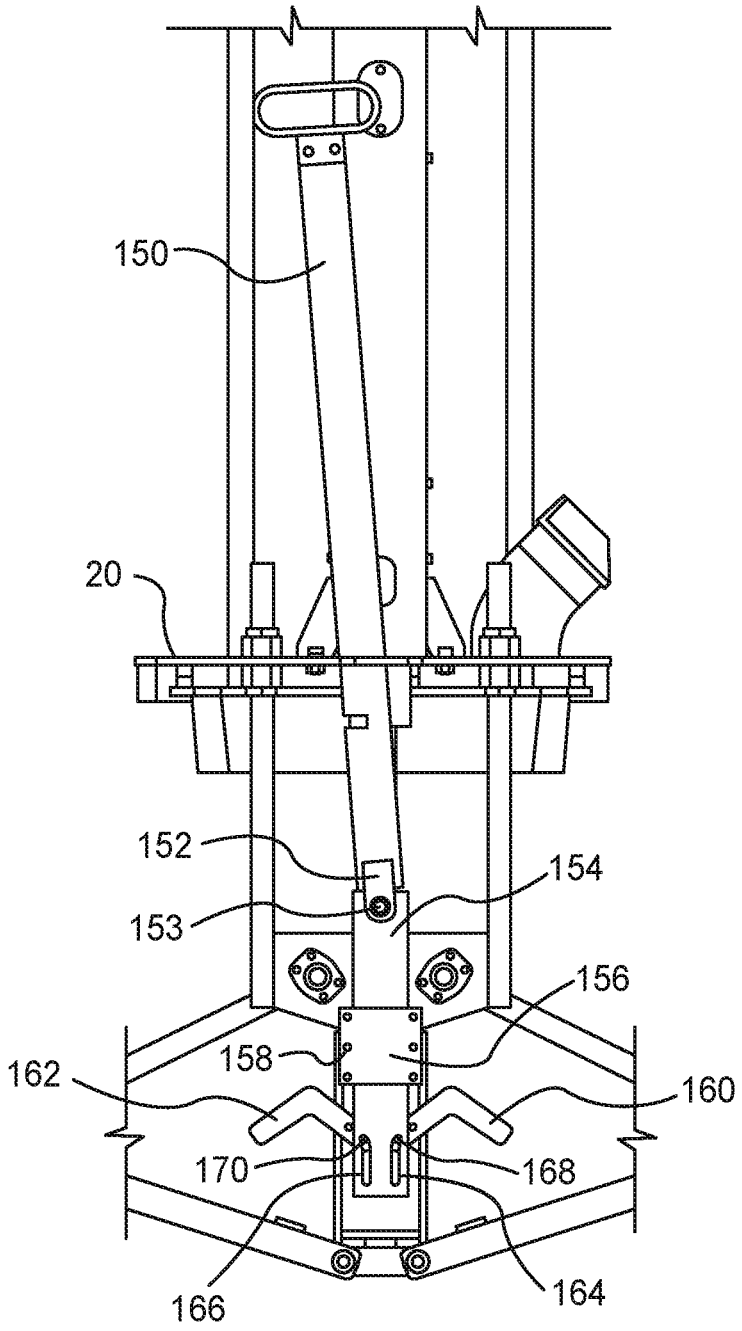
FIG. 35 is a side view of part of the apparatus of FIG. 18.
Figure 36:
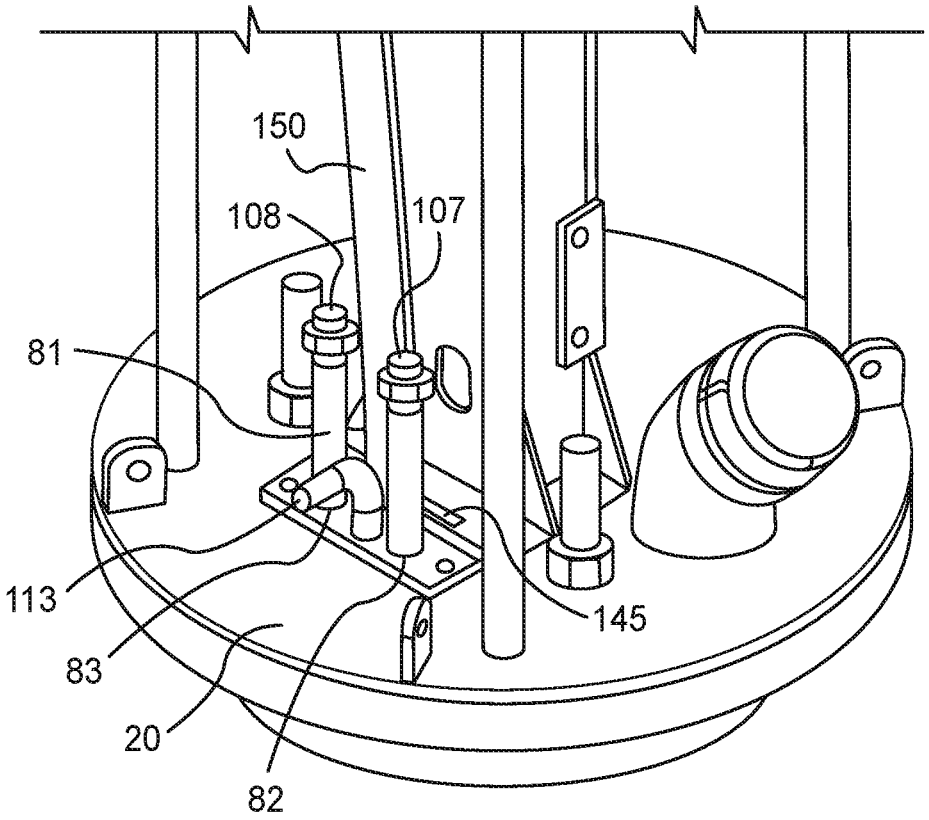
FIG. 36 is a perspective view of part of the apparatus of FIG. 18 including a cover member.

The apparatus 10 of this embodiment further includes a locking assembly operationally configured to assist the cylinder 88 in maintaining the extendable assemblies 50, 60 in (1) a fully retracted position as shown in FIG. 24 during transport and/or non-use of the apparatus 10 and (2) an extended position as shown in FIG. 18. With reference to FIG. 35, one suitable locking assembly includes a manually operated latching arm 150 disposed through the cover member 20 in a manner effective to pivot back and forth between locked position with the cover member 20 and an unlocked position apart from the cover member 20. One suitable latching arm 150 is provided as an elongated planar member (see FIG. 23) with straight side edges extending out from the outer surface 25A of the cover member 20 to a height less than the height of the housing 87. Suitably, the cover member 20 includes a slot 145 for receiving the latching arm 150 there through (see FIG. 36). As shown, the slot 145 in the cover member 20 includes a length greater than the width of the latching arm 150 allowing the latching arm 150 to pivot up to 5.0 degrees from vertical in either direction.

Referring again to FIG. 35, the locking assembly further includes a slide member 154 providing a pivotal attachment surface for the latching arm 150 via a link member 152 at pivot point 153 located along the longitudinal axis of the apparatus 10. In this embodiment, the slide member 154 is provided as a planar plate type member including a first end with an aperture there through for receiving a pivot pin or other pivot fastener effective for pivotal attachment of the link member 152 and latching arm 150 to the slide member 154. In one suitable embodiment, the link member 152 may be pivotally attached to the link member 154 via a hex head bolt, slotted hex nut and washer combination or the like. In another embodiment, the latching arm 150 may be pivotally attached directly to the slide member 154.

In one aspect, the slide member 154 is secured to the second fixed support 103 via a guide block or guide plate 156, which is attached to the second fixed support 103 via one or more fasteners such as rivots, screws or the like and/or fastener assemblies 158 wherein the guide plate 156 and one or more fasteners and/or fastener assemblies 158 are operationally configured to maintain a linear orientation of the slide member 154 according to the longitudinal axis of the apparatus 10. Without limiting the invention, one suitable fastener assembly 158 includes a cylinder head cap screw and washer combination.

A second end of the slide member 154 partially covers opposing catch arms 160, 162 of the locking assembly wherein the covered parts of the catch arms 160, 162 are sandwiched between the slide member 154 and the second fixed support 103. As shown, the second end of the slide member 154 includes two mirror like curved openings or slots 164, 166 for receiving axle guide pins 168, 170 of the catch arms 160, 162 there through in a manner effective to secure the catch arms 160, 162 to the apparatus 10.

Figure 34:
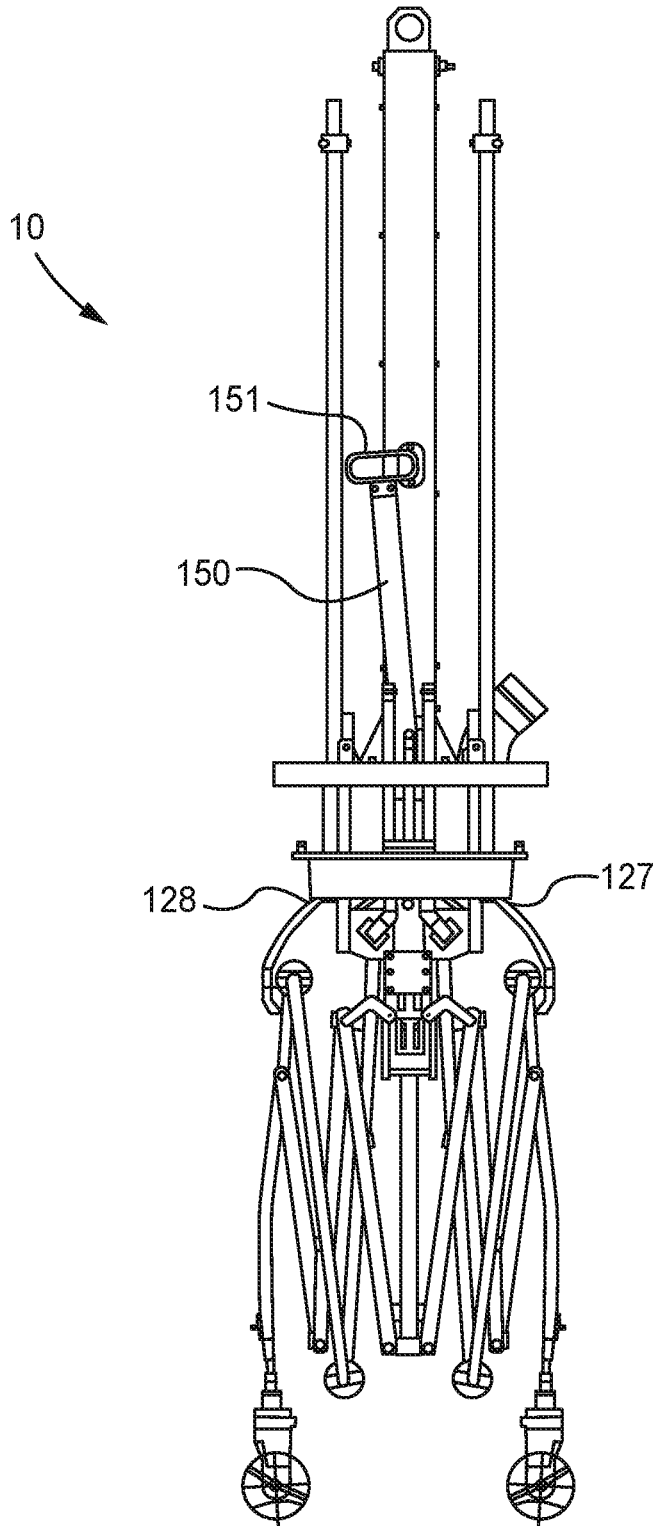
FIG. 34 is another side view of the apparatus of FIG. 18.
Figure 37:
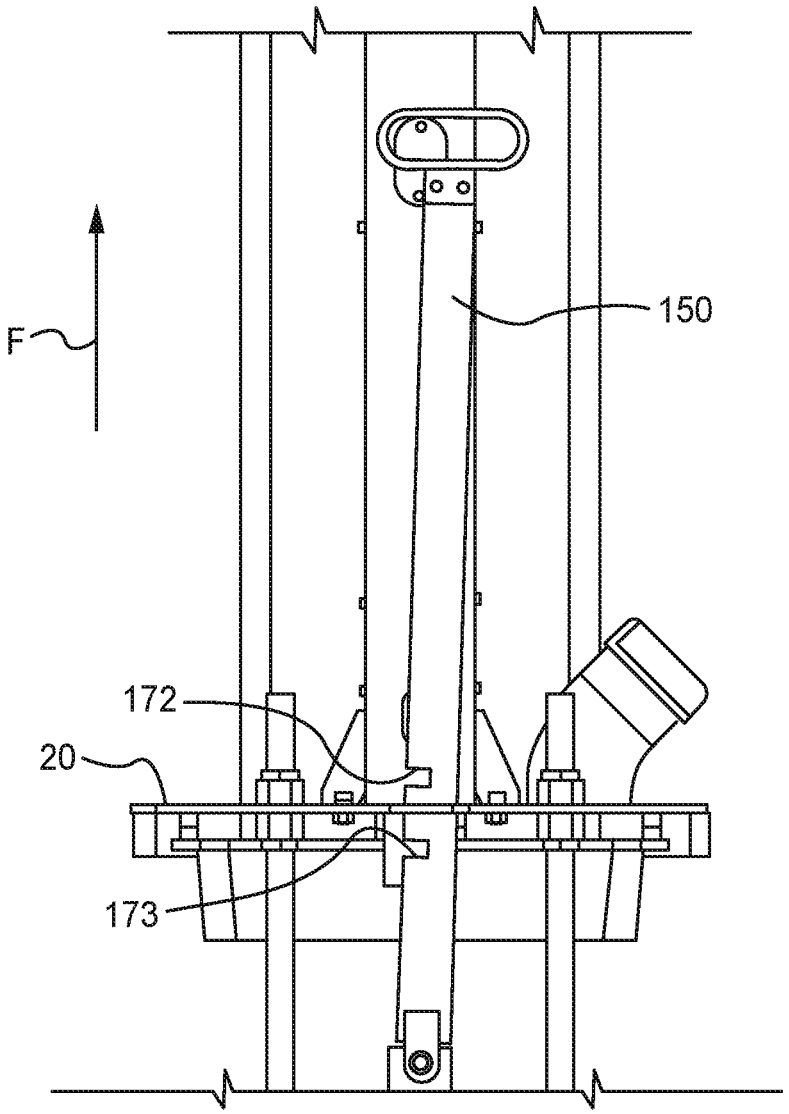
FIG. 37 is a sectional side view of part of the apparatus of FIG. 18.
Figure 38:
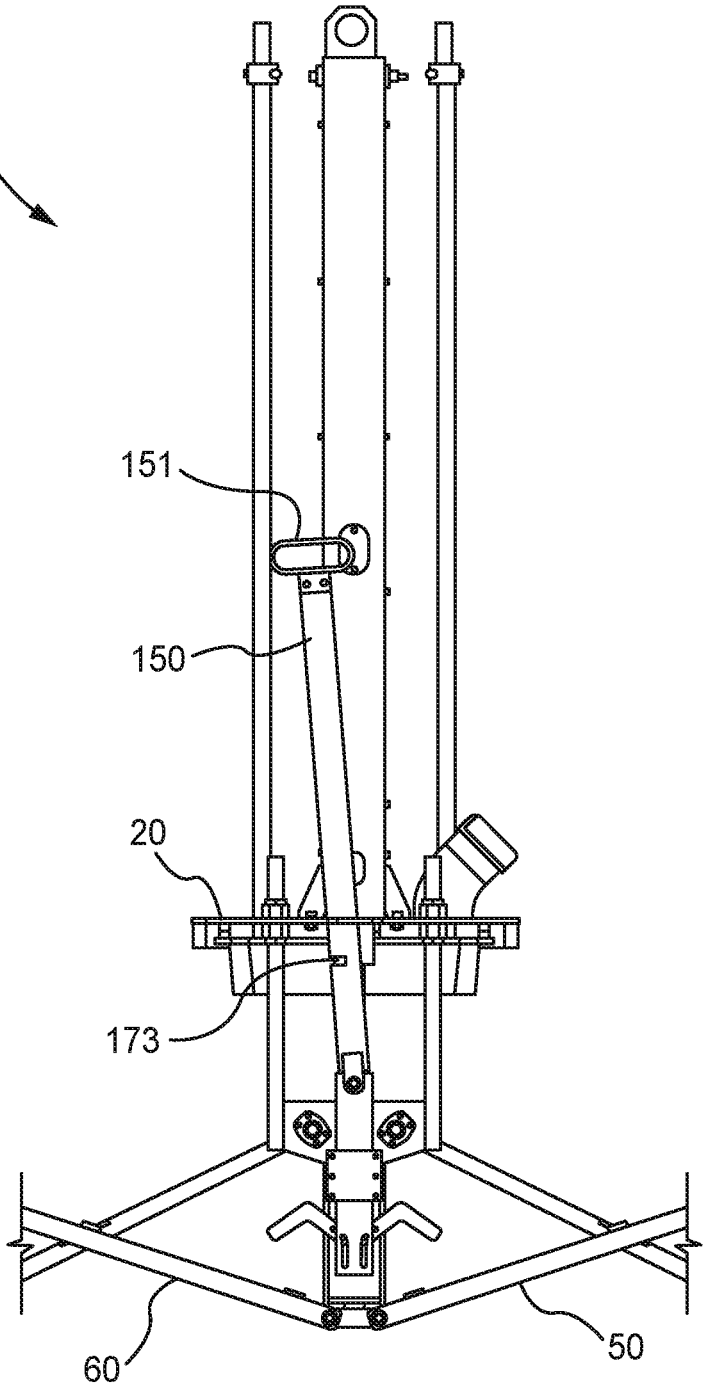
FIG. 38 is a side view of part of the apparatus of FIG. 18.
Figure 39:
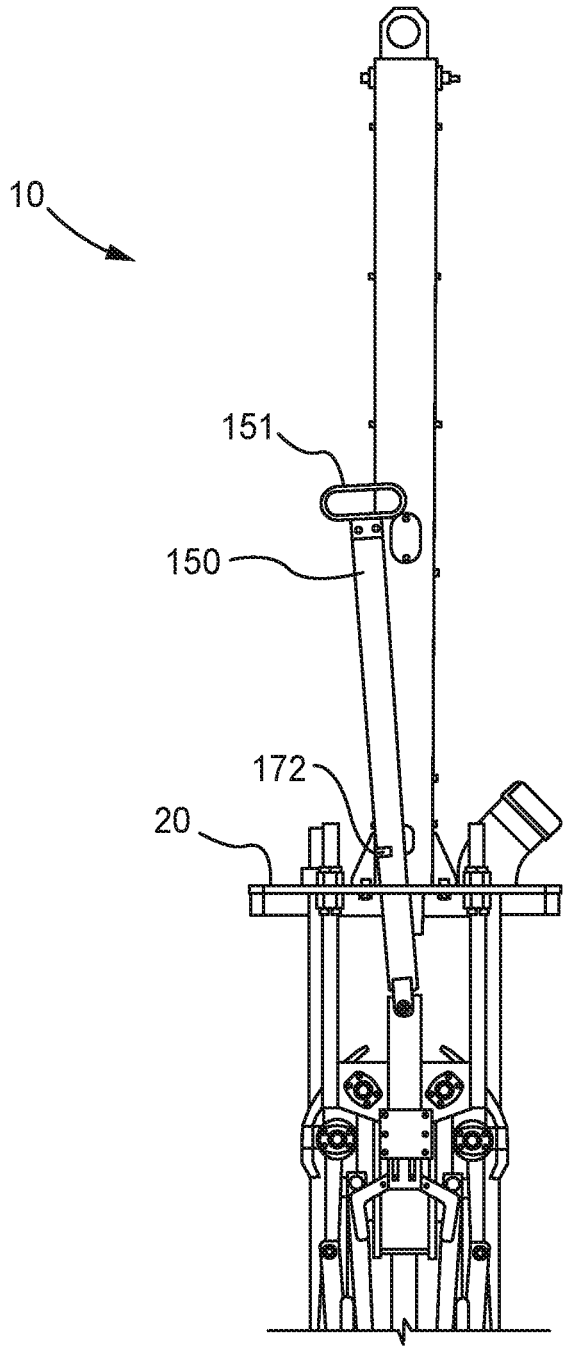
FIG. 39 is a side view of part of the apparatus of FIG. 18.

As shown in FIG. 37, the latching arm 150 of this embodiment includes at least two cutout portions or notches 172, 173 at different locations along a first side edge of the latching arm 150. The notches 172, 173 are suitably sized to engage the part of the cover member 20 located at the corresponding edge of slot 145. In other words, the notches 172, 173 (or "locking notches 172, 173") are larger than the thickness of the cover member 20 allowing part of the cover member 20 to be inserted within the locking notches 172, 173 for purposes of locking the apparatus 10 when the apparatus 10 is set to an extended position or a fully retracted position. For example, when the apparatus 10 is set at a fully extended position as shown in FIG. 38, the latching arm 150 may be directed from an unlocked position as shown in FIG. 37 to a locked position as shown in FIG. 38 where the locking notch 172 engages the cover member 20 maintaining the extendable assemblies 50, 60 in a fully extended position. To return the apparatus 10 to a fully retracted position, the latching arm 150 may be directed back to an unlocked position allowing the drive rod assembly to retract each of the extendable assemblies 50, 60 to a position as shown in FIG. 34. At an unlocked position, one or more individuals may direct the latching arm 150 linearly away from the cover member 20 (see directional arrow F in FIG. 37) by grabbing and/or latching onto the handle 151 of the latching arm 150 to further direct the extendable assemblies 50, 60 a fully retracted position as shown in FIGS. 24 and 39.

Figure 40:
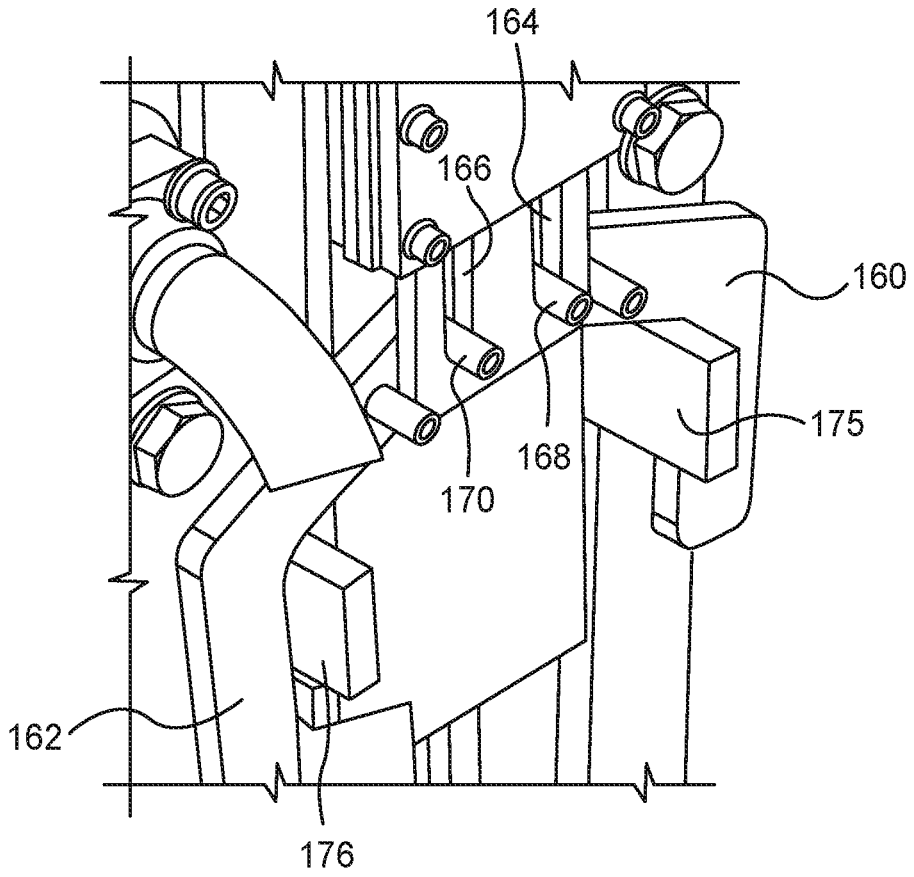
FIG. 40 is a perspective view of part of the apparatus of FIG. 18.
Figure 42:
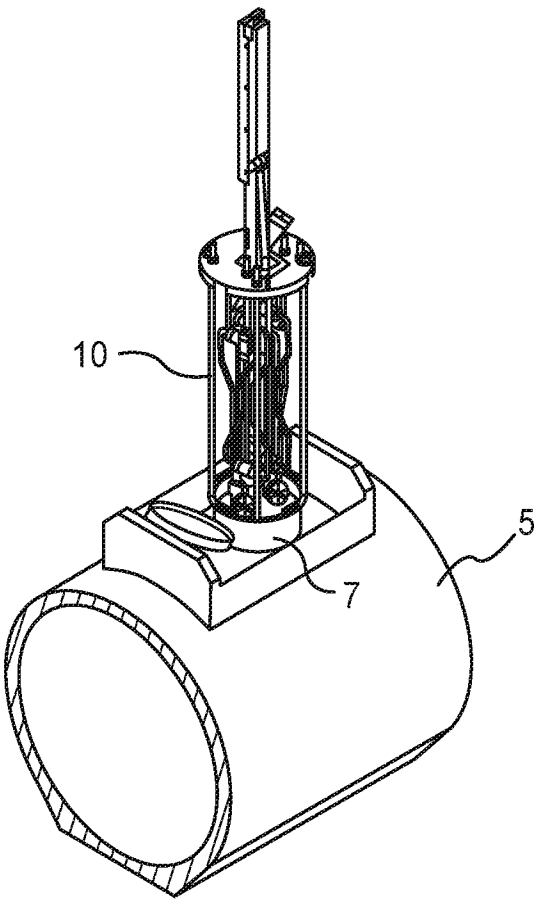
FIG. 42 is a perspective view of the apparatus of FIG. 41 including a ring member of the apparatus mated to the manhole of the tank trailer.
Figure 41:
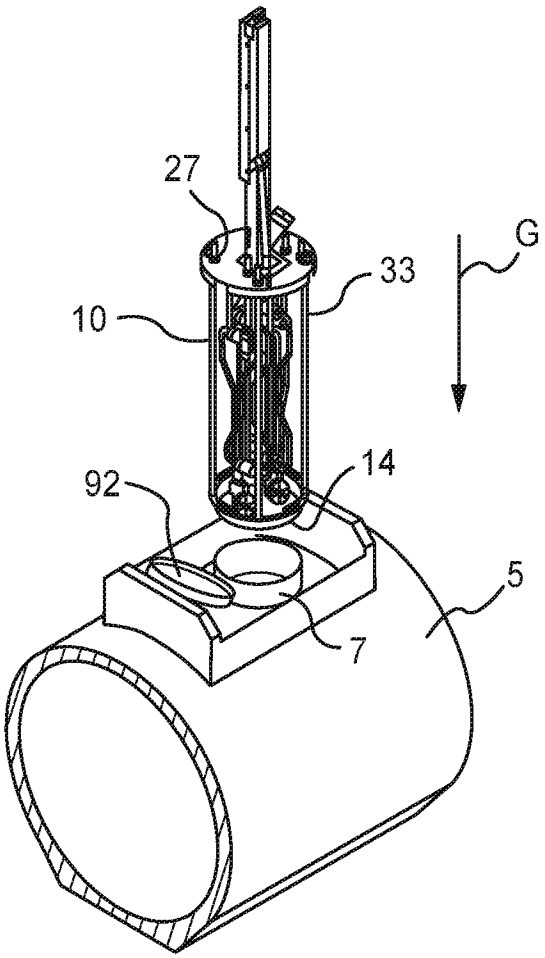
FIG. 41 is a perspective view of the apparatus of FIG. 18 and a simplified illustration of a tank trailer including the apparatus located above a manhole of the tank trailer.

In this particular embodiment including the apparatus 10 mated with a manhole 7 of a tank 5, as the latching arm 150 is directed upward according to directional arrow F the shape of each slot 164, 166 is effective to direct the axle guide pins 168, 170 along a curved path the length of the slots 164, 166, which simultaneously turns each of the catch arms 160, 162 directing the distal end of each catch arm 160, 162 toward the longitudinal axis of the apparatus 10 as shown in FIG. 40. Once the extendable assemblies 50, 60 are set at a fully retracted position, the latching arm 150 may be directed to a locked position via locking notch 173.

As further shown in FIG. 40, as each of the catch arms 160, 162 turns, the catch arms 160, 162 engage a contact section of the bracing members 175, 176 of each proximal arm member 62A, 65A that extends out beyond the side members 67B and 74B (see FIG. 27) forcing the assemblies to the fully retracted position. The locked position of the latching arm 150 and the engagement between the catch arms 160, 162 and the bracing members 175, 176 is operationally configured to maintain the apparatus 10 in a fully retracted position for removal of the apparatus 10 from a tank 5, for transport and storage of the apparatus 10. It is also contemplated that a wrapping material, sleeve, sack, chain, rope or the like may further be placing around the extendable assemblies 50, 60 to assist in maintaining each in a fully retracted position. In an embodiment including proximal arm members 62A, 65A comprised of a single elongated member, each of the arm members 62A, 65A may include an appendage or other contact surface operationally configured for engaging the catch arms 160, 162 similar as the contact section of the bracing members 175, 176 described above.

The travel distance of the latching arm 150 may vary depending on the configuration and/or size of a particular embodiment of the apparatus 10. As understood by the skilled artisan, the locking notches 172, 173 are suitably spaced apart according to a desired length of travel for a particular latching arm 150. For high pressure fluid tank 5 cleaning operations, one suitable latching arm 150 may include a travel distance of or about 7.62 cm (3.0 inches).

Exemplary installation and operation of the apparatus 10 of FIG. 18 is illustrated in FIGS. 41-47. Beginning with FIGS. 41-42, the apparatus 10 may be directed to a position of axial alignment with the manhole 7 of a target tank 5 with the apparatus 10 set to a fully retracted position and the latching arm 150 set at a locked position. Once aligned, the ring member 14 may be directed to a mated position with the manhole 7 (see directional arrow G). At this point during installation, the collar members 27 act as a catch whereby the guide members 33 and the ring member 14 attached thereto are suspended from the cover member 20 via the collar members 27 with the extendable assemblies 50, 60 being located within the guide members 33 as shown.

Figure 44:
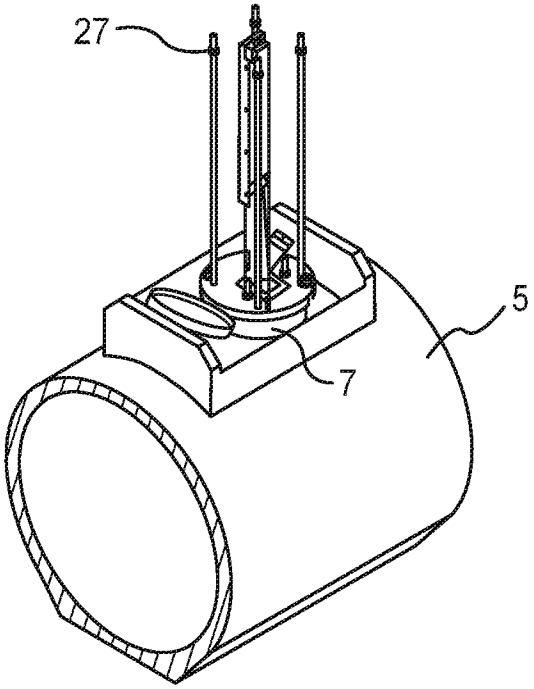
FIG. 44 is a perspective view of the apparatus of FIG. 41 including a cover member of the apparatus covering a ring member of the apparatus and the manhole of the tank trailer.
Figure 43:
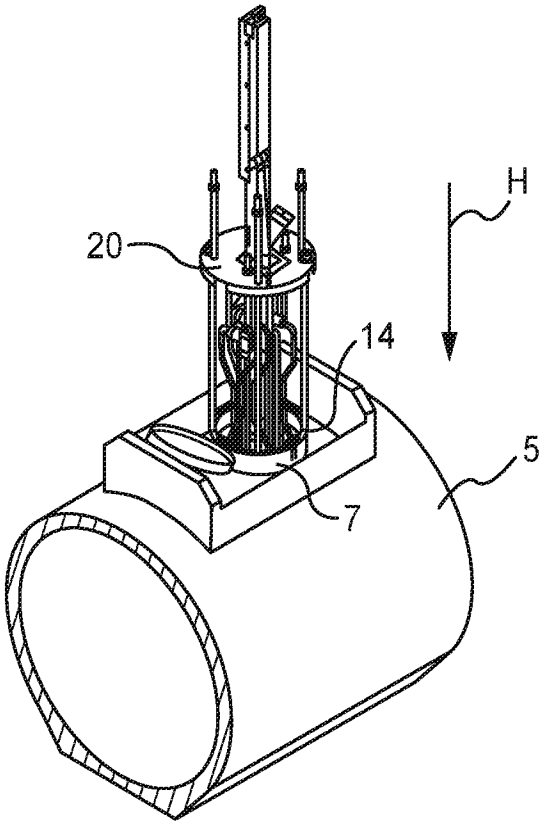
FIG. 43 is a perspective view of the apparatus of FIG. 41 shown partially located within a tank trailer.
Figure 46:
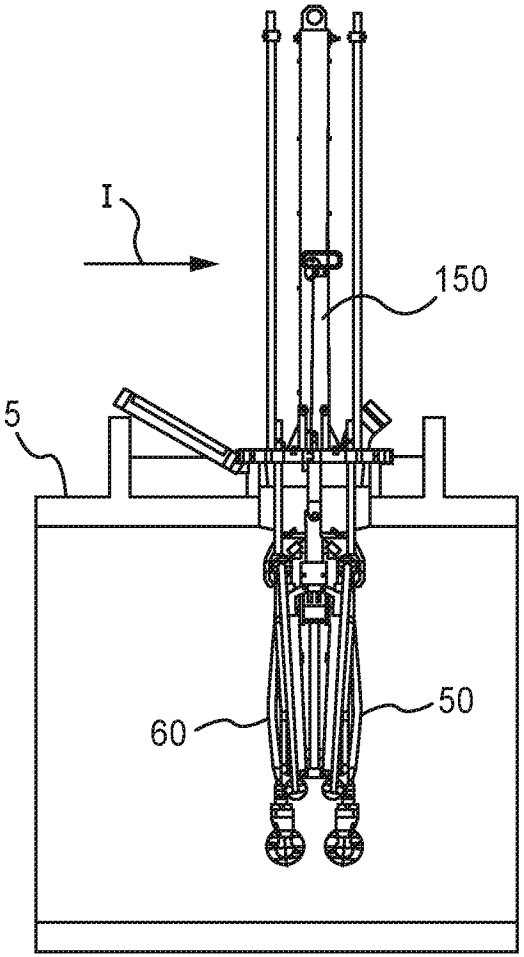
FIG. 46 is a side view of the apparatus of FIG. 45 in an unlocked position including a first extendable assembly and a second extendable assembly of the apparatus set within the tank trailer in a fully retracted position.
Figure 45:
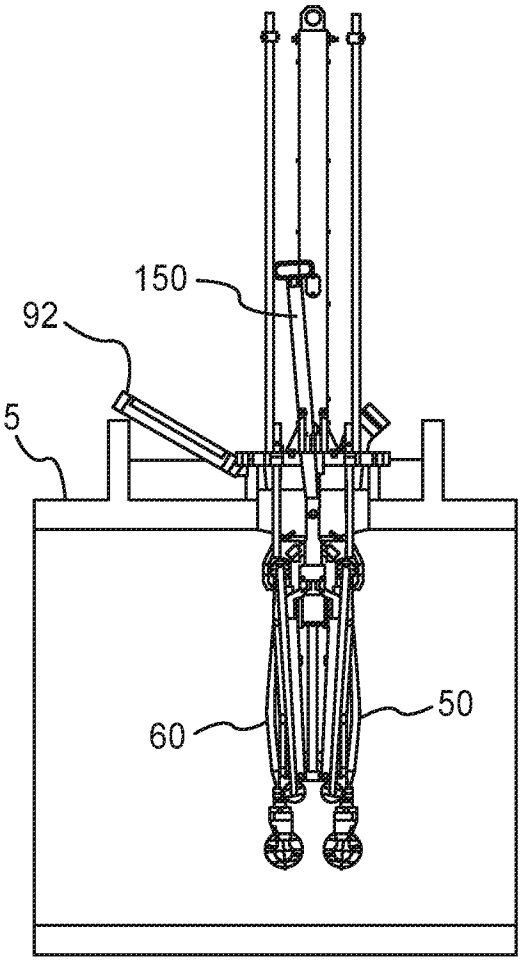
FIG. 45 is a side view of the apparatus of FIG. 41 in a locked position including a first extendable assembly and a second extendable assembly of the apparatus set within a tank trailer in a fully retracted position.
Figure 47:
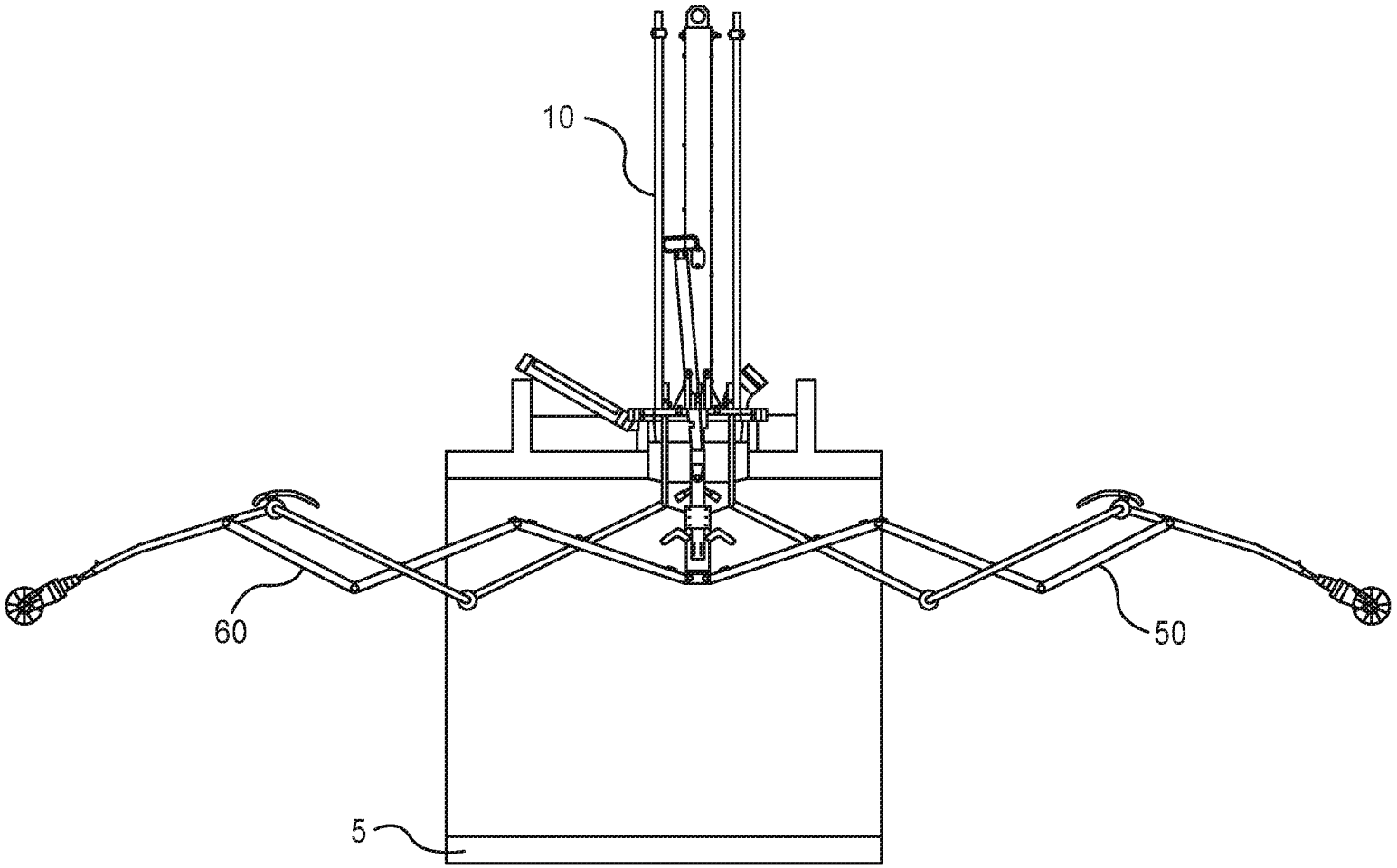
FIG. 47 is a side view of the apparatus of FIG. 45 in a locked position including a first extendable assembly and a second extendable assembly of the apparatus set within the tank trailer in a fully extended position.

Once the ring member 14 is set to a mated position with the manhole 7, the cover member 20 may be directed along the guide members 33 (see directional arrow H in FIG. 43) to a mated position with the ring member 14 covering the manhole 7 as shown in FIG. 44. As shown in FIGS. 45 and 46, once the apparatus 10 is installed the latching arm 150 may be directed to an unlocked position (see directional arrow I) whereby the drive rod assembly may be activated to direct each of the extendable assemblies 50, 60 to a partially extended or fully extended position as shown in FIG. 47. At an extended position, the spray nozzles 85, 86 of the extendable assemblies 50, 60 are suitably positioned along the longitudinal center line of a tank 5 at a distance from the opposing inner end walls of the tank 5 providing for desired or optimal impact of fluid streams emitted from the spray nozzles 85, 86 onto the end walls, for example, fluid streams emitted from the spray nozzles 85, 86 at internal fluid pressures from 3447.4 kPa (500.00 PSI) to 34473.8 kPa (5000.0 PSI). A desired impact of fluid streams may also contact other parts of the interior of a tank 5 when the apparatus 10 is set at one or more partially extended positions.

In the event that the apparatus 10 of FIGS. 41-47 malfunctions during operation, the apparatus 10 is further operationally configured to be manually removed from a tank 5. In such an event, the following steps may be performed: (1) disconnect and remove the housing 87 and drive rod assembly from the cover member 20 by removing the three fastener assemblies 49; (2) disconnect and remove the latching arm 150; (3) disconnect and remove the collar members 27 from the guide members 33; (4) using the lift rings 29, direct the cover member 20 away from the ring member 14 to remove the cover member 20 from the guide members 33; (5) once the cover member 20 is removed, one or more persons may then enter the tank 5 through the manhole 7 in order to manually dismantle the extendable assemblies 50, 60 for removal of the apparatus 10 from the tank 5. During the removal process, the ring member 14 and the guide members 33 may remain in place about the manhole 7. In the alternative, the ring member 14 and/or the guide members 33 may be removed to provide additional clearance at the manhole 7 as desired.

Turning to FIGS. 48-54, in another embodiment the apparatus 10 may include a drive rod assembly as described above, but with a different locking assembly configuration effective to assist in gathering or directing the first and second extendable assemblies 50, 60 to a fully retracted position or a substantially fully retracted position to aid in the removal of the apparatus 10 from a tank 5 through a manhole 7. Suitable linear actuators of the drive rod assembly include tie rod double acting cylinders commercially available from Norgren GmbH, Alpen, Federal Republic of Germany. One non-limiting example of a Norgren GmbH tie rod double acting cylinder includes the IMI NORGREN® TKA/8080/M/650 (80.0 mm diameter, 650.0 mm stroke length).

Figure 50:
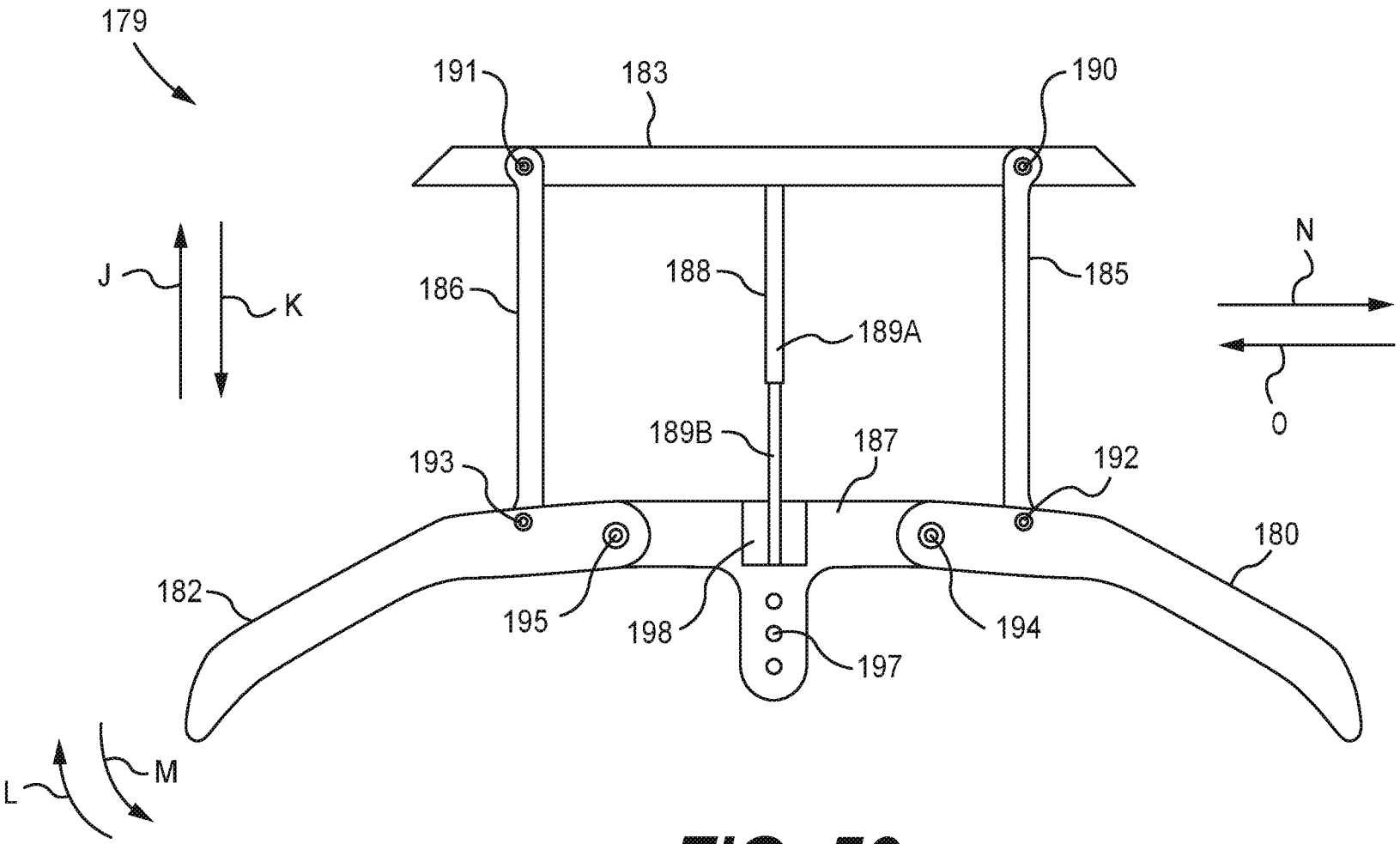
FIG. 50 is a side view of a locking assembly of the apparatus of FIG. 48.

With particular reference to FIG. 50, a locking assembly 179 of this embodiment includes (1) a horizontal cross support member 183, (2) opposing vertical connectors 185, 186, (3) a travel assembly including a mount plate 187 and a stabilizing linear guide member 188 interconnecting the mount plate 187 and the cross support member 183 and (4) opposing catch arms 180, 182. The cross support member 183 suitably includes an elongated member providing an attachment surface for a first end of the vertical connectors 185, 186 and a first end of the guide member 188 as shown. In particular, a first end of the guide member 188 includes an outer tube 189A perpendicularly attached at or near a midpoint of the cross support member 183 along a centerline of the locking assembly 179 and each vertical connector 185, 186 includes a first end pivotally attached to the cross support member 183 (see pivot points 190 and 191)—the vertical connectors 185, 186 being located on opposite sides of the guide member 188 as shown in FIG. 50.

The guide member 188 also includes a rod 189B partially disposed within the tube 189A and linearly moveable therein, the rod 189B providing a second end of the guide member attached at or near a midpoint of the mount plate 187. As further shown, a second end of vertical connector 185 is pivotally attached to catch arm 180 (see pivot point 192) and a second end of vertical connector 186 is pivotally attached to catch arm 182 (see pivot point 193). As discussed below, each of the vertical connectors 185, 186 is operationally configured to move from a parallel orientation with the guide member 188 as shown in FIG. 50 to a non-parallel orientation with the guide member 188 according to the distance between the cross support member 183 and the mount plate 187.

Still referring to FIG. 50, the mount plate 187 includes a planar T-shape type member including a horizontal section and a vertical section defined by one or more fastener through holes 197. Suitably, the distal ends of the horizontal section of the mount plate 187 provide pivotal attachment points for the catch arms 180, 182 (see pivot points 194 and 195). Herein, pivot points 194 and 195 may be referred to as first pivot points of the catch arms 180, 182 and pivot points 192 and 193 may be referred to as second pivot points of the catch arms 180, 182. As described below, the configuration of the catch arms 180, 182 and the location of the pivot points, 190, 191, 192, 193, 194, 195 dictate movement, e.g., extension and retraction or opening and closing, of the catch arms 180, 182 in a manner effective to assist in gathering or directing the first and second extendable assemblies 50, 60 to a fully retracted position or a substantially fully retracted position.

In one embodiment, the pivot points 190, 191, 192, 193, 194, 195 suitably comprise pivot pin attachments, e.g., rivets or a solid bars provided with washers welded about corresponding pivot points. The tube 189A is suitably connected to the cross support member 183 via welds, fasteners, and combinations thereof and the rod 189B is suitably connected directly to the mount plate 187 via welds or interconnected to the mount plate 187 via a plate member 198 or the like providing structural reinforcement to the mount plate 187.

Figure 51:
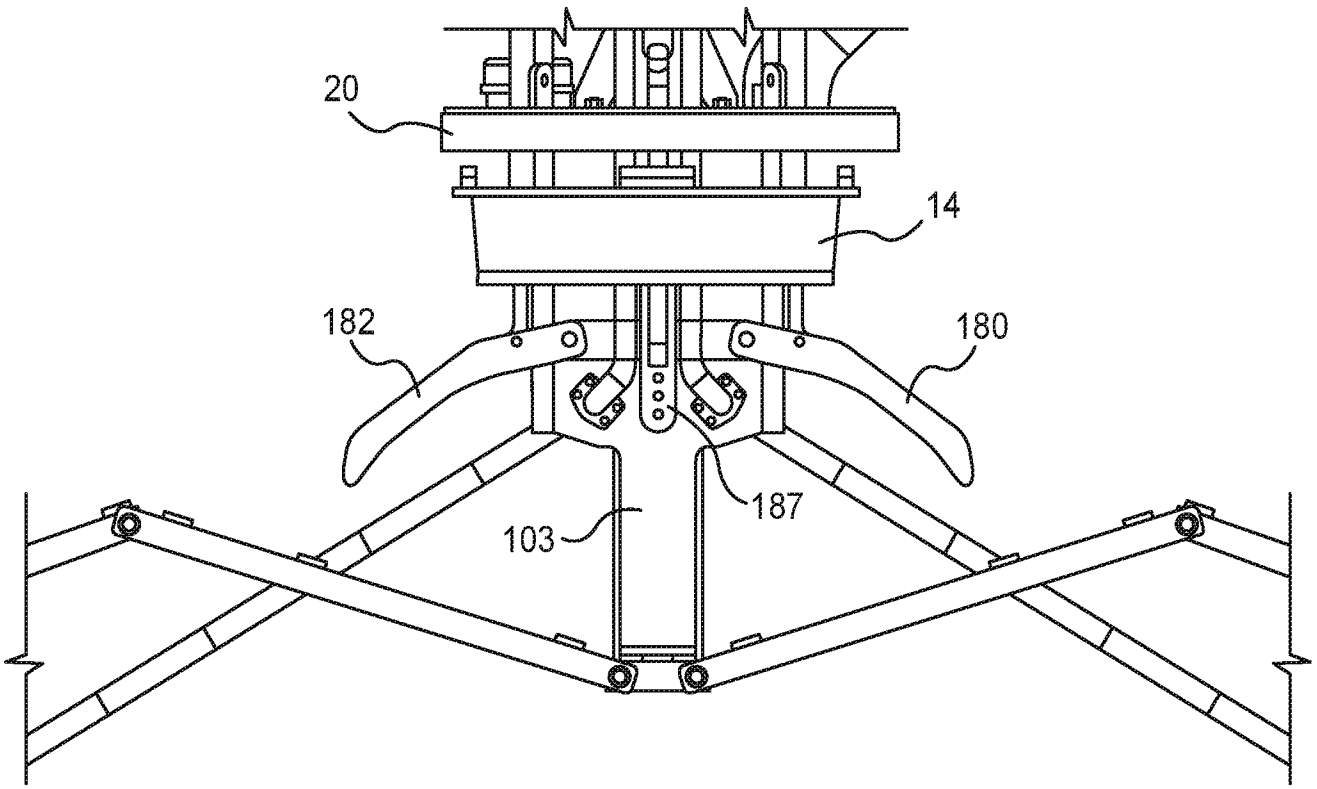
FIG. 51 is a side view of part of the apparatus of FIG. 48.

Turning to FIG. 51, the mount plate 187 is secured to the second fixed support 103 via welds and/or is fastened to the second fixed support 103 via the one or more through holes 197, e.g., using threaded fasteners or the like. Suitably, the catch arms 180, 182 include a non-linear curved type shape and extend out from the mount plate 187 in a manner effective to grab or hook at least part of the first and second extendable assemblies 50, 60 corresponding thereto in a manner effective to assist in gathering or directing the first and second extendable assemblies 50, 60 to a fully retracted position or a substantially fully retracted position (see FIG. 53) to aid in the removal of the apparatus 10 from a tank 5 through a manhole 7. In addition, the catch arms 180, 182 may also be operationally configured to assist in maintaining the first and second extendable assemblies 50, 60 in a retracted position when the apparatus 10 is directed into a tank 5 through a manhole 7 and during periods of non-use of the apparatus 10.

Figure 48:
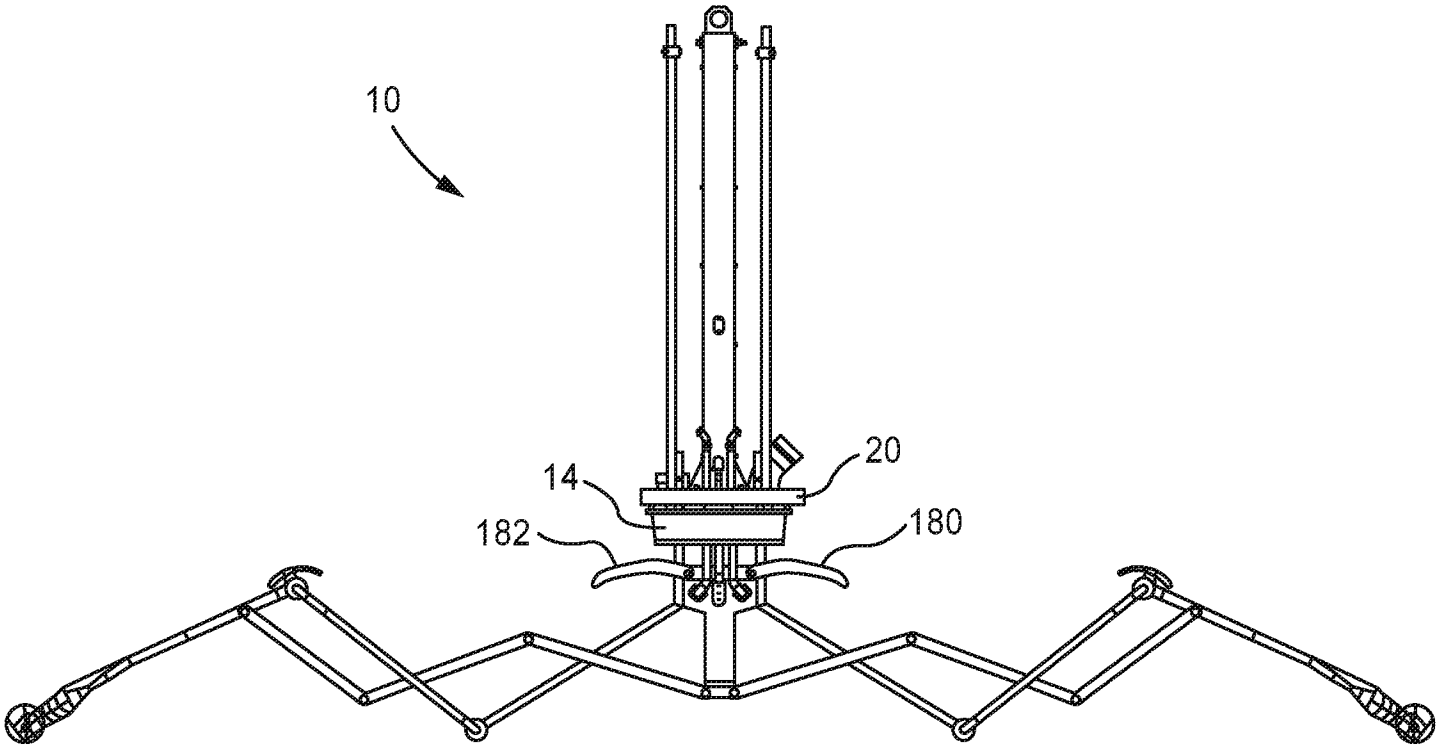
FIG. 48 is a side view of another embodiment of the apparatus in a fully extended position.
Figure 49:
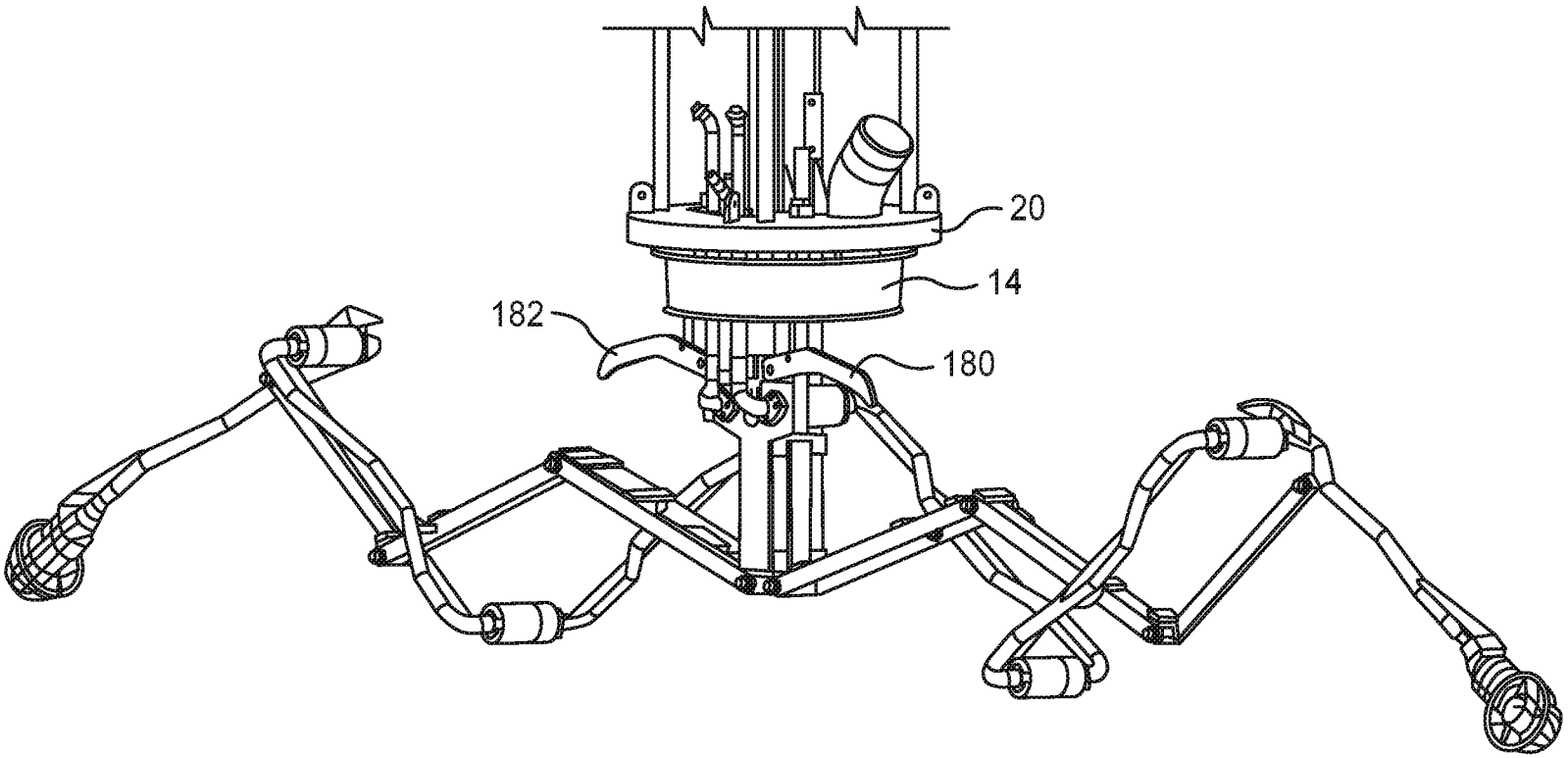
FIG. 49 is a perspective view of part of the apparatus of FIG. 48.
Figure 53:
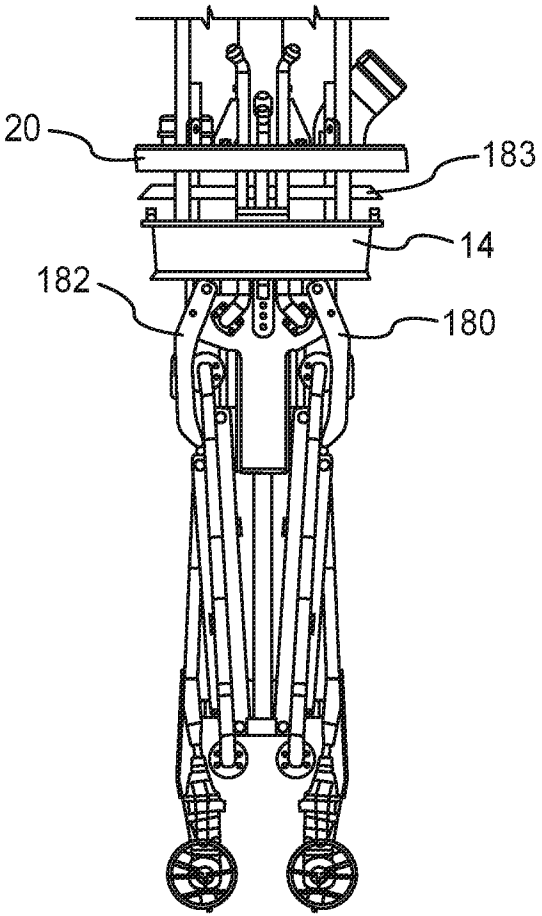
FIG. 53 is a side view of part of the apparatus of FIG. 48 including first and second extendable assemblies in a fully retracted position and the locking assembly in a closed position.

Referring again to FIG. 50, movement of the catch arms 180, 182 along a vertical plane in either direction (see directional arrows L and M) is dictated by linear movement of the mount plate 187 toward and apart from the cross support member 183 (see directional arrows J and K). In particular, as the mount plate 187 is directed toward the cross support member 183 (see directional arrow J) part of the rod 189B is directed into the tube 189A and the vertical connectors 185, 186 pivot about pivot points 192, 193 in a manner effective to direct the vertical connectors 185, 186 inward toward the centerline of the locking assembly 197 (see directional arrow O), which acts on the catch arms 180, 182 directing the catch arms 180, 182 inward (see directional arrow M) toward the centerline of the locking assembly 179 about pivot points 194, 195. Suitably, maximum travel distance of the mount plate 187 toward the cross support member 183, i.e., the closest distance between the mount plate 187 and the cross support member 183, corresponds to a maximum travel distance of the catch arms 180, 182 inward to a fully closed or retracted position ("closed position") as shown in FIG. 53. When the mount plate 187 is directed away from the cross support member 183 an opposite action is realized wherein part of the rod 189B is directed out from the tube 189A and the vertical connectors 185, 186 pivot about pivot points 192, 193 in a manner effective to direct the vertical connectors 185, 186 outward away from the centerline of the locking assembly 197 (see directional arrow N), which acts on the catch arms 180, 182 directing the catch arms 180, 182 outward (see directional arrow L) away from the centerline of the locking assembly 179 about pivot points 194, 195. Suitably, maximum travel distance of the mount plate 187 apart from the cross support member 183, i.e., the furthest distance of the mount plate 187 from the cross support member 183, corresponds to a maximum travel distance of the catch arms 180, 182 outward to a fully open or extended position ("open position") as shown in FIG. 48.

Figure 54:
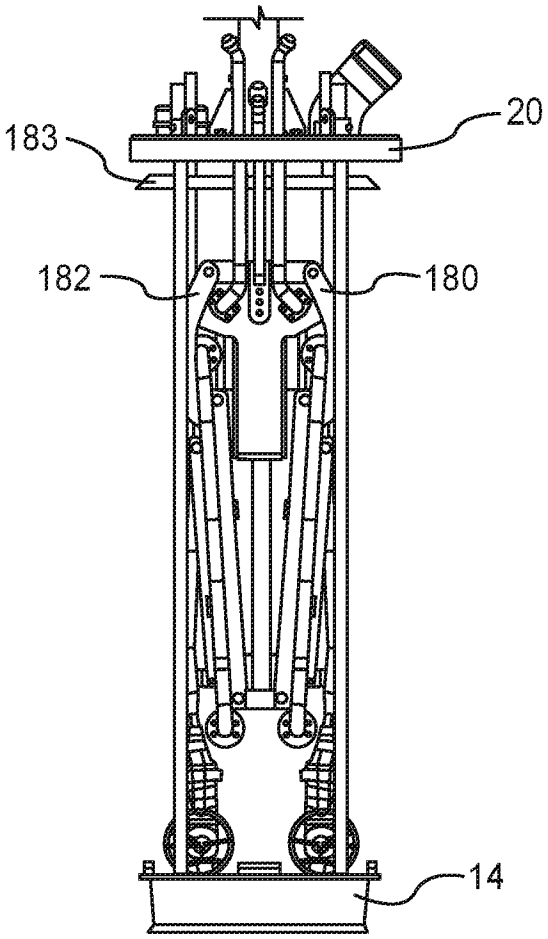
FIG. 54 is another side view of part of the apparatus of FIG. 48 including first and second extendable assemblies in a fully retracted position and the locking assembly in a closed position.

Referring to FIG. 54, when the apparatus 10 is set to a fully closed position the cross support member 183 is located a first distance from the cover member 20. As the apparatus 10 is inserted into a tank 5 the cross support member 183 and the cover member 20 are directed toward the ring member 14 until the cross support member 183 engages the ring member 14 thereby directing the cross support member 183 apart from the mount plate 187 as described above (see directional arrow J), which directs the catch arms 180, 182 to an open position as shown in FIG. 48. Once the apparatus 10 is installed within a tank 5 with the ring member 14 set at a mated position with a manhole 7 of the tank 5, the cover member 20 is set at a mated position with the ring member 14 as described above covering both the ring member 14 and the cross support member 183.

Figure 52:
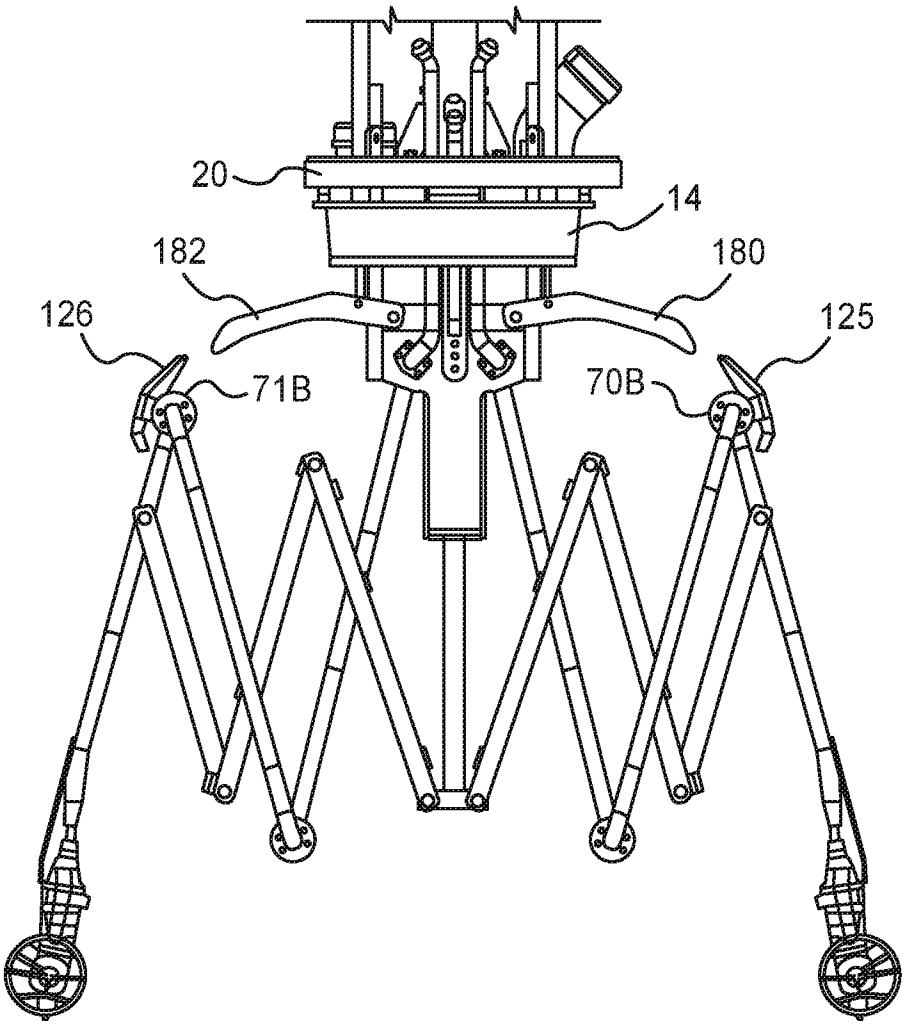
FIG. 52 is a side view of part of the apparatus of FIG. 48 including first and second extendable assemblies in a partially retracted position.
Figure 57:
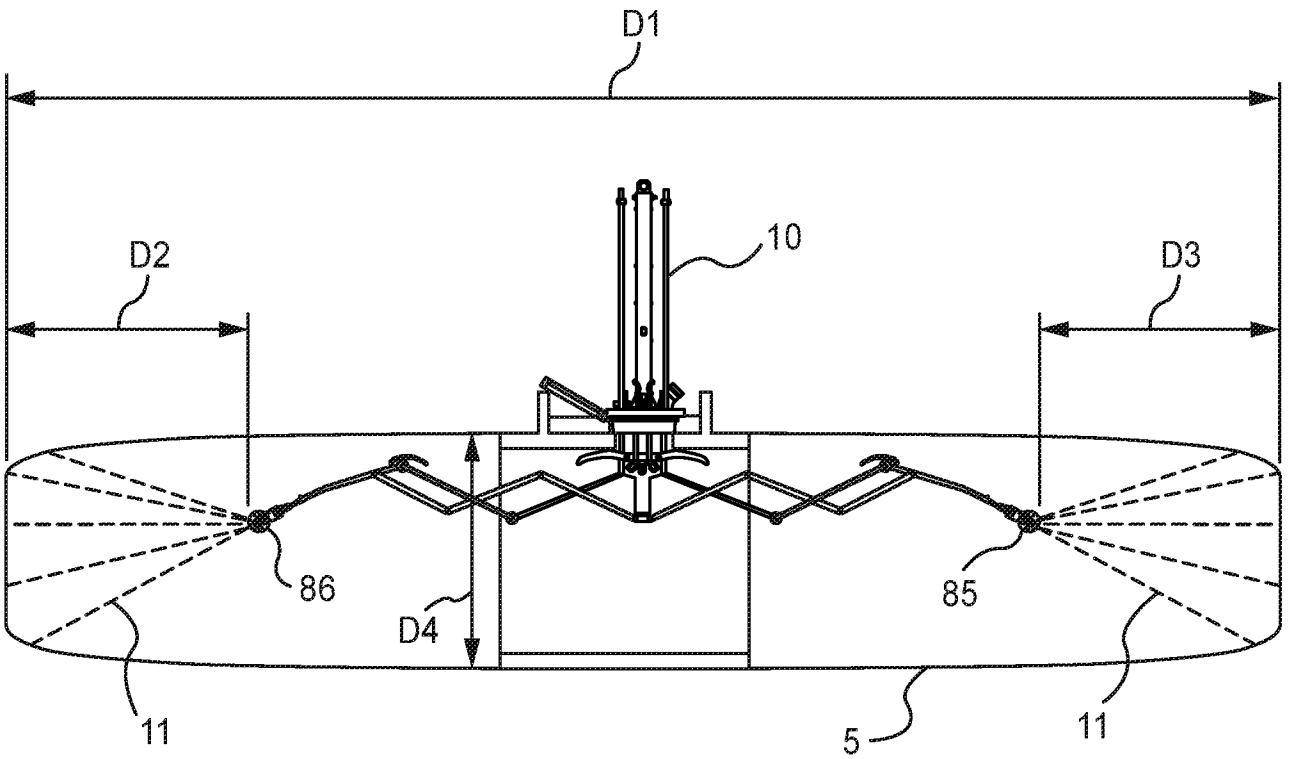
FIG. 57 is a simplified partial phantom side view illustration of a tank during a cleaning operation using the apparatus of FIG. 48.

With reference to FIG. 52, as the first and second extendable assemblies 50, 60 are directed to a fully retracted position, the first and second extendable assemblies 50, 60 are suitably retracted inward to a point so that the distal ends of the catch arms 180, 182 extend out a distance greater than the first and second extendable assemblies 50, 60 allowing the catch arms 180, 182 to engage or contact the first and second extendable assemblies 50, 60 to assist in directing the first and second extendable assemblies 50, 60 to a retracted position as shown in FIG. 53. Accordingly, the catch arms 180, 182 may be referred to as a safety feature safeguarding against the first and second extendable assemblies 50, 60 catching, i.e., getting hung up against, the inner surface of a tank 5 when the apparatus 10 is being removed through a manhole 7. Although the apparatus 10 may be built to scale, each of the catch arms 180, 182 for use with a tank as shown in FIG. 57 includes the dimensions and characteristics as described in Table 1 below.

TABLE 1

| | |
|---|---|
| Length: | 38.5 cm (15.16 inches) |
| Width: | 5.0 cm (1.97 inches) |
| Thickness: | 1.0 cm (0.39 inches) |

Material(s) of construction: Stainless steel AISI 304.

Figure 55:
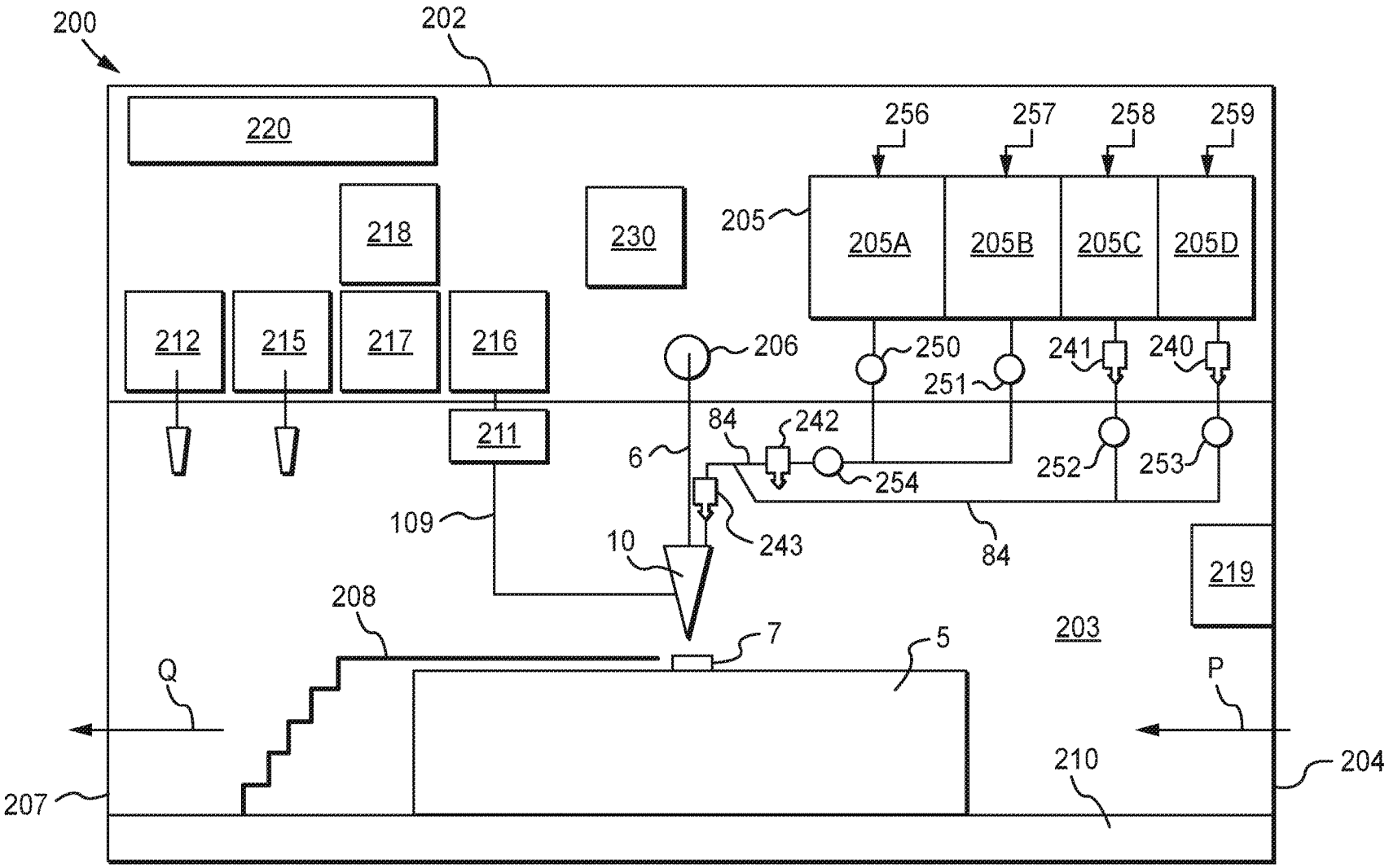
FIG. 55 is a simplified illustration of an embodiment of a system of the present disclosure.
Figure 56:
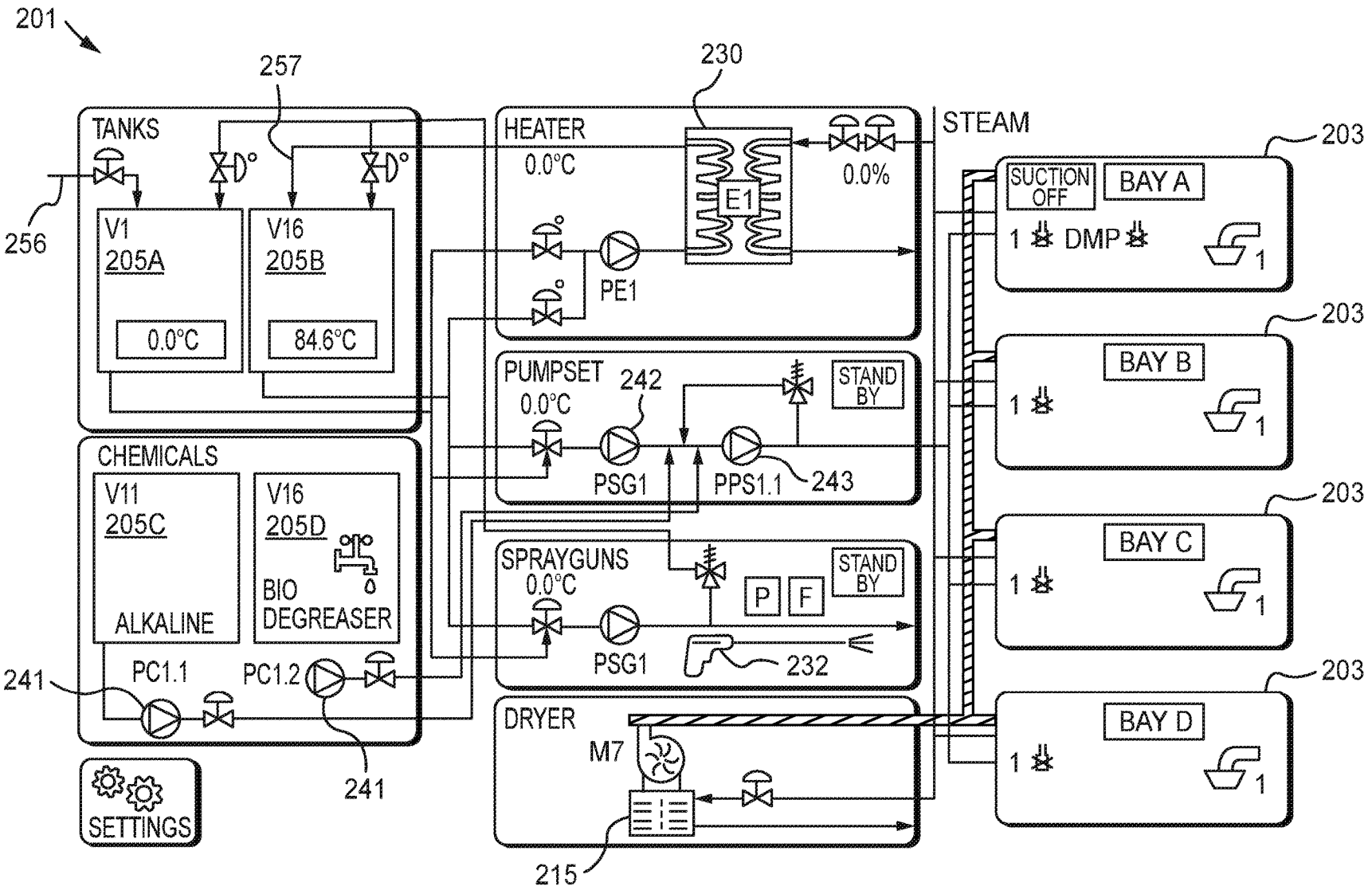
FIG. 56 is a simplified illustration of a user interface of the system of FIG. 55.

Turning to FIGS. 55 and 56, a simplified illustration of an embodiment of the cleaning system 200 of this disclosure including an apparatus 10 as depicted in FIG. 18 or FIG. 48 and a control system user panel (or "user interface 201") of the cleaning system 200 are provided. As shown, one suitable cleaning system 200 may include a cleaning or wash facility, depot, terminal or installation (hereafter "installation 202") designed for cleaning tanks 5, storage containers and/or other items as desired. As known in the art of tank 5 cleaning, an installation 202 may include an enclosure such as a building or warehouse type structure, e.g., a metal building, concrete building, cinder block building, brick building and/or a building constructed from one or more other construction materials, and combinations thereof, with one or more areas designated for tank 5 cleaning operations, e.g., one or more bays 203. In another embodiment, an installation 202 may include one or more open areas provided with a roof, canopy, cover or overhang defining one or more bays 203 for tank 5 cleaning operations.

As shown in FIG. 55, one suitable bay 203 may include an entrance 204 for a tank 5 on one side of the bay 203 (see directional arrow P) and a tank 5 exit 207 on an opposing side of the bay 203 (see directional arrow Q) for ease of tank 5 transport in and out of the bay 203 making way for a successive tank 5 once a cleaning operation is completed on a particular tank 5 previously located within the bay 203. In an embodiment of an installation 202 having a single bay 203, the entrance 204 and exit 207 of the bay 203 may also define the entrance and exit of the installation 202. In another embodiment, a single bay 203 as depicted in FIG. 55 may be located at a point within an installation 202 wherein the installation 202 may include an entrance providing access to an inner bay 203 and an exit for tanks 5 exiting the installation 202.

In another embodiment including a single bay 203 as depicted in FIG. 55 that is located at a point within an installation 202, the installation 202 may include a single opening operable as both an entrance and exit point for tanks 5. In still another embodiment of an installation 202 including two or more bays 203, each individual bay 203 may include its own entrance 204 and separate exit 207 as shown in FIG. 55 defining separate entrances and exits of the installation 202. In another embodiment, an installation 202 with two or more bays 203 may have a single opening operable as both an entrance and exit point for tanks 5 to be cleaned at each of the bays 203 within the installation 202.

An installation 202 may include original construction or include an existing facility renovated, retrofitted or otherwise reconfigured to include the present system 200. An installation 202 may also include an existing cleaning facility in addition to any new construction that may be required for implementation of the system 200 at one or more existing cleaning facilities.

Still referring to FIGS. 55 and 56, one suitable installation 202 may include one or more fluid sources 205 effective to produce a desired pressurized fluid feed up to 5000.0 PSI to the apparatus 10 of the system 200 to facilitate cleaning efficacy of a target tank 5. Suitable fluid sources may include one or more water sources, one or more fluid cleaning chemical sources, and combinations thereof in fluid communication with the apparatus 10 via one or more upstream fluid conduits 84, for example, see the cold water source 205A, e.g., 0.0° C.; the hot water source 205B, e.g., 84.6° C.; the alkaline fluid source 205C; and the bio-degreaser fluid source 205D of FIG. 55. In one suitable embodiment, the one or more chemicals used as part of the system 200 may include one or more biodegradable chemicals.

In one embodiment, the pressurized fluid feed may be produced via gravity including one or more fluid sources 205 located at an elevated locale in reference to the operable location of the apparatus 10. In another embodiment, pressurized fluid may be produced via a pump or a series of pumps 240, 241, 242, 243 allowing the one or more fluid sources 205A, 205B, 205C, 205D to be located at elevations even with or below the location of the apparatus 10 during operation. One or more upstream fluid conduits 84 may also include one or more valves 250, 251, 252, 253, 254 as desired or as otherwise required for a particular operation of the system 200.

As understood by the skilled artisan, the one or more fluids, i.e., the one or more cleaning fluids, provided for a particular cleaning operation may change over time or change on a per tank 5 basis according to the previous content of a target tank 5 prior to cleaning. As shown in FIG. 55, the one or more fluid sources 205 may include two or more storage containers or tanks housing individual fluids that are combined in an upstream fluid conduit 84, e.g., water to be mixed with an alkaline fluid chemical and/or a bio-degreaser and fed to the apparatus 10. In another embodiment, the system 200 may include one or more fluid sources 205 for housing a ready-made cleaning fluid product of a particular chemical composition.

In an embodiment of the system 200 operationally configured to provide pressurized fluid under gravity and/or via the assistance of one or pumps, the layout or design of the installation 202 including for example: (1) the volume of the one or more fluid sources 205, (2) the location of the one or more fluid sources 205 relative the location of the apparatus 10 during system 200 operation, (3) the length of the one or more upstream fluid conduits 84, (4) the inner diameter of the one or more upstream fluid conduits 84, (5) the inner diameter of the fluid conduit sections 64A, 64B and 64C and 66A, 66B and 66C and the corresponding twist couplings 70A, 70B, 71A, 71B, and (6) the viscosity of the cleaning fluid are suitably configured and oriented in a manner effective to produce a pressurized fluid feed out through the spray nozzles 85, 86 at a flow rate of or about 196.8 liters per minute at or about 10.34 MPa to 20.68 MPa (52.0 gallons per minute at or about 500.0 PSI to 5000.0 PSI).

At internal fluid pressures of or about 500.0-5000.0 PSI, the present system 200 is operationally configured to produce jet streams 11 emitted out from each spray nozzle 85, 86 without atomization of the jet streams 11 up to a distance of or about 3.05 meters (10.0 feet) apart from target surfaces of the jet streams 11, e.g., a target inner surface or surfaces of a tank 5, while maintaining a cleaning efficiency satisfactory for cleaning operations as known in the art of tank cleaning (see FIG. 50). An effective jet stream 11 distance of or about 3.05 meters (10.0 feet) may be referred to herein as a target operating distance for each spray nozzle 85, 86 for cleaning operations performed at the above listed flow rate and fluid pressure ranges. The preferred operating distance suitably minimizes the length of the first and second extendable assemblies 50, 60 as well as the overall size of the apparatus 10 necessary for use with a target tank 5 (see FIG. 57). For cleaning operations performed at the above listed flow rate and fluid pressure ranges, a suitable jet stream 11 at the orifices of the spray nozzles 85, 86 has a total impact force of or about 110 N and a jet velocity of or about 140.0 m/s (of or about 5,511.00 inches/s). At the target operating distance, a suitable jet stream 11 has a total impact force against an interior surface such as the inner surface of a tank 5 of or about 65 N and a jet velocity of or about 84.0 m/s (3,307.0 inches/s).

For purposes of this disclosure, for cleaning operations performed at the above listed flow rate and fluid pressure ranges, a suitable fluid jet stream 11 is a fluid jet stream having a maximum diameter no greater than five (5) times the diameter of the corresponding spray nozzle 85, 86 orifice emitting the fluid jet stream 11. For purposes of this disclosure, the term "atomization" refers to when a fluid jet stream 11 begins to disintegrate into fluid drops of or about ten (10) times the diameter of the corresponding spray nozzle 85, 86 orifice emitting the fluid jet stream 11.

As described herein, the apparatus 10 may be provided with first and second extendable assemblies 50, 60 of a known maximum extended position (or maximum "wingspan") based on the size of the manhole 7 and/or the inner dimensions of a target tank 5 to provide a preferred operating distance for a particular tank 5. Suitably, an apparatus 10 may also be used in one or more tanks 5 smaller than a target tank 5 of a particular apparatus 10 by extending each of the first and second extendable assemblies 50, 60 out to a preferred operating distance of the spray nozzles 85, 86 within such tank 5.

In one particular embodiment of the system 200, the size of the various conduits and/or the volume of fluid to be stored in the one or more fluid sources 205 and/or the pumping pressure of the one or more pumps 240, 241, 242, 243 may be operationally configured to provide a desired jet stream 11 at a preferred operating distance for cleaning a desired number of tanks 5 of a particular size before having to refill the one or more fluid sources 205 (see fluid refill inlets 256, 257, 258, 259 in FIG. 55). As such, the one or more fluid sources 205A, 205B, 205C, 205D may include one or more fluid level sources in communication with control circuitry of the system 200.

For cleaning tanks 5 having inner dimensions as described in reference to FIG. 57, the system 200 suitably includes: (1) one or more fluid sources 205 provided as individual containers operationally configured to store at least 1000.0 liters (263.0 gallons) in each individual container; (2) fluid conduit sections 64A, 64B, 66A, 66B having an inner diameter ranging from 2.50 cm to 2.66 cm; (3) one or more upstream fluid conduits 84 having an inner diameter ranging from 4.09 cm to 5.25 cm; and (4) fluid conduits in fluid communication extending from the one or more fluid sources 205A, 205B, 205C, 205D to the spray nozzles 85, 86 at a total length from 15.0 meters to 150.0 meters (45.0 feet to 450.0 feet). For operations at internal fluid pressures of or about 500.0 PSI to 5000.0 PSI, the fluid conduits and fluid conduit sections 64A, 64B, 66A, 66B of the system 200 include heavy wall or thick-walled pressure resistant conduit or piping, e.g., code Schedule 40 thru Schedule 80 pipes.

With further reference to the simplified embodiment of the system 200 of FIG. 55, a suitable lift assembly 6 may include an elevated support member 206 operationally configured to move the apparatus 10 vertically and horizontally as desired. One suitable elevated support member 206 may be located in an installation 202 at a point above the cleaning location or bay 203. One suitable support member 206 may be suspended or otherwise secured to a cross beam or the like of the installation 202—see, for example, cross beam 8 in FIG. 1. Another suitable support member 206 may be set atop an elevated platform or other support surface.

A suitable installation 202 may also include a catwalk 208 or work surface located at or near the top of a target tank 5 enabling personnel access to system 200 equipment, the apparatus 10 and a manhole 7 of a target tank 5. An installation 202 may also include one or more fluid reclamation systems 210 comprised of one or more fluid drains, fluid conduits, filters and storage containers for collecting overspray, spilled fluid and fluids drained from tanks 5 during and after the cleaning process of a target tank 5. Suitably, the one or more fluid reclamation systems 210 are fluidly communicated with the one or more fluid sources 205. One exemplary fluid reclamation system 210 may include a waste water system for pH adjustment and/or water/oil separation.

Other system 200 equipment and features may include, but are not necessarily limited to a water heating system 230 (or "heater") and/or a steam boiler and conduits providing hot water to a hot water source 205B and/or a steam system 212, one or more dryers 215 in fluid communication with the one or more bays 203, one or more spray guns 232 in fluid communication with a cold water source 205A and/or a hot water source 205B and/or a steam system 212, scrub brushes, safety lines/belts, electronic controls, alarm systems, e.g., pressure gauges, temperature gauges, smoke detectors and/or chemical detectors and related emergency alarms. An installation 202 may also include one or more sources of pressurized air 216 in fluid communication with a pneumatic control valve 211 and the cylinder 88 via air line 109, a water purification system 217, an air purification system 218, a temperature control system 219, e.g., air condition/heat, for one or more rooms and/or areas of an installation 202, a control room 220 for operation of the system 200 by personnel, a customer, e.g., a driver, a waiting area (not shown) and personnel office space (not shown).

In one implementation, each bay 203 of an installation 202 may be equipped with its own apparatus 10, one or more fluid sources 205, catwalk 208, electronic controls, alarm system(s), hose reels, swivel joints, steam system 212, dryer 215, scrub brushes, safety lines/belts and control room 220. In another implementation, the system 200 may have a centralized fluid source in fluid communication with each individual bay 203 as shown in FIG. 56. Also, the installation 202 may be sized for cleaning one or more tanks 5 up to a particular maximum height, width and length. An installation 202 may also include a storage lot or parking space area for a particular number of tanks 5 to be kept at the installation 202 for a period of time. In addition, an installation 202 may be provided according to one or more of the following requirements depending on the intended location of the installation 202 or the regulations governing an installation 202 at a particular location:

1. The requirement to use potable water from a certified source;
2. Having to declare the type of cleaning performed on a "wash ticket" or similar item describing the cleaning process performed on a particular tank 5;
3. Having to document the chemical concentration of fluids, e.g., detergent, degreaser and sanitizer, cleaning time and wash/rinse temperatures for each step performed in a particular tank 5 cleaning, making such documentation available upon request;
4. Having to use separate equipment and different bays 203 for cleaning food grade tanks 5 and non-food grade tanks 5;
5. Installation 102 structural requirements, e.g., roof, walls, doors, effective for containing environmental contaminants.

A suitable control room 220 includes computer based controls including one or more user interfaces 201, a hardware and/or software program in communication with the system 200 control circuitry for handling tank 5 cleaning from acceptance through invoicing. One or more user interfaces 201 may be used for manually programming a tank 5 cleaning operation. However, to minimize operational and human errors, software may include automatic programming selections and controls for employing a particular cleaning operation at a desired time interval according to the residual material of a particular tank 5. As an example, a target tank 5 may be provided a unique identification number based on the residue material therein, both of which are programmed into the system 200 and displayed on the physical tank 5 itself for personnel use. The software may also be programmed with (safety) regulations, requirements and instructions for a system 200 operator in regard to the target tank 5. By entering the identification number on the target tank 5, e.g., input control, the correct cleaning program is performed.

The information entered into the software program suitably enables guaranteed required cleaning by continuously recording information from the hardware. By way of one or more user interfaces 201, information such as system 200 diagnostics, system 200 errors, e.g., alarms, the operation of the water heating system 230, the fluid pressure of the system 200, the air pressure of the system 200, boiler operation, pump operation, fluid flow rate, spray gun 232 operation, dosing of detergent, disinfection operations, activities at each individual bay 203, and the temperature may be continuously recorded via one or more sensors and measuring instruments, e.g., output control. The information may be continuously validated during operation. If one or more of the preprogrammed parameters does not meet the required or set values, the software program repeats the previous wash program step. By this principle the quality and assurance of the entire cleaning process of a tank 5 may be monitored and recorded. Following tank 5 cleaning, the system 200 may generate a cleaning certificate, document or other proof of cleaning for use by the customer such as a tank 5 owner or driver of the tank 5.

The invention will be better understood with reference to the following non-limiting examples, which are illustrative only and not intended to limit the present invention to a particular embodiment.

EXAMPLE 1

In a first non-limiting example, an apparatus 10 of this disclosure may be provided for use with a tank 5 as shown in FIG. 57 characterized by the following dimensional information:

D1: 12.8 meters (42.0 feet);
D2: 3.05 meters (10.0 feet);
D3: 3.05 meters (10.0 feet);
D4: 1.83 meters (6.0 feet).

EXAMPLE 2

In a second non-limiting example, an exemplary operational sequence for cleaning a tank 5 using the apparatus 10 of FIG. 18 or FIG. 48 and the system 200 discussed above is described below:

1. A tank 5 to be cleaned is positioned in a bay 203 of an installation 202.
2. A driver of the tank 5 comes to an office of the installation 202 and:
   a. The driver provides office personnel with a CMR or waybill of last product load or contents of the tank 5;
   b. The driver agrees to local safety procedures prior to tank 5 cleaning.
3. The system 200 automatically selects cleaning procedure for the residue within the tank 5.
4. Office personnel confirms cleaning procedure by checking the previous product.
5. An operator in the office provides the washing sequence for the tank 5 to an operator of the bay 203 by printing out the cleaning or washing sequence for hand deliver or by sending the cleaning sequence to the operator digitally, e.g., via a computer network.
6. An operator at the bay 203 opens the cover 92 of the manhole 7 on the top of the tank 5 and checks if any residue (or "heel") is still in the tank 5.
7. If any residue is in the tank 5, an operator at the bay 203 unloads the residue to a collection vessel via a draining hose fluidly communicated with the tank 5 or additionally couple the draining hose to a pump system to pump the residue and the first water flush from the tank 5 to a collective vessel:
   a. Depending on the amount of residue in the tank 5, an extra charge may be added to the total cost of the cleaning operation.
8. An operator at the bay 203 checks tank 5 valves, gaskets, seals:
   a. If required, an operator removes any parts from the tank 5 to be replaced or cleaned manually.

9. The tank 5 is ready to be cleaned.
10. One or more operators at the bay 203 install the apparatus 10 to the tank 5 as described above, e.g., see FIGS. 21 and 22, where the first and second extendable assemblies 50, 60 are aligned within the tank 5 according to the fitting of the notch 94 with the hinge connection 93.
11. An operator at the bay 203 selects the correct cleaning program and starts the cleaning system 200 by entering a code or a program number into a user interface 201 of a computer system of cleaning system 200.
12. During cleaning of the tank 5, operator(s) can:
    a. Prepare documents for an owner or driver of the tank 5.
    b. Using a spray gun 232 one or more operators can:
        i. Clean the exterior of the tank 5; and/or
        ii. Clean (un)loading hoses.
13. When the cleaning program has finished, the apparatus 10 is removed from the tank 5 and one or more operators check the interior of the tank 5 for cleanness, e.g., one or more operators check to make sure there is no remaining residue and/or odor within the tank 5.
14. Cleaning of the tank 5 is completed.
15. As an extra service, the interior of the tank 5 can be dried by placing a drying air tube into the tank 5 via the manhole 7 and start a drying program.
16. Operator(s) can optionally:
    a. Clean the exterior of the tank 5;
    b. Clean the tank 5 valves and gaskets;
    c. Replace tank 5 seals;
    d. Install new parts onto the tank 5.
17. Work on the tank 5 is completed.
18. Office personnel provides the owner or driver of the cleaned tank 5 document(s) related to the tank 5 cleaning operation, e.g. a cleaning certificate indicating the cleaning processes that were performed on the tank 5.
19. The PLC and office system interact and all the data generated while cleaning the tank 5 is stored on a computer server or network for the installation 202 and is ready for reporting purposes.

EXAMPLE 3

In a third non-limiting example, a comparison is provided between (1) the system 200 including an apparatus 10 as shown in FIG. 18 or FIG. 48 as used for a tank 5 cleaning operation and (2) a conventional cleaning operation in the U.S. as of the time of this disclosure that focuses on fluid temperature and the amount of chemicals used for tank cleaning operations.

The present system 200 including the apparatus 10 as shown in FIG. 18 or FIG. 48:

(1) Technology
    (a) Fluid Pressure: High Internal Fluid Pressure of 500.00 PSI to 5000.0 PSI;
    (b) Fluid Volume: Low Volume (94.6 LPM/25.0 GPM per spray nozzle 85, 86);
    (c) Pump Type: Plunger;
    (d) Controls: Fully automated, PLC controlled.
(2) Utilities
    (a) Water Consumption: 1892.7 liters (500.0 gallons) per tank 5;
    (b) Electrical Consumption: 22.0 kW per 25.0 GPM spray nozzle;
    (c) Steam: Related to water consumption;
    (d) Chemicals: 1.9-3.8 liters (0.5-1.0 gallons) per tank 5 cleaning.
(3) Economics
    (a) Cycle Time: 35.0 minute average;
    (b) Maintenance Costs: 2.0 percent of investment in tank 5;
    (c) Manual/Automated: Fully automated;
    (d) Investment: Up to 25.0 percent higher than U.S. conventional cleaning operation;
    (e) Waste Management: Less water (30.0%); less chemicals than U.S. convention cleaning operation (25.0%).
(4) Safety
    (a) Handling: Easy—completely automated. PLC controlled with easy to operate touch screens and/or touch panels.
    (b) Damp: 0.8 percent chemical dosing—minimal, if any, impact on the environment.

Conventional cleaning operation:

(1) Technology
    (a) Fluid Pressure: Medium Pressure (up to 1241.1 kPa or 180.0 PSI);
    (b) Fluid Volume: High Volume (473.2 LPM/125.0 GPM per spray nozzle);
    (c) Pump Type: Centrifugal;
    (d) Controls: Semi-automated, mainly manual controls.
(2) Utilities
    (a) Water Consumption: 2839.1 liters (750.0 gallons) per tank 5;
    (b) Electrical Consumption: 30.0 kW per 125.0 GPM spray nozzle;
    (c) Steam: Related to water consumption;
    (d) Chemicals: 15.1 liters (4.0 gallons) per tank 5 cleaning.
(3) Economics
    (a) Cycle Time: 2.5 hours average;
    (b) Maintenance Costs: 1.5 percent of investment in tank 5;
    (c) Manual/Automated: Manual.
(4) Safety
    (a) Handling: Heavy—completely manual. Heavy chemical usage and exposure to the same.
    (b) Damp: 4.0-5.0 chemical dosing—dangerous environment.

EXAMPLE 4

In a fourth non-limiting example, in a cleaning operation for cleaning a tank 5 as described in Example 1 having a last product load, i.e., "previous commodity," of gasoline, a cleaning operation using the apparatus 10 of FIG. 18 or FIG. 48 and system 200 discussed above is characterized by the following:

(1) Cleaning fluid comprising clean potable water and alkaline and degreaser chemicals;
(2) Target operating distance for each spray nozzle 85, 86 of 3.05 meters (10.0 feet);
(3) Flow rate of cleaning fluid: 200.0 liters per minute at 10 MPa (52.8 gallons per minute at 1,450.4 PSI);
(4) Total volume of cleaning fluid used: 2,000 liters (528.3 gallons);
(5) Duration of cleaning operation: 35.0 minutes.

In comparison, a conventional cleaning operation as described in Example 3 for cleaning the same tank 5 having a last product load of gasoline is characterized by the following:

(1) Cleaning fluid comprising hot water and caustic;
(2) Spray nozzle operating distance of 6.0 meters (19.7 feet);
(3) Flow rate of cleaning fluid: 300.0 liters per minute at 0.8 MPa (79.3 gallons per minute at 116.0 PSI);
(4) Total volume of cleaning fluid used: 3,000 liters (792.5 gallons);
(5) Duration of cleaning operation: 150.0 minutes.

EXAMPLE 5

In a fifth non-limiting example, in a cleaning operation for cleaning a tank 5 as described in Example 1 having a last product load of polyethylene plastic pellets, a cleaning operation using the apparatus 10 of FIG. 18 or FIG. 48 and system 200 described above is characterized by the following parameters:
(1) Cleaning fluid comprising clean potable water and alkaline;
(2) Target operating distance for each spray nozzle 85, 86 of 3.05 meters (10.0 feet);
(3) Flow rate of cleaning fluid: 200.0 liters per minute at 10 MPa (52.8 gallons per minute at 1450.4 PSI);
(4) Total volume of cleaning fluid used: 600.0 liters (158.5 gallons);
(5) Duration of cleaning operation: 6.0 minutes.

In comparison, a conventional cleaning operation as described in Example 3 for cleaning the same tank 5 having a last product load of polyethylene plastic pellets is characterized by the following:
(1) Cleaning fluid comprising hot water and caustic;
(2) Spray nozzle operating distance of 6.1 meters (20.0 feet);
(3) Flow rate of cleaning fluid: 300 liters per minute at 0.8 MPa (79.3 gallons per minute at 116.0 PSI);
(4) Total volume of cleaning fluid used: 1000.0 liters (264.2 gallons);
(5) Duration of cleaning operation: 30.0 minutes.

EXAMPLE 6

In a sixth non-limiting example, in a cleaning operation for cleaning a tank 5 as described in Example 1 having a last product load of food grade citric acid, a cleaning operation using the apparatus 10 of FIG. 18 or FIG. 48 and system 200 described above is characterized by the following parameters:
(1) Cleaning fluid comprising clean potable water and alkaline;
(2) Target operating distance for each spray nozzle 85, 86 of 3.05 meters (10.0 feet);
(3) Flow rate of cleaning fluid: 200 liters per minute at 10 MPa (52.8 gallons per minute at 1450.4 PSI);
(4) Total volume of cleaning fluid used: 1500.0 liters (396.3 gallons);
(5) Duration of cleaning operation: 30.0 minutes.

In comparison, a conventional cleaning operation as described in Example 3 for cleaning the same tank 5 having a last product load of food grade citric acid is characterized by the following:
(1) Cleaning fluid comprising hot water and caustic;
(2) Spray nozzle operating distance of 6.1 meters (20.0 feet);
(3) Flow rate of cleaning fluid: 300 liters per minute at 0.8 MPa (79.3 gallons per minute at 116.0 PSI);
(4) Total volume of cleaning fluid used: 2000.0 liters (514.0 gallons);
(5) Duration of cleaning operation: 60.0 minutes.

Although the disclosure is described above in terms of various exemplary embodiments and implementations, it should be understood that the various features and functionality described in one or more of the individual embodiments are not limited in their applicability to the particular embodiment with which they are described, but instead might be applied, alone or in various combinations, to one or more other embodiments whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like.

Persons of ordinary skill in the art will recognize that many modifications may be made to the present disclosure without departing from the spirit and scope of the disclosure. The embodiment(s) described herein are meant to be illustrative only and should not be taken as limiting the disclosure, which is defined in the claims.

We claim:

1. An apparatus for directing high pressure fluid streams against one or more interior surfaces of a storage container having a manhole disposed along the top of the storage container, including:
a cover assembly in fluid communication with one or more sources of high pressure fluid, the cover assembly comprising a mating member operationally configured to engage a manhole of a storage container and a cover member operationally configured to cover the manhole;
a support assembly attached to the cover member and in fluid communication with the cover member;
a drive rod assembly disposed through the cover member and the support assembly; and
one or more extendable assemblies attached to the support assembly and attached to the drive rod assembly, the one or more extendable assemblies having fluid outlets in fluid communication with the support assembly;
wherein the drive rod assembly is operationally configured to extend and retract the one or more extendable assemblies;
wherein the cover assembly includes one or more guide members interconnecting the mating member and the cover member in a manner effective to axially align the mating member and the cover member; and
wherein the cover member is operationally configured to travel along the one or more guide members to a contact position with the mating member.

2. The apparatus of claim 1 wherein the fluid outlets of the one or more extendable assemblies include high pressure fluid spray nozzles located at the distal ends of the one or more extendable assemblies.

3. The apparatus of claim 1 wherein the cover member includes one or more attachment surfaces for attachment of lifting equipment of the apparatus.

4. The apparatus of claim 1 wherein the drive rod assembly is operationally configured to hold the one or more extendable assemblies in a retracted position and in one or more extended positions.

5. The apparatus of claim 1 including opposing extendable assemblies wherein the drive rod assembly is operationally configured to extend and retract the extendable assemblies simultaneously in opposite directions and hold the one or more extendable assemblies in a retracted position and in one or more extended positions.

6. The apparatus of claim 5 further including a locking assembly attached to the support assembly, the locking assembly including opposing pivotal catch arms operationally configured to direct the opposing extendable assemblies to the retracted position.

7. The apparatus of claim 1 wherein the one or more guide members and the mating member are operationally configured to be suspended from the cover member when the apparatus is lifted by lifting equipment of the apparatus.

8. The apparatus of claim 2 wherein the one or more extendable assemblies include a plurality of support arm members and a plurality of high pressure fluid conduit members assembled in a scissor extendable configuration.

9. The apparatus of claim 1 wherein the cover member includes a fluid inlet in fluid communication with one or more sources of high pressure fluid and in fluid communication with the support assembly.

10. An apparatus for cleaning storage containers, including:

a cover assembly comprising a mating member operationally configured to engage a manhole of a storage container, a cover member in fluid communication with one or more sources of high pressure fluid and operationally configured to cover the manhole, and one or more guide members interconnecting the mating member and the cover member in a manner effective to axially align the mating member and the cover member;

a support assembly in fluid communication with the cover assembly;

a drive rod assembly;

a first extendable assembly having a first fluid outlet in fluid communication with the support assembly and an opposing second extendable assembly having a second fluid outlet in fluid communication with the support assembly; and a locking assembly attached to the support assembly, the locking assembly including opposing pivotal catch arms operationally configured to direct the first extendable assembly and the second extendable assembly to a retracted position;

wherein the drive rod assembly is operationally configured to simultaneously extend and retract the first and second extendable assemblies;

wherein the cover member is moveable along the one or more guide members toward and apart from the mating member; and wherein the catch arms are moveable between a closed position and an open position according to the location of the cover member relative the mating member.

11. The apparatus of claim 10 wherein the cover member includes equidistant lift eyes for attachment of lifting equipment configured to move the apparatus.

12. The apparatus of claim 10 wherein the first fluid outlet includes a first high pressure spray nozzle and the second fluid outlet includes a second high pressure spray nozzle.

* * * * *